United States Patent [19]

Ito et al.

[11] Patent Number: 4,530,477

[45] Date of Patent: Jul. 23, 1985

[54] FLUTTERING KITE

[75] Inventors: Toshio Ito; Akemi Futakawa, both of Amagasaki; Osamu Nakazaki, Nakatsugawa, all of Japan

[73] Assignee: Mitsubishi Denki Kabushiki Kaisha, Tokyo, Japan

[21] Appl. No.: 590,288

[22] Filed: Mar. 16, 1984

Related U.S. Application Data

[63] Continuation of Ser. No. 697,271, Jun. 17, 1976, abandoned.

[30] Foreign Application Priority Data

| | | | |
|---|---|---|---|
| Jun. 26, 1975 | [JP] | Japan | 50-79877 |
| Jun. 26, 1975 | [JP] | Japan | 50-79878 |
| Jun. 26, 1975 | [JP] | Japan | 50-79879 |
| Jun. 26, 1975 | [JP] | Japan | 50-79880 |
| Jun. 26, 1975 | [JP] | Japan | 50-79881 |
| Jun. 26, 1975 | [JP] | Japan | 50-90480[U] |
| Jun. 26, 1975 | [JP] | Japan | 50-90656[U] |
| Jul. 1, 1975 | [JP] | Japan | 50-81603 |
| Jul. 1, 1975 | [JP] | Japan | 50-81604 |
| Jul. 1, 1975 | [JP] | Japan | 50-92611[U] |
| Jul. 2, 1975 | [JP] | Japan | 50-93059[U] |
| Jul. 31, 1975 | [JP] | Japan | 50-93558 |
| Jul. 31, 1975 | [JP] | Japan | 50-93559 |
| Jul. 31, 1975 | [JP] | Japan | 50-93560 |
| Apr. 21, 1976 | [JP] | Japan | 51-50659[U] |

[51] Int. Cl.[3] ..... B64C 31/06

[52] U.S. Cl. ..... 244/153 R; 244/155 A

[58] Field of Search ..... 244/153 R, 154, 16, 244/22; D21/88

[56] References Cited

U.S. PATENT DOCUMENTS

| | | | |
|---|---|---|---|
| 743,301 | 11/1903 | Lischtiak | 244/153 R |
| 1,029,010 | 6/1912 | Guillo | 244/153 R |
| 1,381,264 | 6/1921 | Wilcox | 244/153 R |
| 2,434,077 | 1/1948 | Lang | 244/153 R |
| 2,562,789 | 7/1951 | Holland, Jr. | 244/154 |
| 2,730,318 | 1/1956 | Schild | 244/153 R |
| 3,074,672 | 1/1963 | Hanrahan, Jr. | 244/153 R |
| 3,116,902 | 1/1964 | Gould | 244/153 R |

OTHER PUBLICATIONS

"Secrets of Making and Flying Chinese Kites," Popular Science, Apr. 1960, pp. 178–182.

*Primary Examiner*—Galen L. Barefoot

*Attorney, Agent, or Firm*—Robert E. Burns; Emmanuel J. Lobato; Bruce L. Adams

[57] ABSTRACT

Flying kites are disclosed including the bilaterally symmetric wind-bearing surfaces carried by a plain framework consisting of two triangular portions symmetric with respect to the central axis and pivotally interconnected along that axis. An arcuated resilient rod is fixed to those edges of the framework tilted at equal angles to the central axis. Several reinforcing rods may be disposed on the wind bearing surfaces symmetrically with respect to the central axis and across frame members forming the framework. Also an auxiliary wind including a triangular framework may be fixed to the wind bearing surfaces to be symmetric with respect to the central axis. The equations of motion of the present kite have been obtained and the strength of the framework has been discussed with the characteristics of the kite.

19 Claims, 65 Drawing Figures

FIG. 51
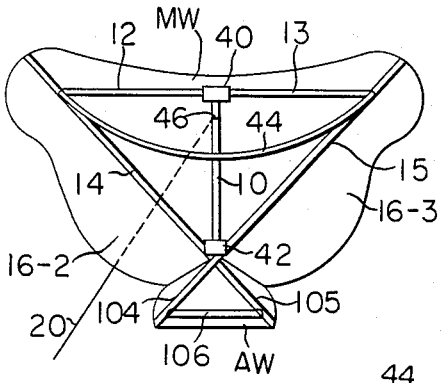
FIG. 52
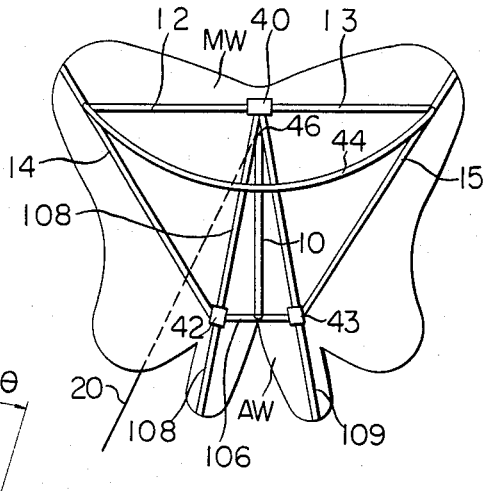
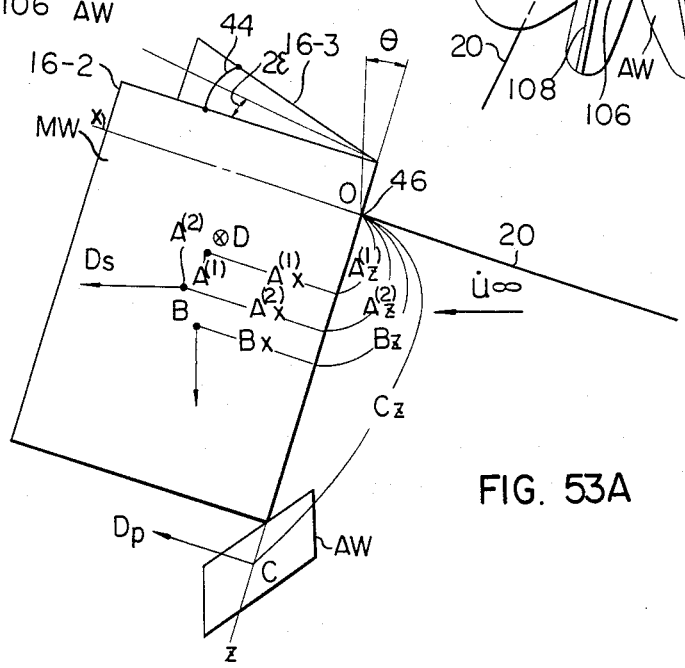
FIG. 53A
FIG. 53B
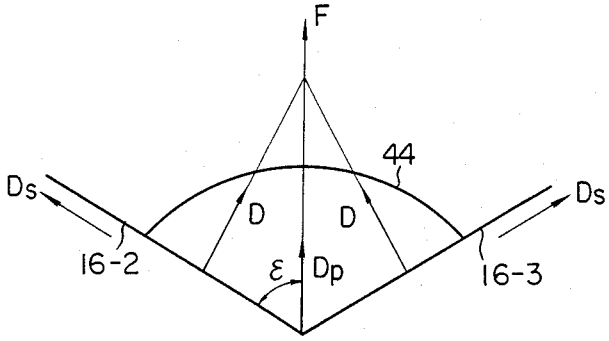

FLUTTERING KITE

This is a continuation, of application Ser. No. 697,271, filed 6-17-76, now abandoned.

BACKGROUND OF THE INVENTION

This invention relates to improvements in a flying object supported by a piece of string to fly in the air by a wind. That is, it relates to the so-called flying kites.

The bilateral symmetric plain surfaces of conventional kites could respond to a wind to be deformed unsymmetrically with their symmetry axis due to frame members involved having different flexibilities. For a relatively strong wind the kites could be rotated until they fall to the ground. Also in three-dimensional kites of the conventional construction, it has been required to increase the strength of frame members involved because the bilateral wind-bearing surfaces undergo a wind to the end. Thus the kites have extremely increased in weight. As a result, such kites have not been raised in the air unless the particular wind is fairly strong and it has been required to use the strong, heavy string therewith because of an increase in wind pressure applied thereto.

Accordingly it is an object of the present invention to provide a new and improved flying object or kite having the following features:

(1) It is sufficiently stable even during a strong wind or a gale;

(2) A wind pressure applied to the kite is limited so as to control forces applied to frame members and string involved to some limits thereby to prevent them from damaging;

(3) It is light enough to go up in the air even by a light wind or a breeze; and (4) The versatility of kite designing is plenty.

SUMMARY OF THE INVENTION

The present invention provides a flying object comprising at least two plain surfaces formed to bear a wind and respond to a wind pressure caused by the wind to change a relative position of one to the other of the plain surfaces, and a string-shaped supporting member for supporting the plain surfaces while the object is flying in the air by the wind.

In a preferred embodiment of the present invention, the flying object may comprise a plurality of frame members disposed symmetrically with respect to a plane passing through the central axis of the object, to be movably interconnected in the central line, a resilient member having a predetermined spring constant to interconnect a pair of the symmetrically disposed frame members, and a surface member disposed in tensioned state on the frame members to form a wind bearing surface, the resilient member being operative to balance a wind pressure acting on the wind bearing surface with an elastic force exerted by the same.

In order to increase the versatility of shapes of the flying object thereof without a decrease in strength of the frameworks, a plurality of secondary frame members may be disposed on the surface member to intersect those frame members forming the frameworks thereby to reinforce the surface member, the secondary frame members being operative to transfer a wind pressure applied to the surface member to the frame members of the framework therethrough.

In order to improve the flying characteristics during a gale without deteriorating the flying characteristics during a breeze, a spring member may be responsive to the relative rotation of the pair of wind bearing surfaces through an angle in excess of a predetermined value to exert a reaction force on the wind bearing surfaces in a direction of preventing the rotation thereof.

In order to stably fly the flying object in the air over a wide range of wind velocities without its fall, the preferred embodiment of the present invention as above described may serve a pair of main relatively movable wings, and an auxiliary wing may be fixedly attached to the main wings on the central axis thereof to be symmetric with respect to the latter, the auxiliary wing including a plurality of frame members forming a triangular framework and another surface member disposed on the triangular framework.

BRIEF DESCRIPTION OF THE DRAWINGS

The present invention will become more readily apparent from the following detailed description taken in conjunction with the accompanying drawings in which:

FIG. 41 is a longitudinal sectional view of the second tubular element shown in FIG. 42;

FIG. 51 is a plan view of another modification of the present invention;

FIG. 52 is a view similar to FIG. 51 but illustrating a modification of the arrangement shown in FIG. 51;

FIG. 53A is a perspective view of a model made for the arrangement shown in FIG. 51;

FIG. 53B is a side elevational view of the arrangement shown in FIG. 53A;

Throughout these Figures wherein various embodiments of the present invention are shown like reference characters and numerals designate the identical or similar components.

DESCRIPTION OF THE PREFERRED EMBODIMENTS

Figure 1:
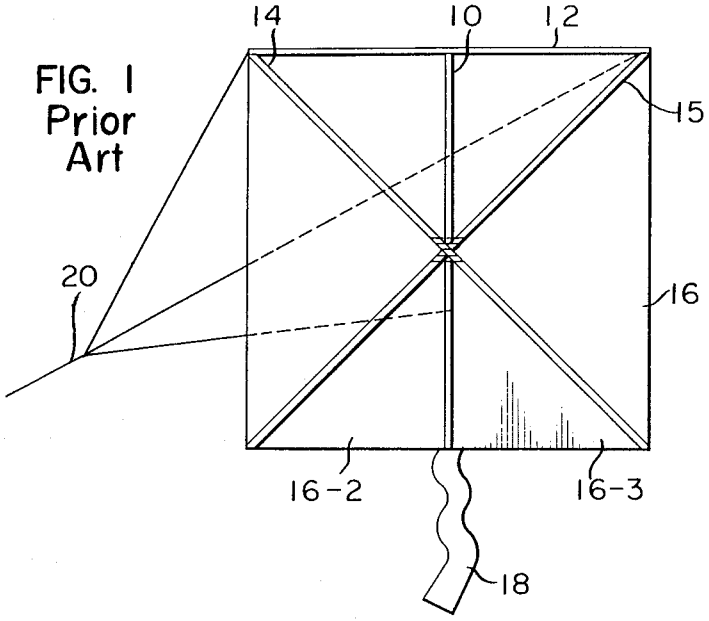
FIG. 1 Prior Art
FIG. 1 is a plan view of a kite most popular in Japan.

Referring now to the drawings and FIG. 1 in particular, there is illustrated a kite well known in Japan. The arrangement illustrated comprises a framework including a spinal frame member 10, a rib frame member 12 connected at the middle point of the spinal member 10 at one end, in this case the upper end as viewed in FIG. 1 to extend perpendicularly to the spinal member, and a pair of stay frame members 14 and 15 disposed in an X shape and having their intersection suitably tied to the spinal member 10 at the middle point. The upper ends as viewed in FIG. 1 of the stay frame members 14 and 15 are suitably connected to both ends of the rib frame member 12 respectively. All the frame members are formed by whittling bamboo (*Phyllostachys mitis*) or the like into slender rods.

Then a rectangular piece of a suitable surface member 16 such as Japanese paper or cloth is bonded on those frame members by means of a suitable paste to form a pair of plain surfaces 16-2 and 16-3 bilaterally symmetric with respect to the axis of the spinal frame member 10. A tail 18 formed preferably of the same material as the surface material 16 is attached to the other or lower end of the spinal frame member 10 to impart the stability to the kite thus produced.

As shown in FIG. 1, three pieces of string 20 are connected at one end to both ends of the rib member 12 and a shutable point on the spinal member 10 respectively and at the other ends to a single piece of string.

It is well known that, as a wind becomes strong to a certain extent, the plain surfaces 16-2 and 16-3 are deformed due to the flexibility of the frame members 12, 14 and 15 or the frame member 10. In this case, if the frame members 12, 14 and 15 are completely uniform in flexibility then the bilateral plain surfaces are deformed symmetrically with respect to the axis of the spinal member 10 providing a symmetry axis and permitted to stably fly in the air without the occurrence of a rotational force due to the wind. However the materials of the frame members are generally different in flexibility from one another and therefore the bilateral plain surfaces may be deformed unsymmetrically with respect to the symmetrical axis formed of the spinal frame member 10. In an extreme case, a relatively strong wind may rotate such a kite until the latter will fall to the ground.

In order to diminish the rotation of the kite as much as possible, the tail 18 has been attached to the lower portion of the kite. The attachment of the tail does not necessarily result in the kite being completely prevented from rotating and rather gives the disadvantage that the kite becomes difficult to fly in the air because the weight of the tail increases the overall weight of the kite.

Figure 2:
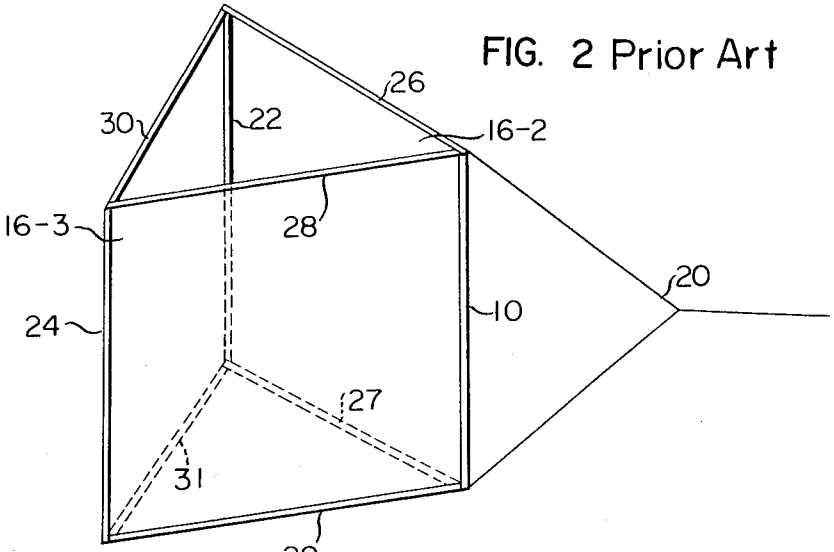
FIG. 2 Prior Art
FIG. 2 is a perspective view of a three-dimensional kite of the conventional construction.

A conventional kite shown in FIG. 2 is of a three-dimensional type and comprises a framework in the form of a triangular prism including a spinal frame member 10 and a pair of auxiliary spinal frame members 22 and 24 disposed in parallel relationship and in such a manner that the upper and lower ends thereof form vertices of identical isosceles or regular triangles. The upper and lower ends of those frame members 10, 22 and 24 are interconnected through rib frame members 26, 28, 30 and 27, 29, 31 extending perpendicularly to the spinal members 10, 22 and 24. Then a pair of plain surfaces portions 16-2 and 16-3 are formed by bonding a corresponding pieces of paper or the like on the frame members 26, 10, 27 and 22 and the frame members 28, 10, 29 and 24 by a suitable paste respectively. The three dimensional kite is completed by attaching forked ends of a piece of string 20 to both ends of the spinal frame member 10.

The arrangement of FIG. 2 has the plain surfaces 16-2 and 16-3 less deformed due to a wind and provides a kite capable of stably flying in the air without the rotation thereof due to the wind. However since such a kite bears a wind pressure to the end resulting in the necessity of increasing the strength of the frame members. As a result, the kite extremely increases in weight. This leads to the disadvantages that the kite is not flying in the air unless the particular wind is fairly strong and that it is required to use a special string that is strong and heavy because a high wind pressure is applied to the kite.

Figure 3:
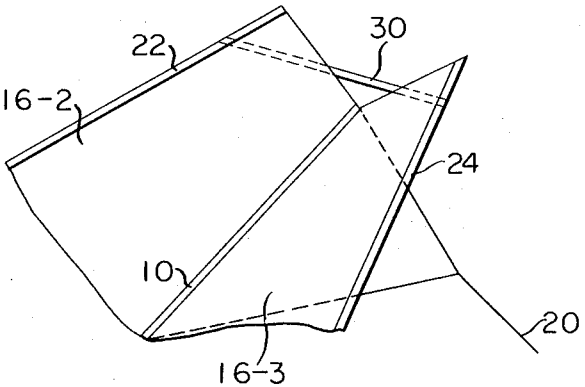
FIG. 3 Prior Art
FIG. 3 is another fragmental perspective view of a conventional kite.

FIG. 3 shows another conventional kite. The arrangement illustrated is different from that shown in FIG. 2 only in that in FIG. 3 the auxiliary spinal frame members 22 and 24 are tilted at relatively small angles to the spinal frame member 10 and interconnected through the rib member 30 connected at both ends to those portions thereof adjacent to the upper ends with all the remaining rib members omitted. The plain surfaces 16-2 and 16-3 are formed of polyvinyl chloride sheet bonded to the associated frame members.

In the arrangement of FIG. 3 the number of the frame members is small as compared with that shown in FIG. 2 resulting in a light kite having the good flight performance. Also when the polyvinyl chloride sheet forming the plain surfaces is high in strength, the kite can continue to stably fly in the air as does the three-dimensional kite shown in FIG. 2. However, regarding the disadvantage of three-dimensional kites that they receive the wind pressure to the end, the arrangement as shown in FIG. 3 has not yet been improved. Therefore upon the arrangement of FIG. 3 undergoing a strong wind, the piece of polyvinyl chloride sheet bonded to the frame members could be stripped from the frame members at their junctions resulting in the damage. Also it has been disadvantageous in that a special high strength string is required as in the arrangement of FIG. 2. Further an interfacial angle formed between the frame member 22 or 24 and the frame member 10 has been limited to an acute angle that is fairly smaller than a right angle which is the great disadvantage of the arrangement shown in FIG. 3. As a result, such kites should be designed within a limited range.

The present invention substantially eliminates the disadvantages of the prior art practice as above described by the provision of a flying object having a novel unique structure including at least two plain surfaces designed and constructed to be relatively movable.

Figure 4A:
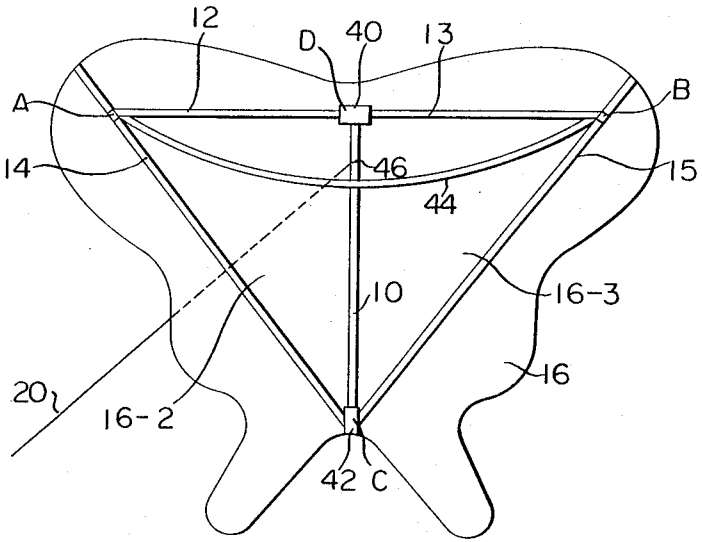
FIG. 4A is a plan view of a flying object or a kite constructed in accordance with the principles of the present invention.

Referring now to FIG. 4A, there is illustrated a flying object constructed in accordance with the principles of the present invention. The flying object is called hereinafter a kite for the sake of convenience. The arrangement illustrated comprises a spinal member 10, a pair of rib members 12 and 13 articulated to each other at a junction 40 to be perpendicular to spinal member 10 to each other, and a pair of stay members 14 and 15 having lower ends connected together by means of a hinge 42 to be tilted at equal angles to the spinal member 10 and upper end portions rigidly connected to the free ends A and B of the rib members 12 and 13 respectively. The spinal member 10 has both ends connected to the junction 40 and the hinge or junction 42 respectively. Thus the stay members 14 and 15 are articulated at lower ends to the lower end of the spinal member 10.

The rib members 12 and 13 are formed of any one of piano wire, yarn, slender bamboo material, wood materials, plastics etc. and serve as tension resisting members playing a role in maintaining distances between points A and D and between the points D and B constant (where D designates the junction of both rib members 12 and 13) while undergoing tension exerted by an arcuated resilient member 44 spanning between the junction A of the lefthand members 12 and 14 and the junction B of the righthand members 13 and 15. The remaining members 10, 14 and 15 are made of a material in the form of slender rods selected from the group consisting of bamboo (*Phyllostachys mitis*), Japanese cypress (*Chamaecyparis obtusa*), *Magnolia obovata*, Japanese ceder (*Cryptomeria japonica*), fir (*Abies firma*), composite materials of plastics, glass fibers etc. The resilient member 44 is formed of a material having a suitable resilience, for example, glass fibers.

Then a bilateral symmetric piece 16 of surfaces material such as paper or polyvinyl chloride sheet is bonded to a framework including the members as above described by means of any suitable bonding agent while a piece of string 16 is tied to a supporting point 46 on spinal member 10.

The framework forms a pair of right-angled triangles ΔACD and ΔBDC identical to each other and bilaterally symmetric with respect to the axis of the spinal member 10 with the side DC common to both triangles. That is, each triangle is a mirror image of the other triangle and therefore plane-symmetric with respect t a plane passing through the common side CD and perpendicular to the plane of FIG. 4A. Both triangles have respective vertices A and B connected through the resilient member 44.

The piece 16 of surface material bonded on the framework forms a pair of plain surfaces 16-2 and 16-3 providing window bearing surfaces articulated to each other along and bilaterally symmetric with respect to the axis of the spinal member 10. While the piece 16 is shown in FIG. 4A as having a profile resembling that of a butterfly flitting as viewed in plan, it is to be understood that the piece may have any desired profile that is bilaterally symmetric with the central axis thereof.

If the rib or shock-resisting members 12 and 13 are made of a relatively rigid material such as bamboo, then the junction 40 is formed, for example, of a hinge.

Figure 4B:
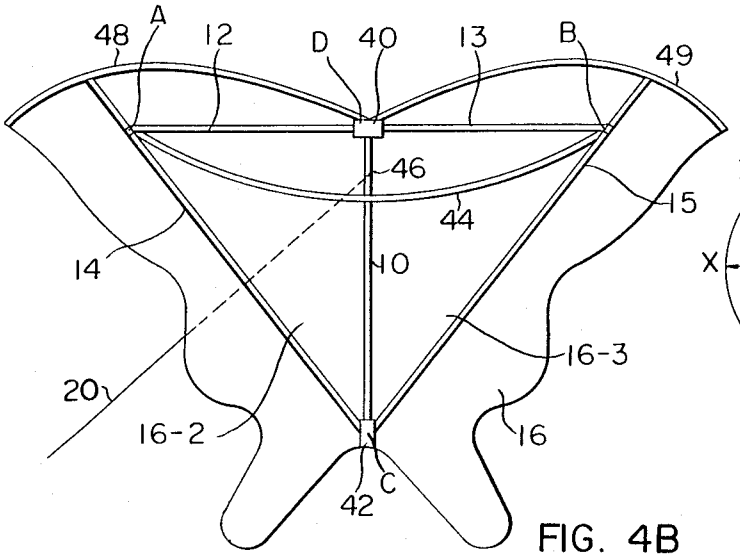
FIG. 4B is a view similar to FIG. 4A but illustrating a modification of the present invention.

The arrangement illustrated in FIG. 4B is different from that shown in FIG. 4A only in that in FIG. 4B each of the plain surfaces 16-2 or 16-3 includes an arcuated rib member 48 or 49 forming the so-called leading edge to winds. Each of the arcuated rib members 48 or 49 has one end pivotally connected to the junction 40 and the other end terminating at the upper corners of the associated plain surface 16-2 or 16-3 with an intermediate portion thereof fixed to the free end of the mating stay member 14 or 15. The arcuated members 48 and 49 are composed of a highly flexible material resisting to shocks, for example, any one of piano wire, bamboo, plastics etc.

The principles and operation of the present invention will now be described in conjunction with the model for kites including a supporting point connected to a piece of string and a pair of plain surfaces substantially symmetrical with respect to a straight line passing through the supporting point as will readily be understood from the illustration of FIGS. 4A and 4B and by using symbols or parameters defined as follows:

S: area of plain surface or wing area $U_\infty$: wind velocity assuming that it only includes a component parallel to the surface of the earth $D^{(1)}$: pressure drag exerting on first one of plain surfaces, for example, the plain surface 16-2 as shown in FIGS. 4A and 4B $D^{(2)}$: pressure drag exerting on second plain surface such as shown at 16-3 in FIGS. 4A and 4B M: mass of modeled kite δ: mass of air $s^{(1)}$: surface vector of first plain surface $s^{(2)}$: surface vector of second plain surface $A^{(1)}$: vector connecting supporting point to center of wind pressure on first plain surface $A^{(2)}$: vector connecting supporting point to center of wind pressure on second plain surface B O: vector connecting supporting point to center of gravity Re: Reynolds number.

Among the above symbols, any symbol having a dot at the top represents a vector. For example $D^{(1)}$ represents a vectorial quantity of a pressure drag exerting on the first plain surface.

Figure 5:
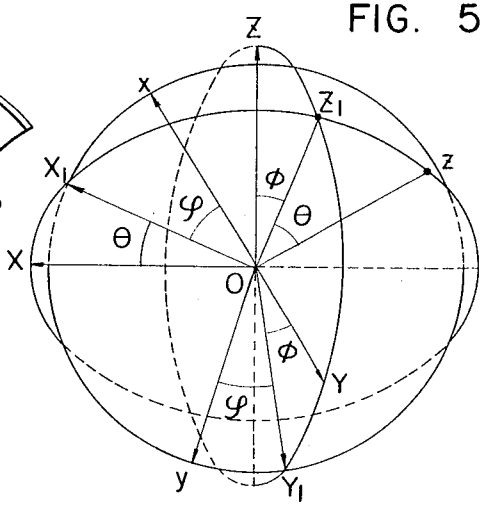
FIG. 5 is a perspective view illustrating the rotational transformation of three-dimensional orthogonal coordinate system.

FIG. 5 shows a three-dimensional orthogonal coordinate system useful for the mathematical analysis of the modeled kite as above described. In FIG. 5 a three-dimensional orthogonal coordinate system X, Y, Z is shown as including an X axis lying in a direction of a velocity of the particular wind, a Y axis orthogonal to the X axis and a Z axis normal to the surface of the earth and orthogonal to the X and Y axes. That coordinate system is assumed to be stationary with respect to the surface of the earth.

It is now assumed that the coordinate system is rotated through an angle $\phi$ about the X axis. This results in the Z and Y axes occupying positions of radii $OZ_1$ and $OY_1$ respectively where O is the origin of the coordinate system. Then the X axis and the radius $OZ_1$ are rotated through an angle $\theta$ about the radius $OY_1$ to be displaced to positions of radii $OX_1$ and Oz respectively. Thereafter the radii $OX_1$ and $OY_1$ are rotated through an angle $\psi$ about the radius Oz to occupy the positions of radii Ox and Oy respectively. This results in another three-dimensional coordinate system including an x and a y and a z axis coinciding with the radii Ox, Oy and Oz respectively and the same origin O as the stationary coordinates systems X, Y, Z. The coordinate system x, y, z thus transformed is assumed to be moving with respect to the surface of the earth.

In the following discussion it is assumed that the moving coordinate system x, y, z is fixed to the particular kite or its model with the z axis coinciding with the symmetry axis comprising the axis of the spinal member 10 shown in FIGS. 4A and 4B and with the x axis bisecting an interfacial angle between the plain surfaces 16-2 and 16-3. Then the coordinate system x, y, z has the origin O coinciding with the supporting point as above described.

The rotational transformation of the coordinate system as above described may be expressed by the equation (1) describing a matrix for the transformation of a coordinate system $$\begin{pmatrix} x \\ y \\ z \end{pmatrix} = \begin{pmatrix} \cos\theta\cos\psi & \sin\theta\sin\phi\cos\psi - \cos\phi\sin\psi & \sin\theta\cos\phi\cos\psi + \sin\phi\sin\psi \\ \cos\theta\sin\psi & \sin\theta\sin\phi\sin\psi + \cos\phi\cos\psi & \sin\theta\cos\phi\sin\psi - \sin\phi\cos\psi \\ -\sin\theta & \cos\theta\sin\phi & \cos\theta\cos\phi \end{pmatrix} \times \begin{pmatrix} X \\ Y \\ Z \end{pmatrix} \quad (1)$$

By using the equation or matrix (1), any vector expressed with respect to the stationary coordinate system X, Y, Z may readily be expressed with respect to the moving coordinate system x, y, z. For example, a wind velocity vector $\dot{U}_\infty$ is expressed by $\dot{U}=(U_\infty, O, O)$ in the stationary coordinate system X, Y, Z because it is assumed that the wind velocity has only one component parallel to the surface of the earth. Therefore, referring to the moving coodinate system x, y, z the wind velocity is expressed by $$\dot{U}_\infty = U_\infty(\cos\theta\cos\phi, \cos\theta\sin\psi, -\sin\theta)$$

Also the gravity Mg applied to the kite or its model is expressed by $Mg=(O, O, -Mg)$ in the stationary coordinate system X, Y, Z and by $$Mg = Mg\begin{pmatrix} -\sin\theta\cos\phi\cos\psi - \sin\phi\sin\psi \\ -\sin\theta\cos\phi\sin\psi + \sin\phi\cos\psi \\ -\cos\theta\cos\phi \end{pmatrix}$$

in the moving coordinate system x, y, z.

Figure 6A:
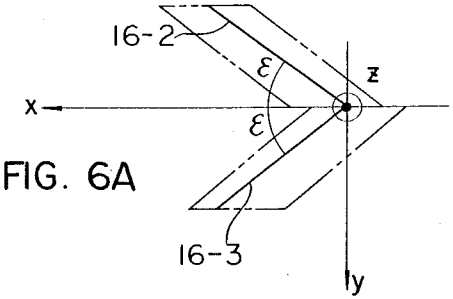
FIG. 6A is a plan view of a model made for the arrangement shown in FIG. 4A or 4B.
Figure 6B:
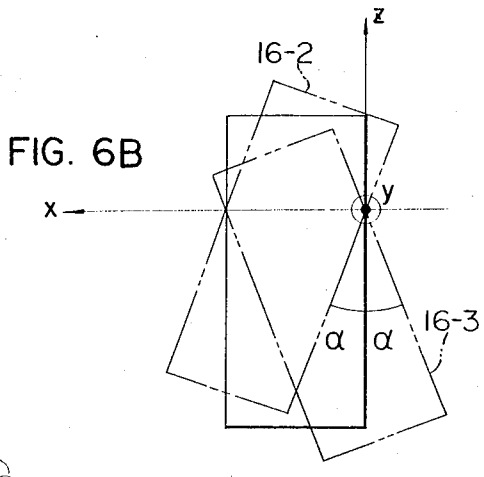
FIG. 6B is an elevational view of the arrangement shown in FIG. 6A.

It is assumed that a modeled kite includes a pair of plain surfaces 16-2 and 16-3 each tilted at an angle $\epsilon$ to the x axis to form an interfacial angle 20 therebetween as shown in FIG. 6A while both surfaces are twisted through a minute angle $2\alpha$ about the y axis. Namely, as best shown in FIG. 6B, the plain surface 16-2 is twisted from its normal position illustrated at solid line in FIGS. 6A and 6B through an angle $\alpha$ in the clockwise direction while the plain surface 16-3 is twisted from its normal position shown at solid line in FIGS. 6A and 6B through an angle x in the counterclockwise direction. In FIGS. 6A and 6B the twisted position of both plain surface are shown at dotted line.

Figure 7:
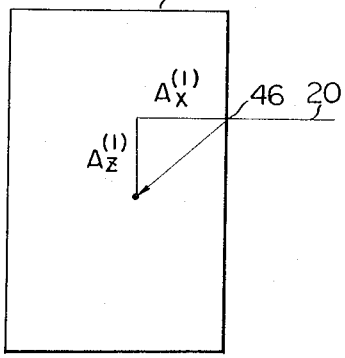
FIG. 7 is an elevational view illustrating a center of wind on one of the wind bearing, plain surfaces shown in FIGS. 6A and 6B.

Under the assumed condition, the plain surface 16-2 has its center of wind $\dot{A}^{(1)}$ expressed by $$\dot{A}^{(1)}=(A_x^{(1)}\cos\epsilon+A_z^{(1)}\sin\alpha,\ -A_x^{(1)}\sin\epsilon,\ A_x^{(1)}\cos\sin\alpha-A_z^{(1)})$$

with reference to the coordinate system x, y, z where $A_x^{(1)}$ designates an x coordinate of the center of wind and $A_z^{(1)}$ designates a z coordinate thereof as shown in FIG. 7.

Similarly the plain surface 16-3 has its center of wind pressure $\dot{A}^{(2)}$ expressed by $$A^{(2)}=(A_x^{(2)}\cos\epsilon+A_z^{(2)}\sin\alpha,\ A_x^{(2)}\sin\epsilon,\ -A_x^{(2)}\cos\epsilon\sin\alpha-A_z^{(2)})$$

where $A_x^{(2)}$ and $A_z^{(2)}$ are similar in meaning to the $A_x^{(1)}$ and $A_z^{(1)}$ respectively.

Also an surface vectors $\dot{s}^{(1)}$ and $\dot{s}^{(2)}$ for the plain surfaces 16-2 and 16-3 are expressed respectively by $$\left.\begin{aligned}\dot{s}^{(1)} &= (\cos\alpha\sin\epsilon,\ \cos\alpha\cos\epsilon,\ \sin\alpha)\\ \text{and } \dot{s}^{(1)} &= (\cos\alpha\sin\epsilon,\ -\cos\alpha\cos\epsilon,\ -\sin\alpha)\end{aligned}\right\}$$

Regarding a wind pressure applied to each plain surface of the molded kite, a pressure drag D per unit area has been calculated at $$\frac{\dot{D}}{S}=\frac{C_D}{2}\delta U^2_\infty\cos\beta\dot{s} \tag{2}$$

with a wind incident upon the associated plain surface at an incident angle less than 45°. In the equation (2) $C_D$ designates a drag coefficient and $\beta$ designates an angle formed between the vectors $U_\infty$ and $\dot{s}$. The drag coefficient $C_D$ is a constant approximately equal to 1.2 for a Reynolds number greater than $10^5$. The above calculation has been made by referring to S. F. Hoerner book entitled "Fluid-Dynamic Drag", 1965, pp 3–16. The pertinent pages of the cite book are incorporated herein by reference.

It will readily be understood that the drag concerning the first plain surface is expressed by the equation (2) having $\dot{D}^{(1)}$ and $\dot{s}^{(1)}$ substituted for $\dot{D}$ and $\dot{s}$ respectively and that the drag concerning the second surface is similarly expressed by the equation (2) having $\dot{D}^{(2)}$ and $\dot{s}^{(2)}$ substituted for $\dot{D}$ and $\dot{s}$ respectively.

By using the fundamental equations as above described torques about the origin of the coordinate system x, y, z are readily calculated.

A torque due to a wind pressure about the origin is expressed by $$\dot{A}^{(1)}\times\dot{D}^{(1)}+\dot{A}^{(2)}\times\dot{D}^{(2)}= \tag{3}$$

-continued $$\begin{pmatrix}-Ax(\sin\epsilon+\cos^2\epsilon)\sin\alpha\Sigma D+Az\cos\epsilon\Delta D\\ -Az\sin=\Sigma D\\ Ax\Delta D+Az\cos\epsilon\sin\alpha\Sigma D\end{pmatrix}$$

where $\Sigma D=D^{(1)}+D^{(2)}$ $Ax=A_x^{(1)}=A_x^{(2)}$ $\Delta D=D^{(1)}-D^{(2)}$ $Az=A_z^{(1)}=A_z^{(2)}$ Also $\Sigma D$ and $\Delta D$ satisfy the following equations:

$$\frac{D}{\frac{C_D}{2}\delta U^2_\infty(2S)}=\cos\theta\cos\phi\sin\delta$$

and $$\frac{\Delta D}{\frac{C_D}{2}\delta U^2_\infty(2S)}=\cos\theta\sin\phi\cos\epsilon-\sin\theta\sin\alpha+\frac{\Delta S}{S}\cos\theta\cos\phi\sin\epsilon \tag{4}$$

where $2\Delta S=S^{(1)}-S^{(2)}$ is held.

By using $B_x$ and $B_y$ similar to $A_x$ and $A_y$ respectively, the positional vector B for the center of gravity is expressed by $$\dot{B}=(B\times\cos\epsilon,\ 0,\ -Bz)$$

Thus a torque $\dot{B}x\times Mg$ due to the gravity about the origin is expressed by $$\dot{B}\times\dot{M}g- \tag{5}$$

$$Mg\begin{pmatrix}Bx(\sin\theta\cos\phi\sin\psi-\sin\phi\cos\psi\\ +Bz(\sin\theta\cos\phi\cos\psi+\sin\phi\sin\psi)+Bx\cos\epsilon\cos\theta\cos\phi\\ Bx\cos\epsilon(\sin\theta\cos\phi\sin\psi-\sin\phi\cos\psi\end{pmatrix}$$

It is now assumed that a kite is flying in the air while stationary with a wind having a constant velocity and a constant direction.

(A) Kite Having Perfect Symmetry

In this case $\sin\alpha=0$ and $\Delta S/S=0$ are held and also due to the symmetry, $\phi$ and $\psi$ are equal to zero. To substitute these conditions into the equations (3) and (4) yields a torques due to the wind pressure and that due to the gravity.

Thus the torque due to the wind pressure is expressed by $$\frac{C_D}{2}U^2_\infty(2S)\begin{pmatrix}0\\ -a_z\cos\theta\sin^2\epsilon\\ 0\end{pmatrix} \tag{6}$$

and the gravity torque is expressed by $$Mg\begin{pmatrix}0\\ +B_2\sin\theta+Bx\cos\epsilon\cos\theta\\ 0\end{pmatrix} \tag{7}$$

The condition for the stationary kite must fulfil (torque due to wind pressure)+(torque due to gravity)=0 Therefore, from the equations (6) and (7), the following relationship is obtained:

$$\tan\theta = \frac{1}{k}\ \frac{Az}{B_2}\sin^2\epsilon - \frac{Bx}{B_2}\cos\epsilon \tag{8}$$

$$\text{where } k = \frac{M_g}{\frac{1}{2}C_D\,U^2{}_\infty\,(2S)}$$

This equation (8) describes the relationship between an attack angle $\theta$ of the kite and a wind velocity.

Figure 8:
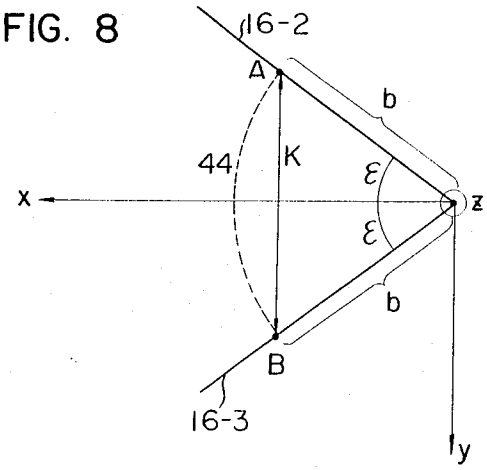
FIG. 8 is a plan view of the modeled kite shown in FIGS. 6A and 6B and having added thereto the arcuated resilient member shown in FIG. 4A or 4B.

The interfacial angle $2\epsilon$ between the two plain surfaces 16-2 and 16-3 will now be calculated with reference to FIG. 8 wherein an arcuated resilient member 44 such as the member 44 illustrated in FIG. 4A or 4B is shown as being connected at both ends to points A and B on both plain surfaces 16-2 and 16-3 forming the angle $2\epsilon$ therebetween. Each point A or B is a distance b from the z axis of the coordinate system x, y, z. Due to the presence of the resilient member 44, the interfacial angle $2\epsilon$ is a function of a wind velocity as will be described hereinafter. This differentiates the kite of the present invention from conventional three-dimensional kite or kites similar thereto.

It is assumed that the resilient member 44 applies to the plain surfaces 16-2 and 16-3 an elastic force having a line of action parallel to the y axis of the coordinate system x, y, z and the absolute value K that is a function of the angle $\epsilon$. Under the assumed condition, a drag D and the absolute value K of the elastic force fulfils the relationship $$B\times D = bK(\epsilon)\cos\epsilon \tag{9}$$

where Bx designates a distance between a center of wind on each of the plain surfaces 16-2 and 16-3 and the z axis.

On the other hand, the equation (2) is reduced to $$D = (C_D/2)\int U^2{}_\infty S\cos\theta\sin\epsilon$$

Multiplying the above equation by $A_x$ is equal to the righthand side of the equation (9). That is, the following equation results:

$$B\times(C_D/2)\int U^2{}_\infty S\cos\theta\sin\epsilon = bK(\epsilon)\cos\epsilon \tag{10}$$

Figure 9:
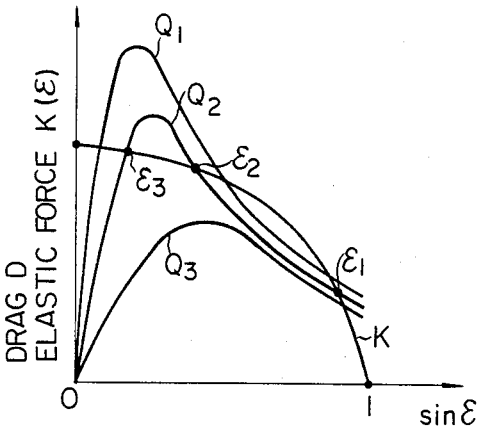
FIG. 9 is a graph illustrating the characteristics of the arrangement shown in FIG. 8 as functions of an interfacial angle between the plain surfaces thereof.

To substitute the $\theta$ obtained from the equation (8) into the equation (10) gives the interfacial angle $2\epsilon$ as a function of the wind velocity $U_\infty$. In order to graphically determine $\sin\epsilon$ or the angle $\epsilon$ satisfying the equations (8) and (10), the lefthand and righthand sides of the latter are calculated at different wind velocities $U_\infty$ on the assumption that $K(\epsilon)=\lambda b(1-\sin\epsilon)$ is held where $\lambda$ designates a spring constant of the resilient member 44 and b designates a distance between the supporting point 46 and the junction A or B of the resilient member 44 and the frame members 12 and 14 or 13 and 15 as shown in FIG. 4A or 4B. The results of the calculations are illustrated in FIG. 9 wherein the axis of ordinates represents the drag D and the elastic force K and the axis of abscissas represents a value of $\sin\epsilon$. The calculated values of both sides of the equation (10) are plotted against $\sin\epsilon$ with the parameter being the wind velocity. Curves labelled $Q_1$, $Q_2$ and $Q_3$ depict the calculated values of the lefthand side of the equation (10) and curve labelled K depicts the calculated values of the righthand side thereof. The reference characters $Q_1$, $Q_2$ and $Q_3$ also designate different values of the wind velocity $U_\infty$ and decreased in the named order.

The intersection of each of curves $Q_1$, $Q_2$ and $Q_3$ and curve K gives a value of $\sin\epsilon$ satisfying the equation (10) or a root thereof. From FIG. 9 it is seen that for a given wind velocity having for example, a small value of $Q_3$, the equation (10) has a single root definitely determined whereas for a given wind velocity having, for example a larger value of $Q_2$ or $Q_1$ exceeding a certain limit, the equation (10) has three roots $\epsilon_1$, $\epsilon_2$, and $\epsilon_3$. If the root $\epsilon_2$ is greater than root $\epsilon_1$ and less than the root $\epsilon_3$ then it can be estimated from FIG. 9 that the $\epsilon_1$ and $\epsilon_3$ are stable solutions of the equation (10) and the $\epsilon_2$ is an unstable solution thereof. This means that the kite of the present invention behaves in extremely interesting manner enriched in variations which is one of the characteristic features of the present invention.

It is particularly to be pointed out that, as seen from the equation (9), a wind pressure applied to the kite is prevented from increasing to exceed an elastic force K of an associated resilient member. This permits the structural members of the present kite to be designed and constructed on the basis of the elastic force $K(\epsilon)$ but not of the wind velocity. Further a kite string involved can be selected on the basis of the elastic force because a force applied to the kite string is equal to at most 2D and therefore 2K. The fact that the strength of structural members including a kite string can be determined only on the basis of the elastic force gives another characteristic feature of the present invention.

In order to determine a minimum wind velocity below which a kite can not fly in the air, it is assumed that an elastic force $K(\epsilon)$ has been selected so that $\epsilon$ is approximately equal to $\pi/2$ radians at the minimum flyable wind velocity. Under the assumed condition the equation (8) is reduced to $$\tan\theta = (1/k)(Az/B_2) \tag{11}$$

On the other hand, lift L applied to the kite is expressed by $$L = \Sigma D\cos\theta$$

The condition for flying the kite is to render the lift higher than the gravity. That is, $$\Sigma D\sin\theta > Mg$$

must be held. Substituting the equation 4 into the above inequality and putting $\epsilon=\pi/2$ in the equation (4) yields $$(C_D/2)\int U^2{}_\infty(2S)\sin 2\theta > Mg$$

Since the lefthand side of the above inequality has a maximum value at $\theta=45°$, concerning to the $\theta$, a minimum value of the kind velocity $(U_\infty)_{min}$ is expressed by $$(U_\infty)_{min} = \sqrt{\frac{M_g}{\frac{C_D}{2}\rho 2S}} \propto \sqrt{\frac{M_g}{2S}} \tag{12}$$

The equation (12) indicates that the smaller the mass per unit area of the kite the better the performance thereof will be.

Also if $\theta=45°$ and $k=\frac{1}{2}$ at the minimum flyable wind velocity are substituted into the equation (11) then the following results:

$$(Az/B_2)=1$$

This means that the kite of the present invention has the best performance when it has the center of gravity the Z coordinate is equal to twice the Z coordinate for the center of wind.

Since the present kite can be designed and constructed in view of the standpoint of the elastic force K as above described, the present invention is greatly advantageous in that the mass per unit area can be made smaller than that in the prior art type kites.

(B) Kite Having Imperfect Symmetry

Upon forming kites, it will be impossible to expect the perfect symmetry of the kites though an effort would be made to obtain the symmetry. Whatever unsymmetry of kites is followed by the fall thereof will now be described $$\Delta S/S \neq 0 \text{ And } \sin\alpha=0 \qquad \text{(B-1)}$$

It is well known that the instability occurs in kites under the influence of strong winds.

Assuming that a gravity torque about the z axis of the coordinate system x, y, z is negligibly small for the sake of simplicity, the conditions for the static equilibrium of a kite about the z axis are obtained from the equations (3) and (4). That is, $$\Delta D=0$$

should be held. To substitute $\Delta D=0$ into the equation (4) concerning $\Delta D$ results in $$\tan/=(\Delta S/s^S)\tan\epsilon \qquad (13)$$

Then the conditions for preventing the rotation about the X axis is derived from the equation (3). Namely a torque due to a wind pressure about the x axis must be null. Accordingly a gravity torque about the x axis is required to be also null which is, substituted into the equation (5) to yield $\tan\phi=\sin\theta\tan\psi$. To substitute this equation into the equation (13) gives $$\tan\phi=-\sin\theta(\Delta S/S)+\tan\epsilon \qquad (14)$$

The equations (13) and (14) describe that for $\tan\epsilon$ on the order of unity, the $\psi$ and $\phi$ are of infinitesmals on the order of $\Delta S/S$ and $\tan\phi$ is on the order of unity only for $\tan\epsilon$ on the order of $S/\Delta S$. In every case, it is seen from the equation (5) that the gravity torque about the z-axis is on the order of $MgBx\Delta S/S$ and negligible as compared with other terms as far as $Mg<<(C_D/2)\int U^2\infty$ is held.

By substituting the two equations (13) and (14) as above described into the equations (3), (4) and (5), the condition for the equilibrium of torques about the y axis can be expressed by the equation $$\tan\theta=\frac{Az\sin^2\epsilon}{KBz\cos\phi}-\frac{Bx\cos\epsilon}{Bz\cos\phi}$$

Particularly for $\tan\epsilon$ on the order of unity, $(\Delta S/S)^2$ is negligibly small resulting in $$\tan\theta=\frac{Az}{kBz}\sin^2\epsilon-\frac{Bx}{Bz}\cos\epsilon$$

The above equation is identical to the equation (8) obtained on the assumption that $\Delta S/S=0$ is held.

From the foregoing it will be appreciated that $\Delta S/S$ does not significantly affect the stability of the kite under the influence of strong winds $$\Delta S/S=0 \sin\alpha\neq 0 \qquad \text{(B-2)}$$

By effecting calculations similar to those described in conjunction with Case (B-1), assuming that a gravity torque about the z axis is similarly negligibly small, the condition for maintaining a kite stationary about the z axis is obtained from the equation (3). That is, the following equation should be held:

$$\Delta D=-(Az/Ax)\cos_2\sin\alpha\epsilon \qquad (15)$$

By substituting this equation into the equation (3), a torque Ta about the x axis due to a wind pressure is expressed by $$Ta=-\sin\alpha\epsilon D\{Ax(\sin\epsilon+\cos^2\theta)+(A^2z/Ax)\cos\epsilon\} \qquad (16)$$

Also by substituting the equation (15) into the equation (4), assuming that the term of the square of $\sin\alpha$ is neglected, the following equation relating to angles is obtained:

$$\sin\phi=\sin\alpha\tan\theta/\cos\epsilon-(Az/Ax)\sin\alpha\sin\epsilon \qquad (17)$$

The condition for equilibrium of torques about the y axis is expressed by $$k\{Bz(\sin\theta\cos_\phi\cos_\phi+\sin\phi\sin_\phi)+Bx\cos_\epsilon\cos\theta\cos\phi\} \qquad (18)$$
$$=Az\sin_\epsilon{}^2\cos\theta\cos_\phi$$

Then the condition for preventing the kite from rotating is such that, with the kite tilted at an angle of 90° to the x axis due to any disturbance, a strength of stability or a righting moment is applied to the kite tending to being about the rotation thereof through an angle not exceeding 90°. In other words, a gravity torque acting as a righting moment is to overcome a corresponding torque due to a wind presure at $\phi=90°$.

Also by substituting 90° for $\phi$ in the equation (5), a gravity torque Tg about the x axis at $\phi=90°$ can be calculated at $$TG=Mg\ Bz\cos\phi \qquad (19)$$

On the other hand, the equation (16) gives a wind-pressure torque Ta about the x axis expressed by $$Ta=\frac{C_D}{2}\rho U_\infty^2 2S\cos\theta\cos\psi\sin\alpha\sin\epsilon\left\{Ax(\sin\epsilon+\cos^2\epsilon)+\frac{A^2z}{Ax}\cos\epsilon\right\} \qquad (20)$$

The equations (19) and (20) are used to calculate the condition for non-rotation about the x axis with the aid of the equation (17) and the equation (18) having 90° substituted for $\phi$, assuming that the terms of $\sin^2\alpha$ and $k^2$ are negligibly small unless the two appear in the form of a ratio.

More specifically, the equation (17) is reduced to $$\sin\psi\approx\sin\alpha\tan\theta/\cos\epsilon$$

On the other hand, the equation (18) is reduced to $$Az \sin^2 \epsilon \cos \theta = kBz \tan \psi$$

To eliminate $\psi$ from these two equations results in $$\mathrm{Cos}\theta = \frac{\sin\alpha}{\sqrt{2}\cos}\left\{1 + \sqrt{1 + \left(\frac{Bz + \cos\epsilon}{Az \sin\alpha \sin^2\epsilon}\right)^2}\right\}$$

By using the equations (19) and (20), $|Tg| > |Ta|$ can be expressed by $$\frac{M_g B_z}{\frac{C_D}{2}\rho U_\infty^2 (2S)} \cos\psi > \cos\theta \cos\psi \sin\alpha \sin\epsilon \times \left\{Ax(\sin\epsilon + \cos^2\epsilon) + \frac{A^2 z}{Az}\cos\epsilon\right\}$$

After the substitution of the above equation for cos $\theta$, the above equation is rearranged to $$\frac{M_g B_z}{\frac{C_D}{2}\rho U_\infty^2 (2S)} \left| \sin^2\alpha > \frac{1}{\sqrt{2}}\left(1 + \sqrt{1 + \frac{Bz\, k \cos^2\epsilon}{Az \sin\alpha \sin^2\epsilon}}\right) \times \left\{\frac{Ax}{Bz}\sin\epsilon(\tan\epsilon + \cos\epsilon) + \frac{Az^2}{AxBz}\sin\epsilon\right\}\right.$$

Under the critical condition that the inequality just described comes into question, $\sin^2 \alpha$ is on the order of k so that the second term within a radical sign on the righthand side of the inequality is negligible. This results in $$\mathrm{Sin}^2\alpha < \frac{M_g}{\frac{C_D}{2}\rho U_\infty^2 (2S)} \left| \frac{1}{\sqrt{2}}\left\{\frac{Ax}{Bz}\sin\epsilon(\tan\epsilon + \cos\epsilon) + \frac{A^2 z}{AxBz}\sin\epsilon\right\}\right.$$

and accordingly $$\sin^2\alpha < \frac{\sqrt{2}\, M_g}{\frac{C_D}{2}\rho U_\infty^2 (2S)} \frac{Bz}{Az \sin\epsilon} \left| \left\{\frac{Ax}{Az}(\tan\epsilon + \cos\epsilon)\frac{Az}{Ax}\right\}\right. \quad (21)$$

This equation describes the condition for non-rotation about x axis.

From the equation (21) it will be understood that, in order to produce kites fulfilling the condition for non-rotation, it is required to make sin $\alpha$ fairly small enough to put it on the order to $\sqrt{K}$. The equation (21) also describes that, in order to stabilize a kite, it is necessary to adjust the twisted angle $\alpha$ of each of two plain surfaces of the kite about the y axis to a value as small as possible. Thus it can be explained that, in order to make the twisted angle as small as possible, the formation of a pair of identical triangles having a common side lying on the z axis ensures that kites are simplest and reliable in structure and light in weight.

Where kites have the basic framework in the form of a triangle, they can be formed into the special shape having an upper wide portion and a lower narrow portion by positioning the base of the triangle on the upper portion thereof. Such a shape has not been found in conventional kites. Thus the present invention is enabled to produce kites symbolical of various forms of life flying in the air, for example, butterflies and birds.

Figure 10:
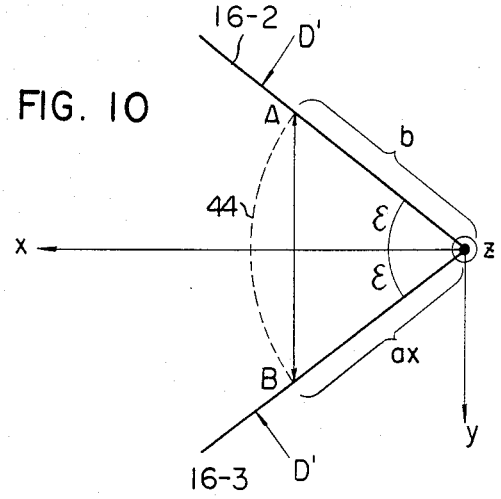
FIG. 10 is a view similar to FIG. 8 and useful in explaining the motion of the arrangement shown in FIG. 8.

The fundamental equations of motion of kites will now be described. In a perfectly symmetric kite shown in FIG. 10 wherein like reference numerals and characters designate the components identical to those shown in FIG. 8, a pair of plain surfaces 16-2 and 16-3 are relatively moved following the fundamental equations of motion:

$$2I_z' \frac{d^2\epsilon}{dt^2} = bk\cos\epsilon - \left(\int_{s1} d(\dot{r} \times d\dot{s}) - \int_{s2} d(\dot{r} \times d\dot{s})\right)_z \quad (22)$$

where Iz' designates a moment of inertia for each plain surface about the z axis and r designates a positional vector for a point on either of the plain surfaces relative to the origin of the coordinate system. The bracket with a suffix z means a z component of a physical quantity within the bracket. In this case, the effect of the gravity upon the relative motion is assumed to be negligibly small.

Regarding a motion of the entire kite, its gravity is moved following the equations of motion $$M\frac{d^2R}{dt} = \Sigma\dot{D} + \dot{F} + M\dot{g} \quad (23)$$

where $\dot{R}$ = positional vector with reference to the stationary coodinate system D = wind force applied to point on either of plain surface and previously called "pressure drag"

$\dot{F}$ = tension of kite string g = acceleration of gravity

Also $\Sigma\dot{D}$ designates the sum of wind forces applied to both plain surfaces and expressed by $$\Sigma\dot{D} = \int_{s1} \dot{d}\cdot d\dot{s} + \int_{s2} \dot{d}\cdot d\dot{s} \quad (24)$$

where d designates a wind force per unit area at a point on either of the plain surfaces. The D is applied to either of the plain surfaces 16-2 and 16-3 in the direction of the arrow D' shown in FIG. 10.

An angular momentum L about the gravity satisfies the equation $$\frac{d\dot{L}}{dt} = -\dot{B}x\dot{F} + \int_{s1} d(\dot{r} - \dot{s}) \times d\dot{s} + \int_{s2} d(\dot{r} + \dot{s}) \times d\dot{s} \quad (25)$$

where $\dot{r}$ designates a positional vector with reference to the moving coordinate system. The equations (22), (23), (24) and (25) are the fundamental equations of motion concerning the kite.

As above described, the kite maintained stationary has applied thereto a wind force D expressed by $$D = \int_s \dot{d}\, d\dot{s} = \frac{C_D}{2} \int U_\infty^2 S \cos\beta \qquad (2')$$

where $\beta$ designates an angle formed between the vectors $\dot{s}$ and a wind velocity $\dot{U}\infty$. As above described the drag coefficient $C_D$ is a constant approximately equal to 1.2. It is to be noted that the equation (2') is held only for $\beta<45°$ and a Reynolds number Re more than $10^5$.

The problem at issue is how the equation (2') will be transformed with the kite moved at a constant wind velocity. In order to solve this problem, the motion of the kite is resolved into a motion of the center of wind per se with a velocity va and a rotational motion about the center of wind with an angular velocity $\Omega$.

The motion of the center of wind gives a wind force expressed by the equation (2') having $\dot{U}\infty + \dot{v}a \cos \dot{\beta}$ substituted for $U\infty \cos \beta$ where $\dot{\beta}$ designates and angle formed between $\dot{U}\infty + va$ and the surface vector.

On the other hand, the rotational motion results in a wind force D expressed by $$\dot{D} = \frac{C_D}{2} \delta(\dot{U}_\infty + \dot{v}a)^2 \cos\beta\, S\, \dot{s} \qquad (26)$$

In this case it is assumed that $r \times \Omega$ affects the kite in the form of a local stagnation pressure. Also the following equation is obtained:

$$\int_s \dot{d}(\dot{r} \times d\dot{s}) = \dot{A} \times \dot{D} + c'_{pp} \int_s U_\infty (\dot{r}_a x \dot{\Omega})(\dot{r}_a \times d\dot{s}) \qquad (27)$$

where ra is a vector connecting the center of wind to a point on the plain surface of the kite.

In the following analysis of the motion, it is assumed that the kite is perfectly symmetric and a wind is not varied with time. Also it is assumed that there is an ideal state in which a kite string is larger in mass than the kite.

Under the assumed condition, it may be considered that the kite effects such a motion that the connection point of the string to the kite is approximately moved as if it is a fixed point. Thus one obtains $$\frac{d^2\dot{R}o}{dt} = \frac{d^2\dot{R}}{dt^2} + \frac{d^2\dot{A}}{dt^2} = \frac{d^2\dot{A}}{dt^2}$$

where $\dot{R}o$ and $\dot{R}$ designate positional vectors with reference to the stationary and moving coordinate systems respectively.

This equation is substituted in the equation (23) to determine $\dot{F}$. To substitute the $\dot{F}$ thus determined into the equation (33) yields $$\frac{d\dot{L}'}{dt} \dot{B} \times M\dot{g} + \dot{A} \times \Sigma D + \qquad (28)$$

$$C_D \qquad S_1 + S_2\, \dot{U}\infty(\dot{r}_a \times \dot{\Omega})(\dot{r}_a \times d\dot{s})$$

$$\text{where } \dot{L}' = \frac{d\dot{L}}{dt} + \frac{d^2B}{dt^2} \times B$$

That is, the $\dot{L}'$ designates an angular momentum about the connection point of the string to the kite.

On the other hand, the equation (20) is transformed to $$2\Gamma z \frac{d^2\epsilon}{dt^2} bk\cos\epsilon - Ax\epsilon D -$$

$$C'_D \left( \int_{s_1} \{\dot{U}_\infty(\dot{r}_a \times \dot{\Omega}) \int (\dot{r}_a \times d\dot{s}) - \int_{s_2} [\dot{U}_\infty(\dot{r}_a x \dot{\Omega})(\dot{r}_a \times d\dot{s}) \right)_2$$

by substituting the equation (2) thereinto. In the equation (29) $C'_D$ designates a drag coefficient of a local stagnation pressure. A bracket with the suffix z has been previously defined.

Here an interest is taken in the oscillation of the angles $\epsilon$ and $\theta$ as previously defined.

Figure 11:
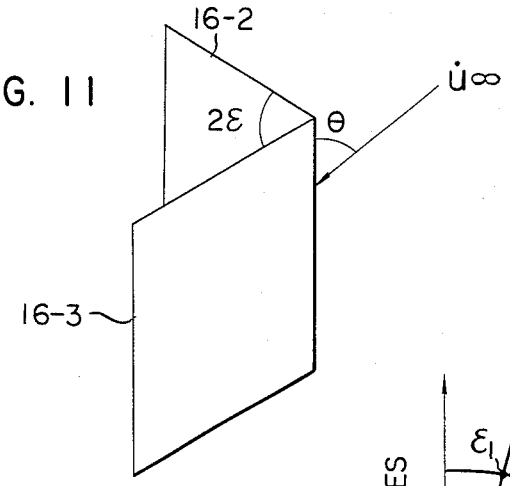
FIG. 11 is a perspective view of a perfectly symmetric kite flying in perfectly symmetric relationship with a wind.

For the purpose of simplifying the analysis, it is assumed that the kite is flying in the air in perfectly symmetric relationship with the particular wind. The arrangement illustrated in FIG. 11 includes a pair of plain surfaces 16-2 and 16-3 forming an interfacial angle $2\epsilon$ therebetween. A wind fully symmetrically blows against the kite while its velocity $\dot{U}\infty$ forms and an angle $\theta$ with the common edge of the plain surfaces. Thus $\psi=0$ and $\phi=0$ are given Under the assumed condition the equation (26) is rewritten to $$D = \frac{C_D}{2} \int (\dot{U}_\infty + \dot{A} \times \dot{\Omega})^2 \cos\dot{\beta} S\dot{s} \qquad (30)$$

$$\approx \frac{C_D}{2} \int U_\infty{}^2 + \frac{C_D}{2} \left\{ \frac{\dot{U}_\infty s}{U_\infty} \dot{U}_\infty + \dot{U}_\infty \frac{\dot{s}}{S} \right\} \dot{A} \times \dot{\Omega}$$

where $\dot{\Omega}=(0, -d\theta/dt \pm d\epsilon/dt)$

Therefore $$\dot{A} \times \dot{\Omega} = (Ax(d\epsilon/dt)) \sin \epsilon - Az(d\theta/dt), \pm Ax(d\epsilon/dt) \cos \epsilon, -Ax(d\theta/dt) \cos \epsilon)$$

also $\dot{U}\infty = U\infty\ (\cos \theta.0, -\sin \theta)$ and $\dot{s}=(\sin \epsilon, \pm\cos \epsilon, 0)$ are obtained. In the above equations the double sign $\pm$ means that the upper sign corresponds to the plain surface 16-2 and the lower sign corresponds to the plain surface 16-3.

By substituting the above $\dot{\Omega}A \times \dot{\Omega}$, $\dot{U}\infty$ and $\dot{s}$ into the equation (30), the D is calculated at $$D/S = Do/S + \frac{C_D}{2} \int U_\infty Ax(1 + \omega S^2\theta \sin^2\epsilon) \frac{d\epsilon}{dt} -$$

$$\frac{C_D}{2} \int U_\infty Az\sin\epsilon \left( 1 + \cos^2\theta = \frac{Ax}{Az} \cos\epsilon\sin\theta \right) \frac{d\theta}{dt}$$

where $Do/S = \frac{C_D}{2} \int U_\infty{}^2 \sin\epsilon\cos\theta$.

Figure 12:
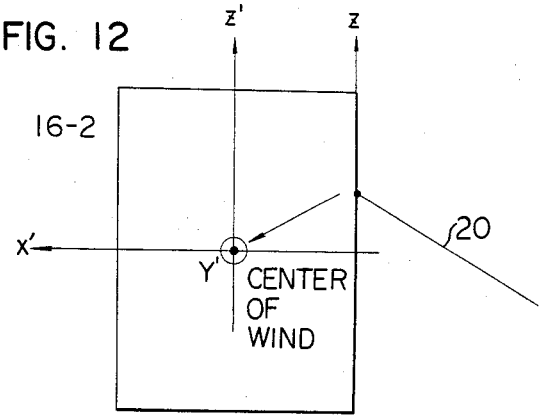
FIG. 12 is a view illustrating a three-dimensional orthogonal coordinate system useful in deriving the fundamental equation of motion of a perfectly symmetric kite.

In order to calculate $$C_D \int_s \{\dot{U}_\infty(\dot{r}a \times \dot{\Omega})\, (\dot{r}_a \times d\dot{s}),$$

any point on the plain surface 16-2 can be expressed with respect to a coordinate system x', y' z' including the origin lying at the center of wind, and an x, a y' and a z' axis parallel to the x, y and z axis as shown in FIG. 12. Then one obtains $$\dot{r}_a = (\underline{x}', 0, \underline{z}')$$

$$d\dot{s} = (0, ds, 0)$$

and $$\dot{U}_\infty = U_\infty(\cos\theta \cos\epsilon, \cos\theta \sin\epsilon, -\sin\theta)$$

After the substitution of those $r_a$, ds and U into the second term on the righthand side of the equation (27), the second term is rearranged. This process is similarly repeated with respect to the other plain surface 16-3 or $S_2$. This results in $$C_D \int_S \dot{U}_\infty(\dot{r}_a \times \dot{\Omega})(\dot{r}_a \times d\dot{s}) = S\begin{pmatrix} \mp C_D \int U_\infty \cos\theta \cos\epsilon \bar{h}^2(d\theta/dt) \\ C_D \int U_\infty \cos\theta \sin\epsilon \bar{h}^2(d\theta/dt) \\ \pm C_D \int U_\infty \sin\theta\,(\theta \pm \epsilon)\overline{W}^2(d\epsilon/dt) \end{pmatrix}$$

expressed with respect to the coordinate system x', y', z', where $$\bar{h}^2 = \int_{S_1} z'^2 ds/S$$

$$\overline{W}^2 = \int_{S_1} x'^2 ds/S$$

Also the upper and lower portions of the double sign correspond to the plain surfaces 16-2 and 16-3 respectively as above described.

Assuming that the z axis is the principal axis, only the y component of the equation (28) may be discussed. Although this assumption is not correct in many cases, it is not deprived of the generality because the z axis can supposedly be the principal axis by adding to the kite a virtual inertia receiving no wind pressure. Thus the equation (28) is reduced to $$\frac{d}{dt}\left(I' \frac{d\theta}{ydt}\right) + \frac{C_D}{2} \int U_\infty 2S\sin\epsilon \left[\left\{(1 + \cos^2\theta)\sin\epsilon A^2 z + 2\frac{C_D}{C_D}\cos\theta \bar{h}^2\right\} - AxAz\cos\epsilon\sin\theta\right] \frac{d\theta}{dt} + Mg(Bz\sin\theta + Bx\sin\epsilon\cos\theta) - \frac{C_D}{2} \int U_\infty{}^2 2SAz\sin^2\epsilon\cos\theta = 0 \quad (31)$$

where Iy' designates a moment of inertia for each plain surface about the y axis of the kite.

Also the equation (29) is transformed to $$2I'z\frac{d^2\epsilon}{dt^2} + \frac{C_D}{2} \int U_\infty 2S\left\{(1 + \cos^2\theta\sin^2\epsilon)A^2 x + 2\frac{C_D}{C_D}\cos\theta\sin\overline{W}^2\right\}\frac{d}{dt} = bk\cos\epsilon - \frac{C_D}{2} \int U_\infty{}^2 2SAx\sin\epsilon\cos\theta \quad (32)$$

In this way the equations of motion concerning kites have been obtained.

It is here to be noted that the coefficient of $d\theta/dt$ in the equation (31) is possible to become negative under the following conditions:

(1) The condition that $A_x$ is greater than $\sqrt{h^{-2}}$ and Az that is to say, the kite has a large aspect ratio. Examples of such kites involve triangular or inverted triangular kite, rhombic kites, rectangular kites small in height and wide in width etc.;

(2) The condition that $\theta$ is large and $\epsilon$ is relatively small; and (3) The condition that a change in $\epsilon$ is smaller than a change in $\theta$:

Under these condition, kites are negatively damped so that they are initiated to effect the sustained vibration about the equilibrium point, as if they would be alive, and even at the constant wind velocity.

Figure 13:
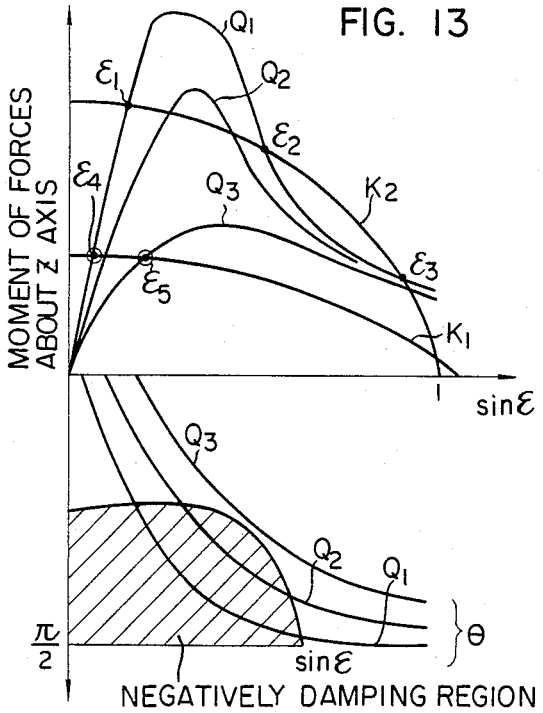
FIG. 13 is a graph illustrating the characteristics of a perfectly symmetric kite as a functions of an interfacial angle between a pair of plain surfaces thereof.

This sustained vibration will be in somewhat more detail described. An equilibrium point for the equations (31) and (32) may be graphically determined from FIG. 13 wherein moments of the wind force and elastic force about the z axis are plotted in ordinate against sin $\epsilon$ in abscissa with the parameter being a wind velocity on the upper portion. In FIG. 13 like reference characters are identical in meaning to those shown in FIG. 9. As seen in the upper portion of FIG. 13, curves labelled $Q_1$, $Q_2$ and $Q_3$ intersects curves labelled $K_1$ and $K_2$ at points $\epsilon_1$, $\epsilon_2$, $\epsilon_3$, $\epsilon_4$ and $\epsilon_5$. The reference characters $Q_1$, $Q_2$ and $Q_3$ also means a higher a moderate and a lower wind velocity respectively while the reference characters $K_1$ and $K_2$ also means a proper and a smaller value of the elastic force $K(\epsilon)$ assumed to be expressed by $K(\epsilon)=\lambda b(1-\sin\epsilon)$ as above described.

For the proper value of the elastic force curve $K_1$ is shown in FIG. 13 as intersecting the curve $Q_1$ at three points $\epsilon_1$, $\epsilon_2$, and $\epsilon_3$. As will readily be understood from the description for FIG. 9, the points $\epsilon_1$ and $\epsilon_3$ provide the stable solutions of the equation (32) and the point $\epsilon_2$ provides the unstable solution thereof.

On the other hand, negatively damping region obtained by the equation (31) is designated by a hatched area shown in the lower portion of FIG. 13 wherein $\theta$ is plotted as a function of sin $\epsilon$. Curves labelled $Q_1'$, $Q_2'$ and $Q_3'$ respectively correspond to a higher, a moderate and a lower wind velocity with the parameter being the wind velocity.

Where a kite has the characteristics as shown at curves $Q_1$ and $K_2$ in FIG. 13, the kite effects the sustained vibration having a finite amplitude over both the negatively damping region and a positively damping region and about a suitable point between the points $\epsilon_1$ and $\epsilon_2$. This is the principles of the kite according to the present invention.

On the other hand, it will be appreciated from the lower portion of FIG. 13 that for a low elastic force the motion just described never occurs.

In conventional kites such as three-dimensional kites having sin $\epsilon$ remaining unchanged, the occurrence of the negative damping does not lead to their being operated in the vibrating mode but the $\theta$ may increase beyond 90°. As a result, the kites forwardly tumble until they will fall to the ground. This has been very frequently experienced.

From the foregoing it can be appreciated that the present invention provides a flying object excellent in stability and capable of effecting, for itself, a motion resembling the fluttering.

Numerous kites were produced, by way of trial, in accordance with the principles of the present invention as above described and examined in terms of the deformation and strength of the framework involved.

It is noted that the symbols and reference characters used with the following description, and therefore the pertinent Figures, are not similar to those employed in the embodiments of the present invention as above described and accordingly have been independently selected.

Figure 14A:
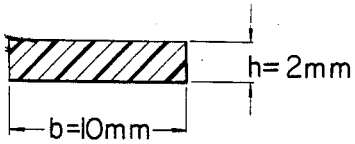
FIGS. 14A and 14B are cross sectional view of different frame members used with the present invention.
Figure 14B:
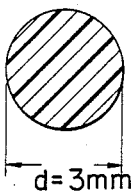

Specimens No. 1 and No. 2 included wooden rods of rectangular cross section each having a width b of 10 mm and a height h of 2 mm as shown in FIG. 14A and Specimen No. 1 included bamboo rods of circular cross section having a diameter d of 3 mm as shown in FIG. 14B. Materials of Specimen No. 1 were different in mechanical strength from those of Specimen No. 2 and the sort thereof was not known.

Figures 15, 17:
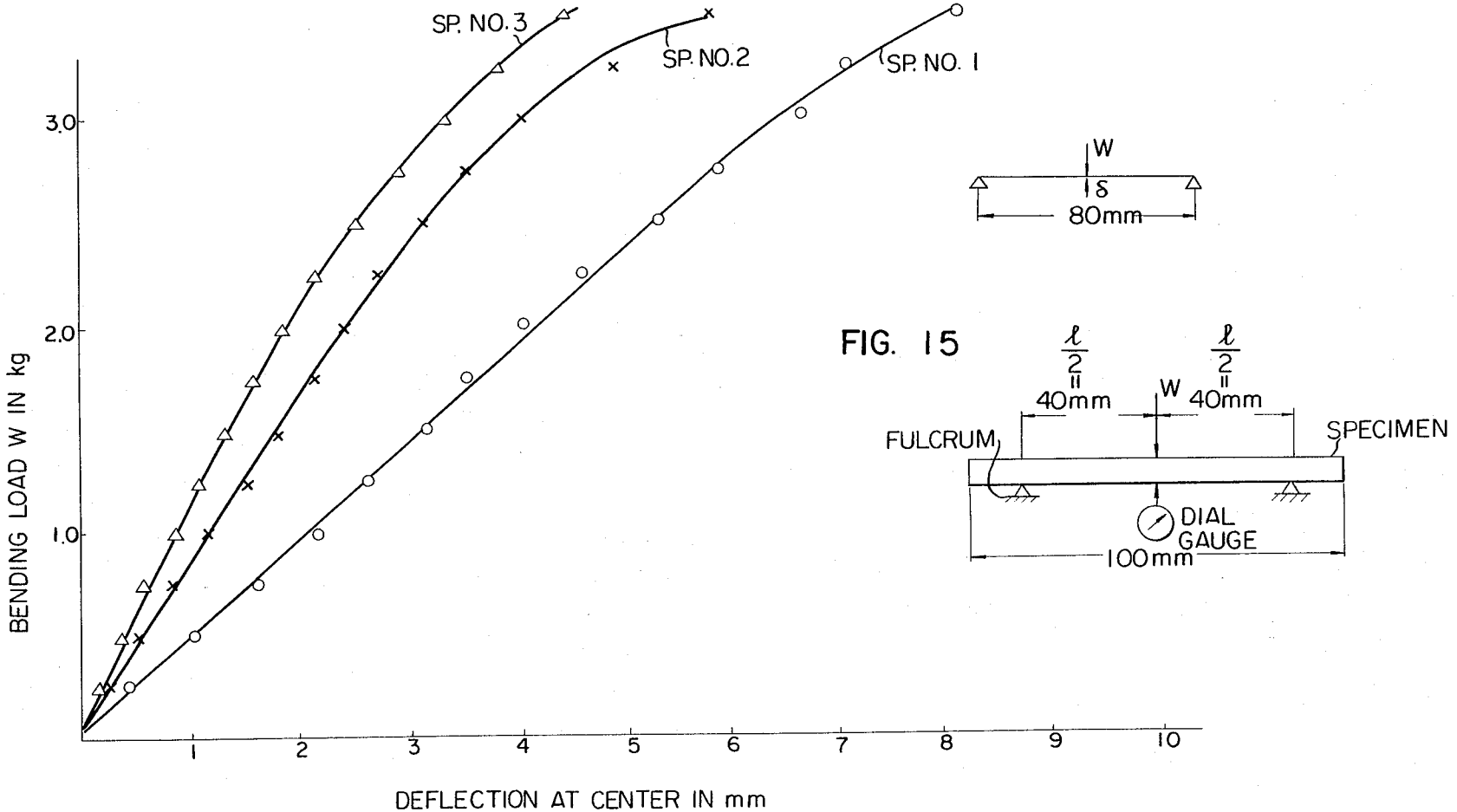
FIG. 15 is a schematic diagram illustrating a method of measuring a bending of a rod.
FIG. 17 is a graph illustrating the results of the measurements shown in FIG. 15 conducted with the frame members shown in FIGS. 14A and 14B.

The rods as above described were cut into lengths of 100 mm and supported on the lower side by a pair of fulcra equally spaced apart distances ½ of 40 mm from the center thereof as shown in FIG. 15. Then a bending load W was applied to the upper side of each rod at the center while the load was successively varied. In this way, the bending load was measured while a corresponding deflection at the center was read by a dial gauge (see FIG. 15) and a maximum value of the bending load was determined.

Figure 16:
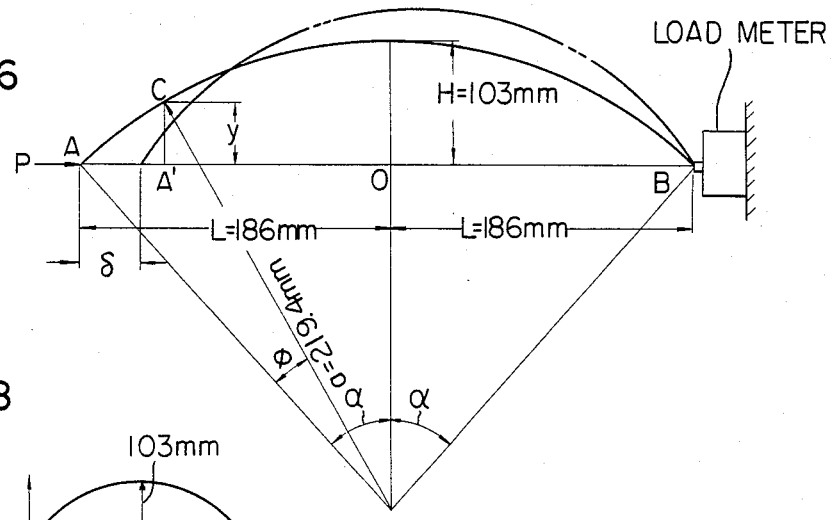
FIG. 16 is a schematic diagram illustrating a method of measuring the load-to-deflection characteristic of a circularly segmental beam.

Further rods quite identical to those called Specimens No. 1, No. 2 and No. 3 were cut into suitable lengths to prepare the resilient members 44 as shown in FIGS. 4A and 4B. The resilient members thus prepared and now called "circularly segmental beam" were tested by testing method as shown in FIG. 16. The beam was initially arranged to be substantially equal in shape to the actual resilient member 44, having, for example, dimensions as shown in FIG. 16 with one end fixed to a load meter (see FIG. 16). Then a load P was applied to the other end A in a direction interconnecting both ends A and B to deform the beam from its shape illustrated at solid line to its shape illustrated at dotted line in FIG. 16. At that time the load was read by the load meter while a corresponding deflections $\delta$ in the direction AB was measured.

The results of the measurements as shown in FIG. 15 are indicated in FIG. 17 wherein the bending load W in kg is plotted in ordinate against the deflection $\delta$ in mm at the center of the rod in abscissa. In FIG. 17 curves labelled No. 1, No. 2 and No. 3 describe Specimens No. 1, No. 2 and No. 3 respectively.

Under the loading condition such as shown in FIG. 15, the deflection $\delta$ and the bending load W fulfil the relationship $$\delta = \frac{l^3}{48EI} P$$

where

E=modulus of longitudinal elasticity l=distance between both fulcra

I=geometrical moment of inertia

This equation gives the longitudinal elastic coefficient E expressed by $$E = \frac{l^3}{48I} \frac{W}{8}$$

Thus one obtains $$E = \frac{l^3}{4bh^3} \frac{W}{8} \tag{33}$$

for a specimen of rectangular cross section having width b and a height h and $$E = \frac{4\,l^3}{3\pi d^4} \frac{W}{8} \tag{34}$$

for a specimen of circular cross section having a diameter d. By substituting l=80 mm, b=10 mm, h=2 mm and measured value of W/$\delta$ from the results of the measurements into the equation (33), Specimens No. 1 and No. 2 were determined to have moduli of longitudinal elasticity E of $0.744\times10^3$ and $1.30\times10^3$ Kg/mm$^2$ respectively. The same substitution into equation (34) except for d=3 mm substituted for b=10 mm and h=2 mm resulted in Specimen No. 3 having modulus of longitudinal elasticity E of $2.83\times10^3$ Kg/mm$^2$.

Under the loading condition such as shown in FIG. 15, the load W and a corresponding bending stress $\delta_b$ fulfil the following relationship:

$$\lambda b = \frac{3\,l}{2bh^2} W$$

for a specimen having a rectangular cross section or $$b = \frac{8}{3\,d^3} W$$

for a specimen having a circular cross section. By utilizing the dimensions as shown in FIGS. 14A and 14B, these equations give the following Table I also listing the measured maximum value $W_{max}$ of the bending load:

TABLE I

| Specimen No. | Bending Strength of Specimen: Max. Bend. Load in Kg | Bend. Stress in Kg/mm$^2$ |
|---|---|---|
| No. 1 | 3.3 | 9.9 |
| | 3.6 | 10.8 |
| No. 2 | 3.7 | 11.1 |
| | 3.7 | 11.1 |
| No. 3 | 4.4 | 33.0 |
| | 3.7 | 27.9 |

Figure 18:
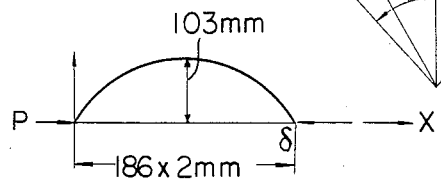
FIG. 18 is a graph illustrating theoretical and measured values of the load-to-deflection characteristic of the segmental beam shown in FIG. 16.
Figure 18:
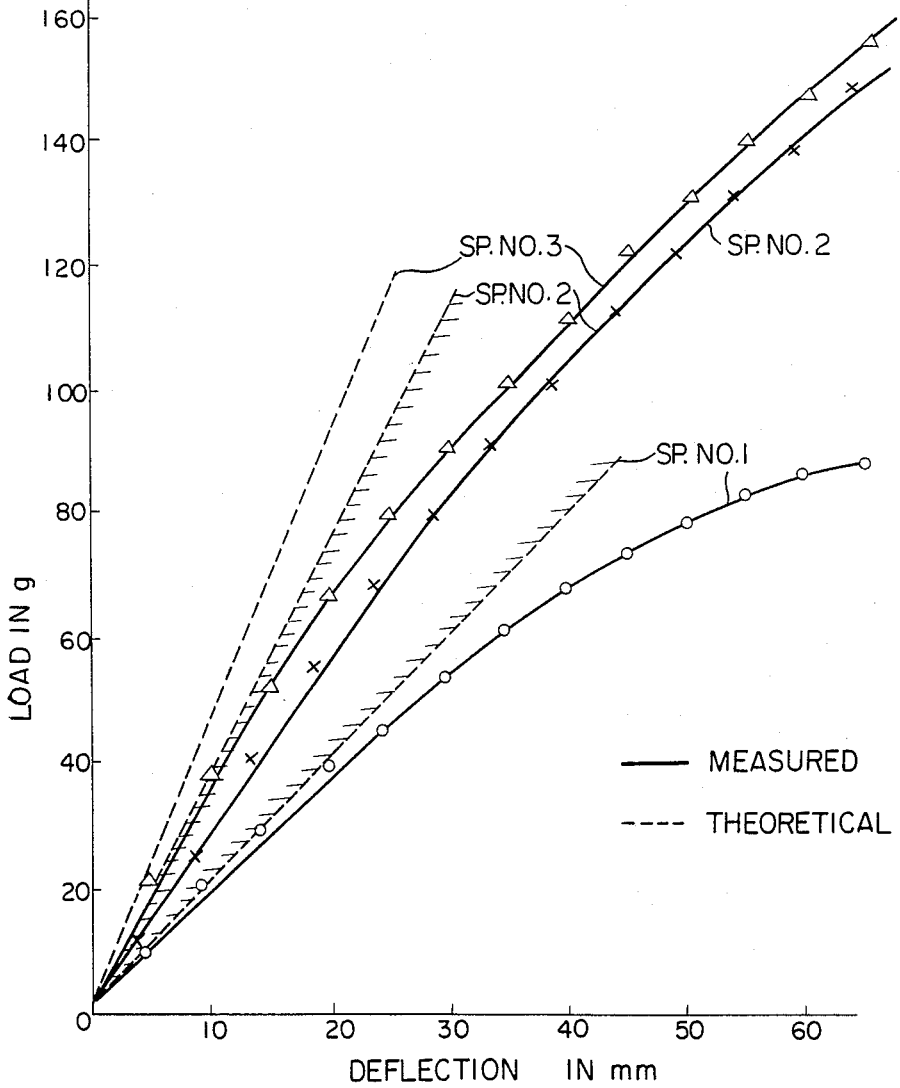

FIG. 18 wherein the axis of ordinates represents a load P in grams and the axis of abscissas represents a deflection $\delta$ in millimeters shows the load-to-deflection characteristic of Specimens No. 1, No. 2 and No. 3 resulting from the measurements as shown in FIG. 16. In the deformation obtained with such measurements the problem of large deflections occurs. However, in order to obtain a provisional measure of the deflection, it has been tried to depict a load-to-deflection curve for a circularly segmental beam within a range of relatively small deflections.

Referring back to FIG. 16, any point C on the segmental beam has a bending moment M expressed by $$M = Py = Pa\cos(\alpha - \phi) - (a = H)$$

where

P = bending force or load applied to point A y = distance between C and chord interconnecting both ends A and B a = radius of curvature of beam $\alpha$ = one half angle subtended by beam at center $\phi$ = angle subtended by beam portion AC at center H = crown of segmental beam Therefore a strain energy U stored in the segmental beam is expressed by $$U = \frac{1}{2EI} \int_{o}^{2\alpha} M^2 a d\phi$$

$$= \frac{1}{2EI} \int_{o}^{2} [Pa\cos(\alpha - \phi) - (a - H)]^2 a d\phi$$

To partially differentiate both sides of the above equation with respect to P results in a displacement $\delta$ due to the force or load P expressed by $$\int = \frac{\partial U}{\partial P} = \frac{Pa}{EI} \int_{o}^{2\alpha} \{a\cos(\alpha - \phi) - (a - H)\}^2 d\phi \quad (35)$$

$$= \frac{Pa}{EI}\left(\frac{a^2}{2}(2\alpha + \sin 2\alpha) - 4a(a - H\sin\alpha) + 2\alpha(a - H)^2\right)$$

By substituting a = 219.4 mm, H = 103 mm and $\alpha = 57.9°$ into the equation (35) and also substituting $EI = 0.496 \times 10^4$ Kg mm$^2$ for Specimen No. 1, $EI = 0.922 \times 10^4$ kg mm for Specimen No. 2 and $EI = 1.13 \times 10^4$ Kg mm$^2$ for Specimen No. 3 into the same equation, dotted curves labelled No. 1, No. 2 and No. 3 respectively have been plotted in FIG. 18. The curves No. 1, No. 2 and No. 3 describe the theoretical relationship between the load and deflection for Specimens No. 1, No. 2 and No. 3 respectively.

Then the total force exerting on a framework of a kite will be estimated.

Figure 19:
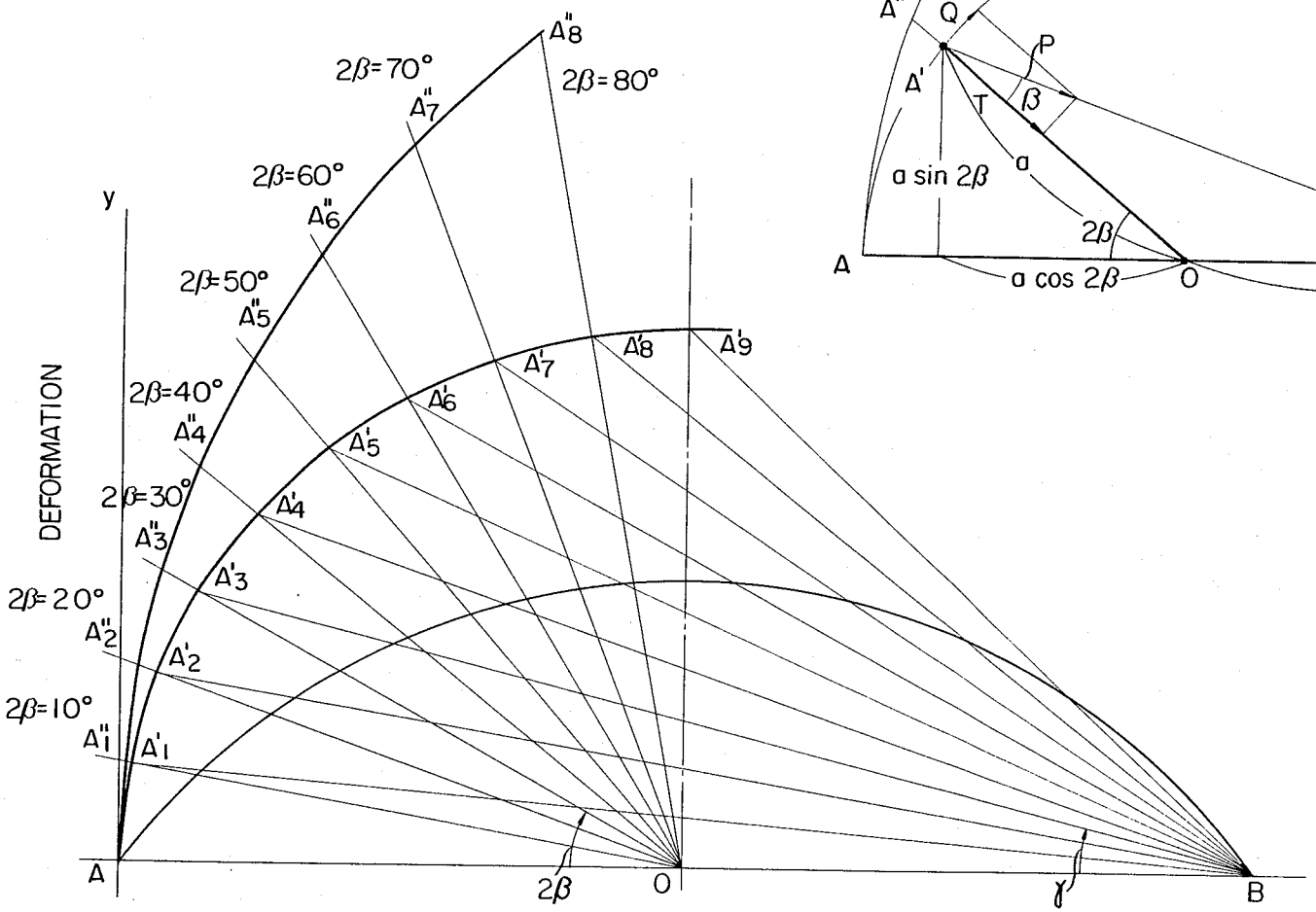
FIG. 19 is a diagram of the deformation of the circularly segmental beam shown in FIG. 16 due to a change in central angle subtended thereby.

FIG. 19 shows a deformation of a circularly segmental beam caused from a variation in central angle subtended thereby. It is assumed that the circularly segmental beam has had initially both ends A and B lying in a straight line passing through a point O equidistant therefrom and subtends a central angle such as the angle $2\alpha$ shown in FIG. 16. When the kite has flied in the air, the straight line AOB is folded into a broken line A'OB and the end or point A is rotated through an angle $\angle AOA' = 2\beta$ about the point O.

With the segmental beam not fixed at the point A, the rotation of AO to A'O causes the end A of the beam to be rotated through an angle about the point B to be displaced to a point A"the angle being equal to one half the angle $\angle AOA'$: As a result, the segmental beam is deformed by an amount A'A", in response to the rotation of the point A through the angle $2\beta$ about the point O.

FIG. 19 shows the amounts of deformation of the beam $A'_1A''_1$, $A'_2A''_2$ and $A'_3A''_3$ in response to the rotation of the beam portion OA through different angles $2\beta$ with increments of 10°.

Figure 20:
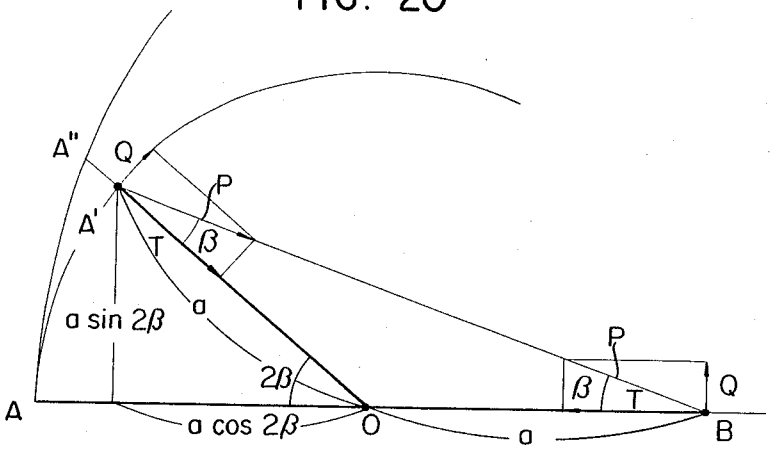
FIG. 20 is a diagram illustrating forces exerting on a beam having one end rotated through an angle about the center.

In order to calculate forces exerting on the segmental beam, it is assumed that a pair of forces T and Q are applied respectively to the point B in a direction OB and a direction perpendicular to the direction OB as shown in FIG. 20 wherein like reference characters designate the components identical to those shown in FIG. 16. Under the assumed condition moments of force about the point A' is in equilibrium state so that, as apparent from the illustration of FIG. 20, the following relationship is held:

$$(a\cos 2\beta + a)Qa\sin 2\beta T$$

where a designates a length of the beam portion OA or OB. Therefore $$Q = \frac{\sin 2\beta}{1 + \cos 2\beta}$$

$$= \tan\beta T$$

is obtained. When the above relationship is satisfied, the resultant of the forces Q and T acts on the beam in a direction A'O resulting in $$Q = P\sin\beta$$

As an example, the force P acting on the segmental beam in the direction A'B and the force Q acting on each of the beam portions OB and OA' perpendicularly thereto were measured with rods belonging to Specimen No. 3 as above described and having the end or point A rotated through angle $2\beta$ about the point or center O.

Figure 21:
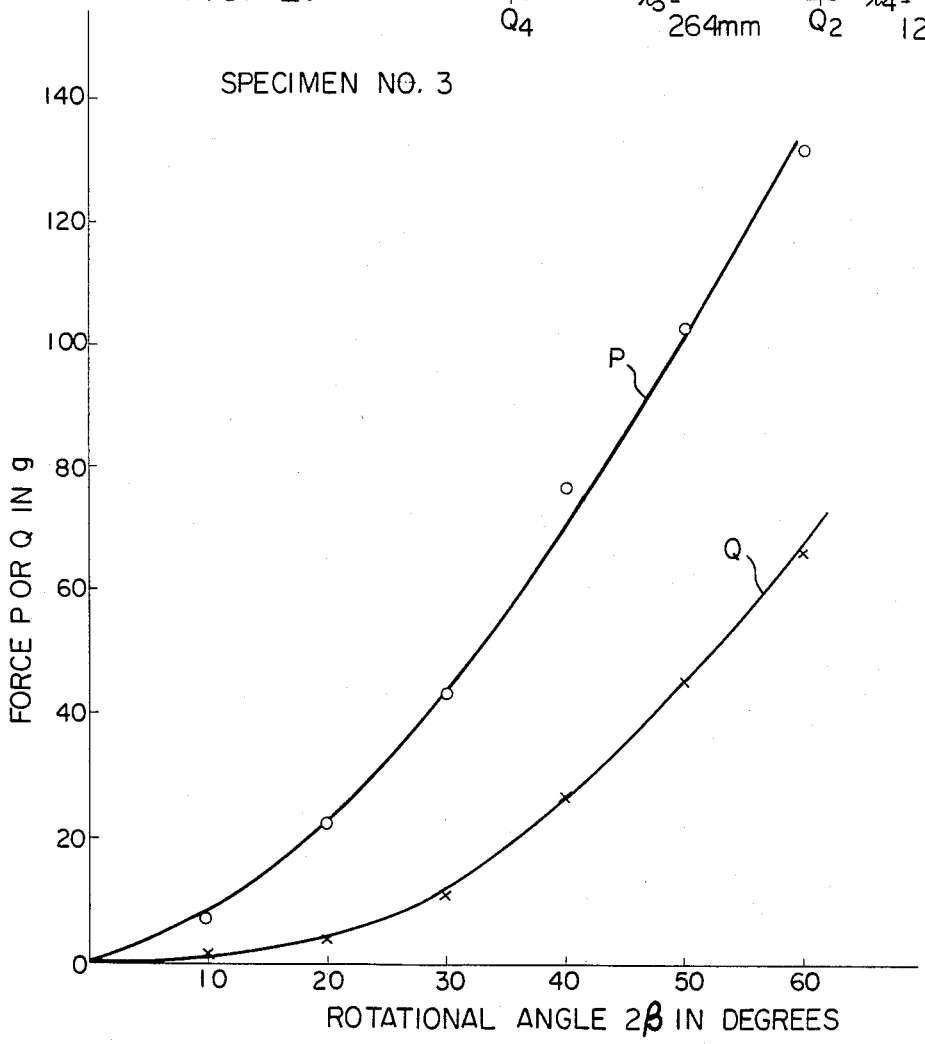
FIG. 21 is a graph plotting the forces shown in FIG. 20 as a function of the angle of rotation shown in FIG. 20.

The results of the measurements are indicated in FIG. 21 wherein the forces P and Q in grams are plotted in ordinate against the rotational angle 2 in degrees in abscissa. From FIG. 21 it is seen that the force Q on the order of 65 grams is required to cause an angle change of $2\beta = 60°$.

Figure 22:
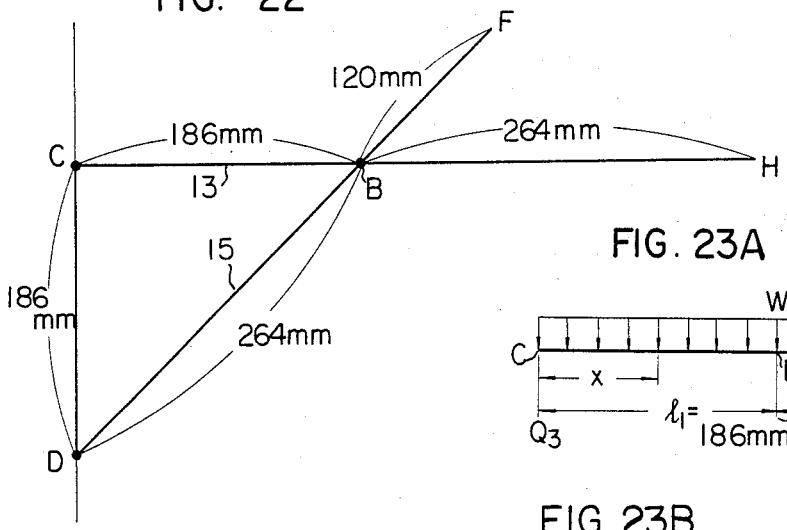
FIG. 22 is a skeleton diagram of one portion of the framework shown in FIG. 4A.

In order to estimate forces acting on the various members forming the framework of the kite as shown in FIG. 4A or 4B, the righthand portion of the framework as shown in that Figure is abstracted as shown in FIG. 22 for the purpose of facilitating the theoretical discussion of the fundamental structure of the kite illustrated in FIG. 4A or 4B. In FIG. 22 like reference numerals designate the components identical to those shown in FIGS. 4A and 4B, excepting that in FIG. 22 the reference characters C and D designating the verticles of the triangle in FIG. 4A or 4B are interchanged. FIG. 22 also shows the dimensions of the frame members called here "triangulated members".

In FIG. 22, the rib member 13 or CB has an extension BH and the stay member 15 or DB has an extension BF.

Figure 23A:
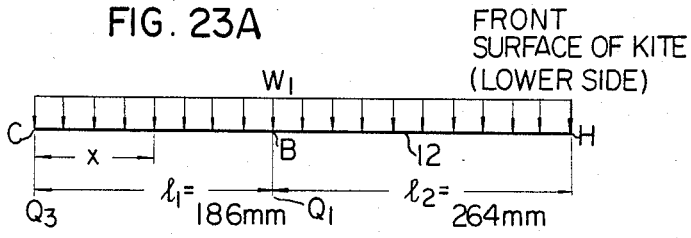
FIG. 23A is a schematic diagram illustrating forces acting on one frame member shown in FIG. 22.
Figure 23B:
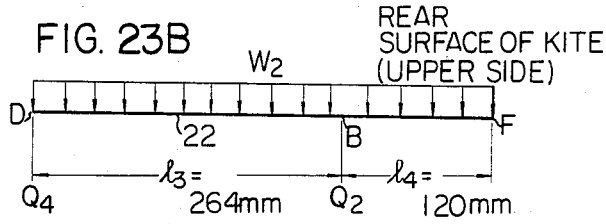
FIG. 23B is a view similar to FIG. 23A but illustrating the other frame member shown in FIG. 22.

FIGS. 23A and 23B show forces acting on the members CBH and DBF respectively. A distributed load $W_1$ or $W_2$ designates a load per unit length of the kite on the front surface and equals a difference between a load due to a wind pressure and the weight of the kite. When the kite is flying in the air, the front surface thereof faces the ground to provide the lower side and therefore the rear surface thereof provides the upper side of the kite.

A force Q acting at the vertex or point B consists of a force $Q_1$ acting on the member CBH and a force $Q_2$ acting on the member DBF. Since a pressure distribution on the surface of the kite is unknown, a proportion of the force $Q_1$ to the force $Q_2$ cannot be exactly determined. However for the sake of simplification, the force Q is divided into the forces $Q_1$ and $Q_2$ in accordance with a proportion of length between the member CBH and the member DBF. This results in $$Q_1 = \frac{l_1 + l_2}{l_1 + l_2 + l_3 + l_4} Q = \frac{450}{450 + 384} Q$$

$$\approx 0.54Q$$

and $$Q_2 = 0.46Q$$

In FIG. 23A, the $Q_1$ at the point D and a force $Q_3$ at the vertex or point C will be calculated. First the equilibrium of vertical forces gives $$Q_1+Q_3=W_1(l_1+l_2) \quad (36)$$

Also from the equilibrium of moments of force about the point C there is obtained $$Q_1 \cdot l = \frac{W_1}{2}(l_1 + l_2)^2$$

Therefore $$Q_1 = \frac{W_1}{2}\left(\frac{l_1 + l_2}{l_1}\right)^2$$

Substituting this equation into the equation (36) obtains $$Q_3 = \frac{W_1}{2} \frac{l_1^2 - l_2^2}{l_1} \quad (38)$$

Therefore to eliminate $W_1$ from the equations (37) and (38) and utilize $Q_1=0.54Q$ gives $$Q_3 = \frac{l_1 - l_2}{l_1 + l_2} Q_1 = 0.54 \frac{l_1 - l_2}{l_1 + l_2} Q$$

This equation is calculated at $$Q_3 = 0.54 \times \frac{186 - 264}{186 + 264} Q = -0.087Q$$

by using the figures shown in FIGS. 22 and 23A.

Also the distributed load $W_2$ is obtained from the equation (37) and calculated by utilizing the figures shown in FIGS. 22 and 23A. That is $$W_1 = \frac{2l_1}{(l_1 + l_2)} Q_1 = \frac{1.08l_1}{(l_1 + l_2)^2} Q$$

$$= \frac{1.08 \times 186}{(184 + 264)^2} Q = 0.992 \times 10^{-3}Q$$

The forces $Q_2$ and $Q_4$ at the points B and D on the member DBF as shown in FIG. 23A are similarly calculated. That is, one obtains $$Q_2 = \frac{W_2}{2} \frac{(l_3^2 - l_4^2)}{l_3}$$

-continued and $$Q_4 = \frac{W_2}{2} \frac{(l_3^2 - l_4^2)}{l_3}$$

Therefore from those two equations and $Q_2=0.46Q$ there is given $$Q_4 = \frac{l_3 - l_4}{l_3 + l_4} Q_2 = 0.46 \frac{l_3 - l_4}{l_3 + l_4} Q$$

By using the figures shown in FIGS. 22 and 23B the above equation is calculated at $$Q_4 = 0.46 \times \frac{264 - 120}{264 + 120} Q$$

$$= 0.173Q$$

Starting with the equation (27), a distributed load $W_2$ is calculated at $$W_2 = \frac{2l_3}{(l_3 + l_4)^2} Q_2 = \frac{0.92l_3}{(l_3 + l_4)^2} Q$$

$$= \frac{0.92 \times 264}{(264 + 120)^2} Q = 1.65 \times 10^{-3}Q$$

In order to calculate the deformation of the members CBH and DBF in response to distributed loads applied thereto as shown in FIGS. 23A and 23B, a bending moment M at any point on the member CBH is first calculated which point is spaced apart a distance x from the point C as the origin. That is, the bending moment M is expressed by $$M_1 = \frac{1}{2} W_1x^2 - \frac{W_1}{2} \frac{l_1^2 - l_2^2}{l} \times (0 \leqq x \leqq l_1)$$

or $$M_2 = \frac{1}{2} W_1 (x - l_1 - l_2)^2 (l_1 = x = l_1 + l_2)$$

On the other hand, the relationship $$\frac{d^2y_1}{dx^2} = \frac{M_1}{EI} \text{ or } \frac{d^2y_2}{dx^2} = \frac{M_2}{EI}$$

is held between the bending moment M and a deflection y perpendicular to the axis of the member CBH as the case may be. By considering the boundary conditions $$y_1|_{x=0} = 0, y_1|_{x=1} = y_2|_{x=l}$$

and $$\left.\frac{dy_1}{dx}\right|_{x=l_1} = \frac{dy_2}{dx}_{x=l_1}$$

the above differential equation can be solved. That is, $$y_1 = \frac{W_1l_1^4}{24EI} \cdot \left(\frac{x}{l_1}\right) [1 - 2(x/l_1)^2 + (x/l_1)^3] \quad (39)$$

-continued $$= 2(l_2/l_1)^2 - \{1 - (x/l_1)^2\}](0 \leqq x \leqq 1)$$

$$Y_2 = \frac{W_1 l_2^4}{24EI}\left(\frac{x - l_1}{l_1}\right)[\{(x - l_1)|l_1\}^3 - \{4(x - l_1)|l_1\}^2 - 6(x - l_1)|l_2 - (l_1|l_2)[(l_1|l_2)^2 - 4\}](l_1 \leqq x \leqq l_1 + l_2) \quad (40)$$

In the above equations $M_1$ and $y_1$ relate to the member portion CB while $M_2$ and $y_2$ relate to the member portion BH.

Figure 24:
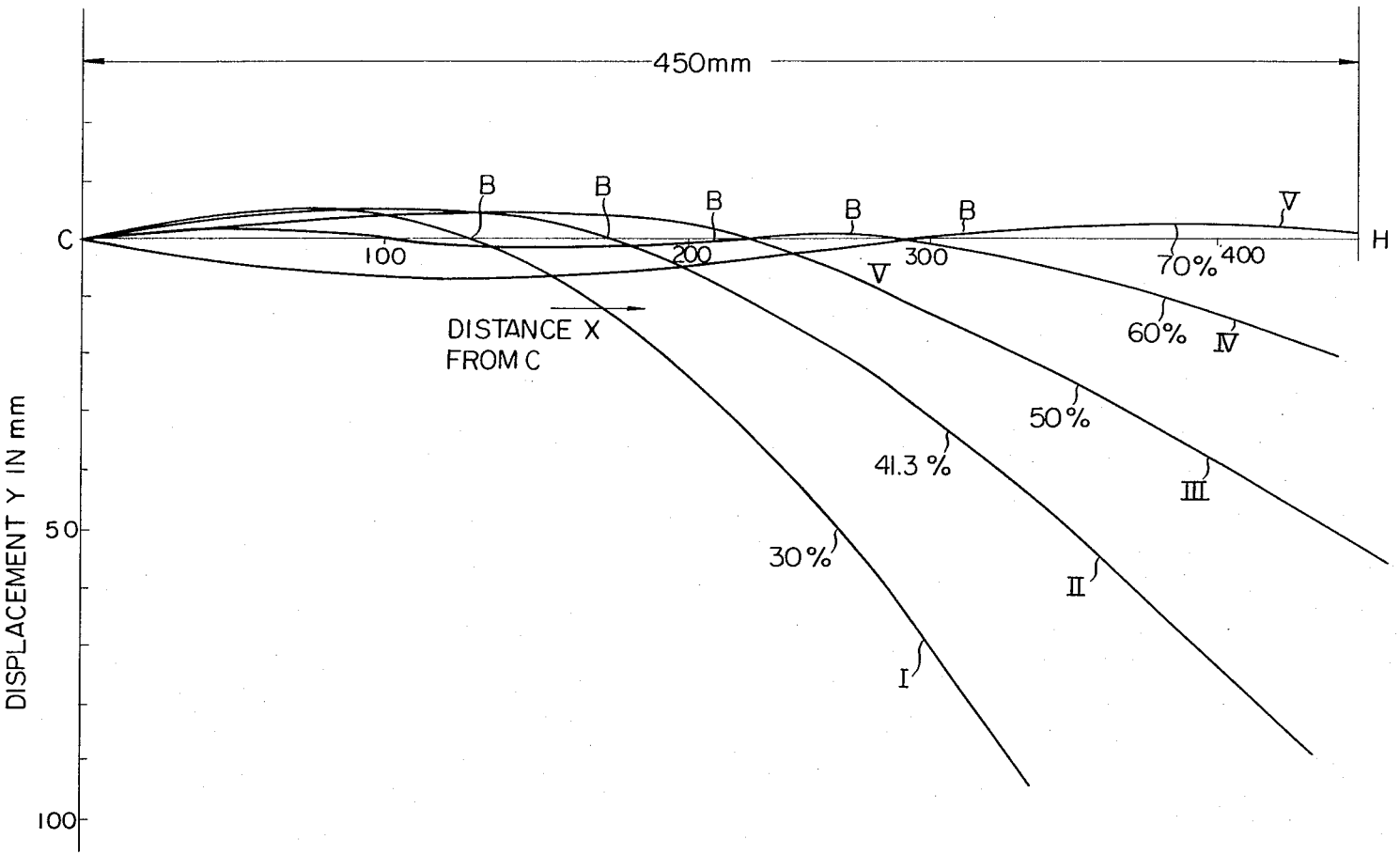
FIG. 24 is a graph plotting the displacement of the one frame member shown in FIG. 22 against a length thereof.

A graph shown in FIG. 24 describes the deformation of the member CBH as a function of the distance x from the point C and as determined by substituting $EI = 1.13 \times 10^4$ kg mm$^2$, $W_1 = 10^{-3}$ kg/mm into the equations (39) and (40) and changing the $l_1$-value to 30, 41.3, 50, 60 and 70% of the total length $l_1 + l_2 = 450$ mm in both equations respectively. Curves labelled I, II, III, IV and V correspond to 30, 41.3, 50, 60 and 70% of the length of the member CBH.

According to FIG. 24, the deformation of the member CBH can be determined for any value of the angle $\beta$. For example, for a given value of $2\beta = 60°$, Q=65 grams is obtained from FIG. 24. By substituting this value of the Q into the equation for $W_1$, the distributed load $W_1$ has value of $$64.5 \times 10^{-3} \text{ g/mm} = 0.0645 \times 10^{-3} \text{ kg/mm.}$$

This figure corresponds to 64.5% of $W_1$ shown in FIG. 24, so that a deflection y at a point H is of 6.3 mm.

FIG. 24 also illustrates that the member CBH may be greatly deformed according to the position of the fulcrum B.

Therefore, if it is desired to render the deformation of the member small then the length $l_1$ of the member portion CB is preferably on the order of 65% of the total length of the member CBH.

The deformation of the stay member DFB can be similarly determined by the equations (39) and (40). In this case $l_3$, $l_4$ and $W_2$ are substituted for $l_1$, $l_2$ and $W_1$ respectively. The member DBF is shown in FIGS. 22 and 23B as having a length $(l_3 + l_4)$ equal to 384 mm and the member portion DB has a length $l_3$ equal to 264 mm. Thus $l_3/(l_3 + l_4)$ is of 0.688. This figure indicates the position of the fulcrum is substantially proper.

Upon a bending moment M acting on the member, a corresponding bending stress $\alpha$ is expressed by $$\alpha = M/Z \quad (41)$$

where Z designates a section modulus expressed by $$Z = \frac{1}{6} bh^2 \text{ for a rectangular cross section}$$

$$= \frac{1}{32} \pi d^2 \text{ for a circular cross section}$$

where b, h and d have been previously defined.

As the determination of a stress developed in a circularly segmental beam encounters the problem of large deflection, it is difficult to make an exact solution therefor. Thus the bending stress will now be very roughly discussed. Within such a range that in FIG. 16, the displacement $\delta$ is relatively small enough not to cause the crown H so much, a bending moment M acting on a circularly segmental beam is the greatest at the center and expressed by $$M = PH \quad (42)$$

To substitute this equation into the equation (41) gives $\alpha = 32\ PH/\pi d^3$ for rods of circular cross section such as Specimen No. 3. Assuming that for d=3 mm and H=103 mm, P has a value of 134 g or 0.134 kg read in FIG. 17 with $2\beta = \lambda 60°$, the bending stress $\alpha$ is calculated at $$d = \frac{32}{3.14 \times 3^3} \times 0.134 \times 10^3 = 5.21 \text{ in kg/mm}^2$$

Although a value of the crown $H2\beta = 60°$ becomes actually larger than 103 for by tenths thereof, segmental beams belonging to Specimen No. 3 as above described have a fairly great reserve of the bending stress even by taking account of this increase in crown as will readily be understood from the comparison of the figure just calculated with the figures listed in Table I as previously described. However if the particular wind becomes stronger then the beam may come into question. This results in the necessity of paying attention to the design thereof.

Regarding the rib member CBH, a bending moment M is also expressed as above described in conjunction with FIG. 23A. By substituting that bending moment $M_1$ or $M_2$ into the equation (41), a bending stress $\lambda$ occurring in the member CBH can be expressed by $$= \frac{16 W_1 l_1^2}{\pi d^3}[(x/l_1)^2 - \{1 - (l_2/l_1)^2\}(x/l_1)](0 \leqq x \leqq l_1)$$

and $$\lambda = \frac{16 W_1 l_2^2}{\quad}[(x - l_1 - l_2)/l_2]^2 (1 \leqq x \leqq 1 + l_2)$$

Figure 25:
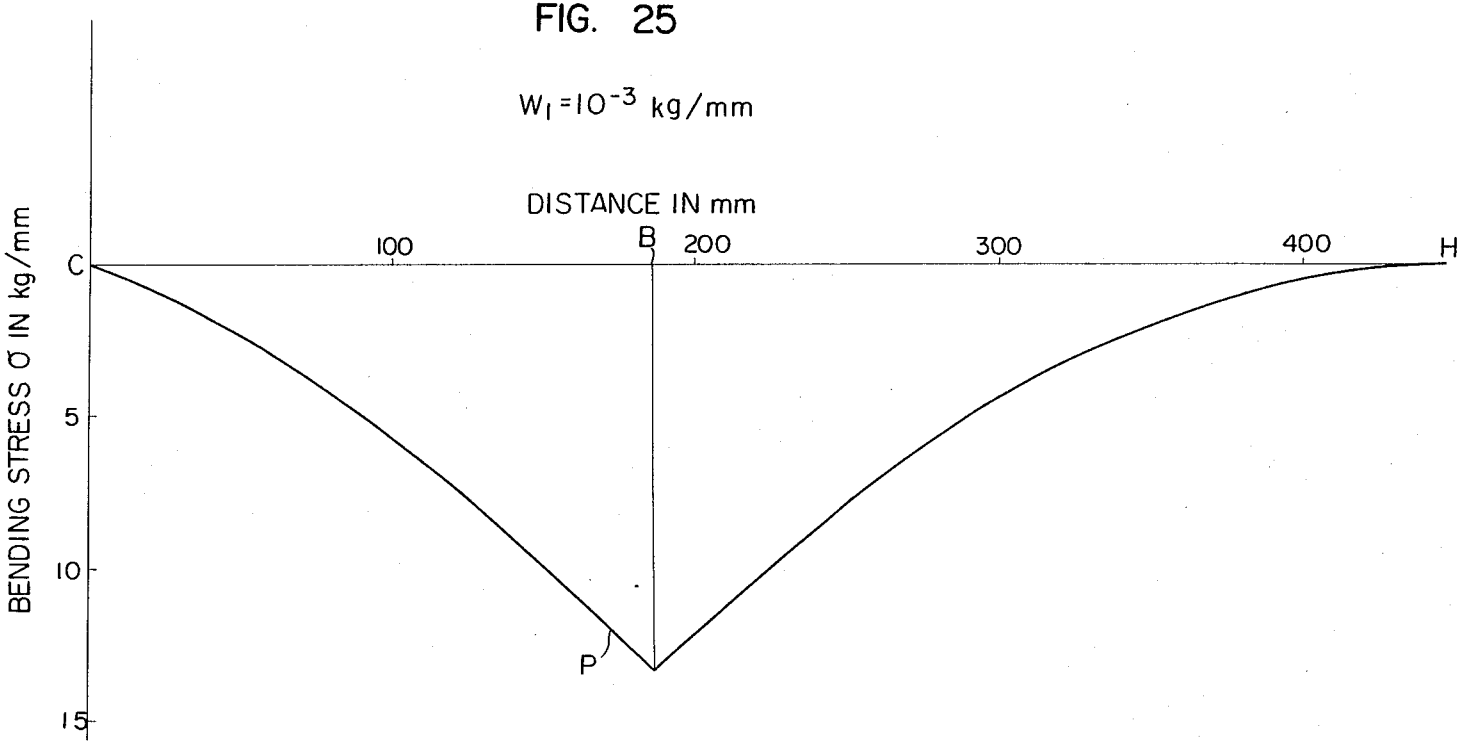
FIG. 25 is a graph plotting a bending stress of the one frame members shown in FIG. 22 against a length thereof.

By putting $W_1 = 10^{-3}$ kg/mm, d=3 mm, $l_1 = 186$ mm and $l_2 = 264$ mm. in each of the above equations, a profile of bending stress is given as shown in FIG. 25 wherein a bending stress in kg/mm$^2$ is plotted in ordinate against a distance from the point C extending along the member CBH. From FIG. 25 it can be seen that for $2\beta = 60°$ a bending stress $\alpha$ at the point B has a maximum value of 0.85 kg/mm$^2$ because a distributed load $W_1$ is of $0.0645 \times 10^{-3}$ kg/mm as above described. By comparing the figure of the bending stress just specified with the figures listed in Table I, it is seen that the member CBH also has a sufficiently great reserve of the bending stress.

From the foregoing it can be concluded that (1) as the bending stress is maximum at the point B, care is required to be taken to prevent an extreme decrease in cross sectional profile and particularly thickness at the point B at which a pair of members are to be interconnected;

(2) in such a structure that a pair of members abruptly decreased in cross section in order to interconnect them at the point B those portions of the members at and adjacent to that point are preferably reinforced;

(3) the $l_2$ is preferably short because the maximum value of the bending stress at the point B is proportional to $l_2^2$;

(4) when the members of rectangular cross section are used, they are disposed on the surface of a kite so as to increase in height, in the direction of that surface; and (5) since the members used have still a reserve of the bending stress, the design is presently made by taking account of the deflection.

In order to make it difficult to deform the frame members, though they would be of either circular or rectangular cross section, the product of the modulus of longitudinal elasticity and geometrical moment of inertia or EI can be advantageously increased as will be apparent from the equations (39) and (40). For example, the geometrical moment of inertia I may be increased with the material of frame members remaining unchanged.

Since the circular and rectangular cross sections have geometrical moments of inertias I expressed by $\pi d^4/64$ and $bh^3/12$ respectively where d, b and h have been previously defined, their geometrical moments of inertia I are equal to each other when $\pi d^4/64 = bh^3/12$. Therefore the cross section equal in I to the rectangular cross section has its diameter d expressed by $$d = \sqrt[4]{\frac{64}{12\pi} bh^3}$$

Figure 26:
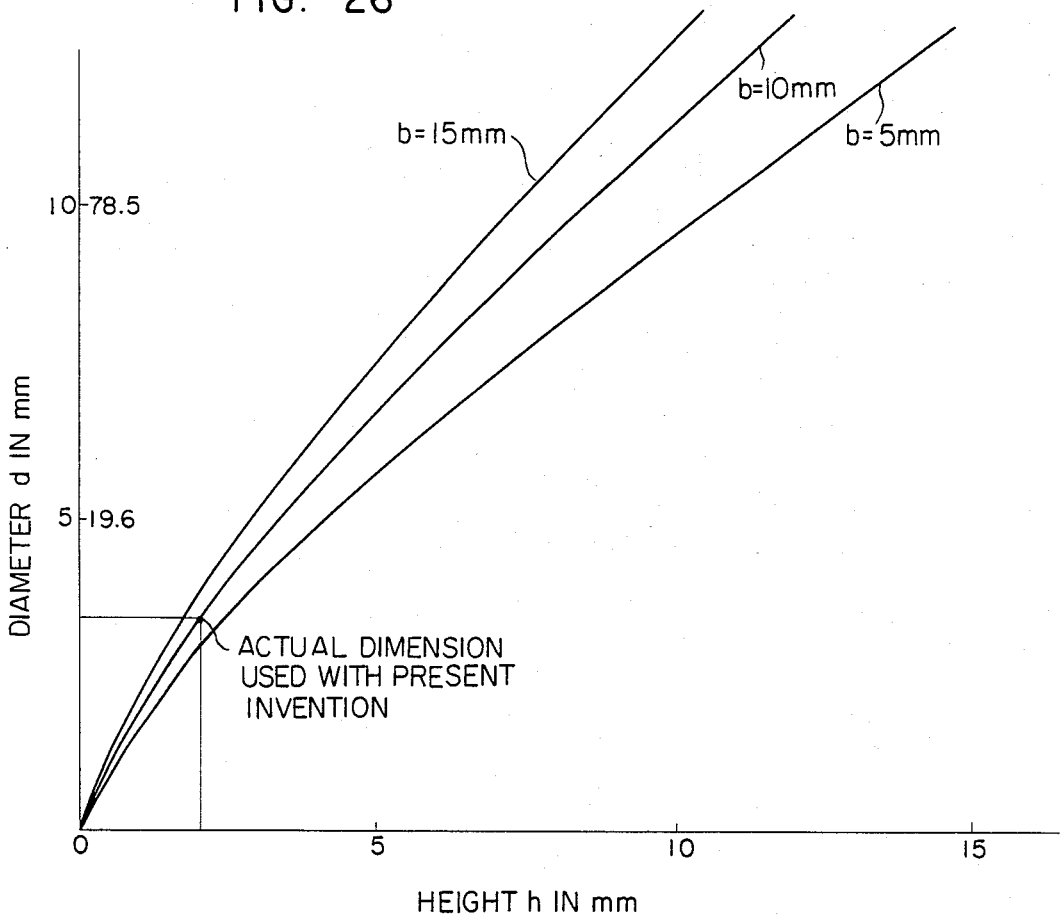
FIG. 26 is a graph plotting a diameter of a circular frame member against a height of a rectangular frame member equal in geometrical moment of inertia to the circular frame member with the parameter being a width of the rectangular member.

FIG. 26 shows three curves satisfying the above equation for h ranging from 1 to 15 mm and the respective b's having values of 5, 10 and 15 mm.

For example, a rectangular member called Specimen No. 1 or No. 2 may have a width b of 10 mm and a height h of 2 mm as shown in FIG. 14. A circular member equal in geometrical moment of inertia to such a rectangular member has necessarily a diameter d of 3.4 mm as read in FIG. 26. In that case the rectangular member has a cross sectional area bh calculated at $bh = 10 \times 2 = 20$ mm$^2$ while the circular member has a cross sectional area $\pi d^2/4$ calculated at $\pi d^2/4 = 3.14 \times 3.4^2 = 8.67$ mm$^2$. From this the circular member may be advantageously used for the purpose of decreasing a weight.

Further the use of hollow members provides the cross sectional profile increasing the rigidity and decreasing the weight although such members are not discussed herein.

From the results of the discussions as above set forth it is recommended to use materials high in both specific strength and specific rigidity. Typical Examples of such materials are listed in the following Tables II and III with some of their mechanical properties.

TABLE II

| Natural Materials & Mechanical Properties | | | | | |
|---|---|---|---|---|---|
| | | Bend. Stress | | Mod. of Long Elas. | |
| Type of Material | Spec. Gr. in g/cm$^3$ | b in Kg/mm$^2$ | λb/γ | E in $10^3$ Kg/mm$^2$ | E/γ × $10^2$ |
| Bamboo (*Phyllostachys mitis*) | 0.4 | *27.9<br>33.0<br>14.6 | *67.8<br>82.5<br>36.4 | *2.8<br>1.0 | *7.0<br>2.5 |
| White Oak (*Quercus mysinaefolia*) | 0.9 | 11.8 | 13.1 | 0.76<br>0.86 | 0.84<br>0.95 |
| Red Oak (*Quercus octa*) | 0.9 | 11.1 | 12.3 | 1.1 | 1.22 |
| Beech-Tree (*Fagus crenata*) | 0.75 | 9.5 | 12.7 | 0.57<br>0.89 | 0.76<br>1.19 |
| Maple Tree (*Acer palmatum*) | 0.72 | 9.1 | 12.6 | 0.57<br>1.26 | 0.79<br>1.75 |

TABLE II-continued

| Natural Materials & Mechanical Properties | | | | | |
|---|---|---|---|---|---|
| | | Bend. Stress | | Mod. of Long Elas. | |
| Type of Material | Spec. Gr. in g/cm$^3$ | b in Kg/mm$^2$ | λb/γ | E in $10^3$ Kg/mm$^2$ | E/γ × $10^2$ |
| Wild Cherry Tree (*Prunus Yamazakura*) | 0.65 | 8.8 | 13.5 | 0.57<br>1.10 | 0.87<br>1.69 |
| Zelkova-Tree (*Zelkova serrata*) | 0.75 | 8.7 | 11.6 | 0.84<br>1.10 | 11.2<br>1.46 |
| Larch-Tree (*Larix kaempferi*) | 0.65 | 8.3 | 12.7 | 0.98<br>1.10 | 1.50<br>1.69 |
| *Pinus thumbergii* | 0.60 | 7.0 | 11.7 | — | — |
| *Magnolia obvata* | 0.45 | 7.3 | 16.2 | 0.57<br>0.86 | 1.27<br>1.91 |
| Japanese Cypress (*Chamaecyparis obtusa*) | 0.50 | 8.0 | 16.0 | 0.77<br>1.30 | 1.54<br>2.60 |
| Red Lauan (Shorea or Hopea) | 0.60 | 8.7 | 14.5 | 1.0 | 1.67 |
| Hemlock-Spruce (*Tsura heterophylla*) | 0.40 | 6.15 | 15.3 | 0.99 | 2.48 |

Remark:
Figures with the asterisk (*) were measured upon forming by way of trial kites according to the present invention.

TABLE III

| Synthetic Materials & Mechanical Properties | | | | | |
|---|---|---|---|---|---|
| | | Bend Stress | | Mod. of Long Elas. | |
| Type of Material | Spec. Gr. in Kg/mm$^2$ | λ in Kg/mm$^2$ | λb/γ | E in $10^3$ Kg/mm$^2$ | E/ $10^3$ |
| Acrylic Ester Resin | 1.4 | 0.8~<br>1.4 | 0.57~<br>1 | 0.14~<br>0.28 | 0.1<br>0.2 |
| Polyvinyl Chloride(Hard) | 1.4 | 3.5<br>6.3 | 2.5 ~<br>4.5 | 0.25<br>0.42 | 0.17<br>0.3 |
| Urea Resin | 1.5 | 4.2<br>9.1 | 2.8<br>6.1 | 1.05 | 0.7 |
| FluorineContained Polymer | 2.1 | 4.0 | 1.9 | 0.14~<br>0.21 | 0.07~<br>0.1 |
| 66-Nylon | 1.14 | 7.6 | 6.7 | 0.28 | 0.25 |
| Polyester | 1.8 | 2.1<br>2.8 | 1.17<br>1.6 | 1.06 | 0.59 |
| Polyethylene | 0.94 | 2.0<br>3.9 | 2.1<br>4.1 | 0.017<br>0.039 | 0.02<br>0.04 |
| Polystyrene | 1.05 | 3.5<br>6.3 | 3.3<br>6.0 | 0.28<br>0.42 | 0.27<br>0.4 |
| Methy Methacrylate Resin | 1.18 | 4.9<br>6.3 | 4.1<br>5.3 | 0.32 | 0.27 |

From Tables II and III it can be seen that bamboo is most preferable in that it is light in weight and high in both rigidity and strength and that other materials are good in the order of wooden materials and plastics. The plastics are better to be unused. Among the wooden materials, what approximates in properties. Japanese cypress and *Magnolia obovata* low in specific gravity is better but hard materials such as Japanese oak, Japanese beech tree etc. are not suitable. It is said by way of suggestion that aluminum has $\alpha b/\alpha$ ranging from 3.7 to 14.8 and E/γ ranging from $2.3 \times 10^3$ to $2.8 \times 10^3$.

From the foregoing, it has been concluded that (1) the framework preferably comprises a combination of existing triangular elements;

(2) care is taken to dispose the center of wind for each plain surface of a kite within an associated triangulated element;

(3) the cross sectional profile of frame members is most desirably of the hollow type and desirable in the order of a circle and a rectangle;

(4) where a frame member of rectangular cross section is used, it is preferable to increase its height in a direction normal to the surface of the kite as large as possible;

(5) the above paragraph (4) is applied to a circularly segmental member having a rectangular cross section:

(6) the triangulated element is formed by first attaching a rib member CBH (see FIG. 22) to a circularly segmental member and then a stay member DBF (see FIG. 22) to the assembly thus prepared;

(7) the junction B (see FIG. 22) is preferably positioned on the rib member CBH so that the rib portion CB has a length $l_1$ approximating about 65% of the length of rib member CBH;

(8) it is desirable initially to place one half of the kites' surface at a certain angle to the other half thereof without the surface formed to be of a perfect plane;

(9) the adjacent frame members are interconnected to be rotatable as much as practicable;

(10) those portions of the frame members adjacent to the junction B may be preferably reinforced according to the particular joint structure because stress developed at and near the junction B becomes maximum;

(11) Since the circularly segmental member has a very high bending stress occurring therein and a large deformation, the same is required to be formed of a material sufficiently accommodating any deformation of the kite and exhibiting a resilience to a large deformation of the kite; and

(12) The material of the frame members is most preferably of bamboo and a wooden material desirably comprises one selected from the group consisting of Japanese cypress, *Magnolia obovata, Cryotomeria japonica* and *Abies firma* which are light.

The present invention will now be in detail described in conjunction with various embodiments thereof.

Figure 27:
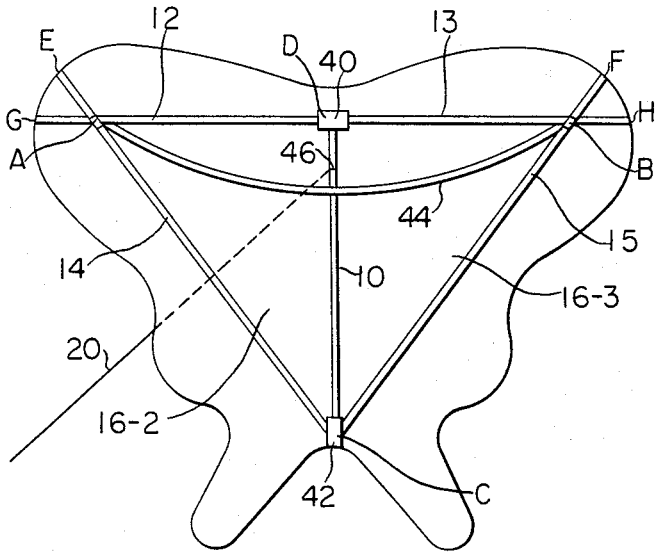
FIG. 27 is a plan view of a modification of the present invention.

The arrangement shown in FIG. 27 is different from that shown in FIG. 4A only in that each of the rib members 12 or 13 extends beyond the junction A or B until it terminates at the adjacent edge of the plain surface 16-2 or 16-3. Therefore, in FIG. 27 the free ends of both stay members 14 and 15 are designated by the reference characters E and F respectively and the free ends of the extended rib members 12 and 13 are designated by the reference characters G and H respectively.

In the arrangement of FIG. 27, the junction A of the rib and stay members 12 and 14 and the junction B of the similar members 13 and 15 are preselected to be located so as to render each of ratios of DA/DG, DB/DH, CA/CE and CB/CF equal to a value ranging from 0.5 to 0.8 for the reasons as will be apparent from the description for FIGS. 22, 23 and 24.

More specifically, curve I shown in FIG. 24 depicts an amount of displacement of every point on the frame member 13 or CBH having a length $(l_1+l_2)$ and including the portion BC having a length $l_1$ equal to 30% of $(l_1+l_2)$. That is, the frame member CBH includes its flucrum B whose position is selected to satisfy CB/CH=0.3. Similarly curves II, III, IV and V shown in FIG. 24 describe displacements with the position of the fulcrum B selected to satisfy CB/CH equal to 0.413, 0.5, 0.6 and 0.7 respectively.

As seen in FIG. 24, the profile of displacement or deflection developed on the frame member 13 or CBH is fairly different in accordance with the position of the fulcrum or intersection B. More specifically, for CB/CH=0.65 every point on the frame member CBH is small in deflection whereas for CB/CH not greater than 0.4 or not less than 0.8 a deflection at the free end H or an intermediate point on the frame portion CB is greatly increased with the result that the surface of the kite is greatly deformed. Thus it has been determined that, in order to maintain a relatively small deformation of the frame member 13 shown in FIG. 27, the junction B should be positioned on the frame member 13 so as to cause the ratio DB/DH to range from 0.5 to 0.8. This is true in the case of the rib member 12 or CAG.

It will be appreciated that the stay members 14 and 15 are qualitatively equal in deflection profile to the rib member 13.

Thus the junction A of the rib and stay member 12 and 14 respectively is positioned so as to cause a ratio DA/DG and/or a ratio CA/CE to range from 0.5 to 0.8 while the junction B of the rib and stay members 13 and 15 respectively is positioned so as to cause a ratio DE/DH and/or a ratio CB/CF to range from 0.5 to 0.8. This permits the deformation of the frame member to be extremely small thereby to suppress any deformation of the kite. Therefore the kite increases in both flight performance and stability while a stress occurring in the kite is relieved accompanied by an increase in reliability. Also the kite reduces in weight.

In the distance of the rib portion AG and BH as in the arrangement of FIG. 4A, points A and B are positioned on the stay members 14 and 15 so as to cause ratios CA/CE and CB/CF to range from 0.5 to 0.8. In the absence of the stay portions AE and BF the points A and B are positioned on the rib members 12 and 13 so as to cause ratios DA/DG and CB/CH to range from 0.5 to 0.8.

Figures 28, 30A, 30B, 30C, 30D, 31, 33, 35:
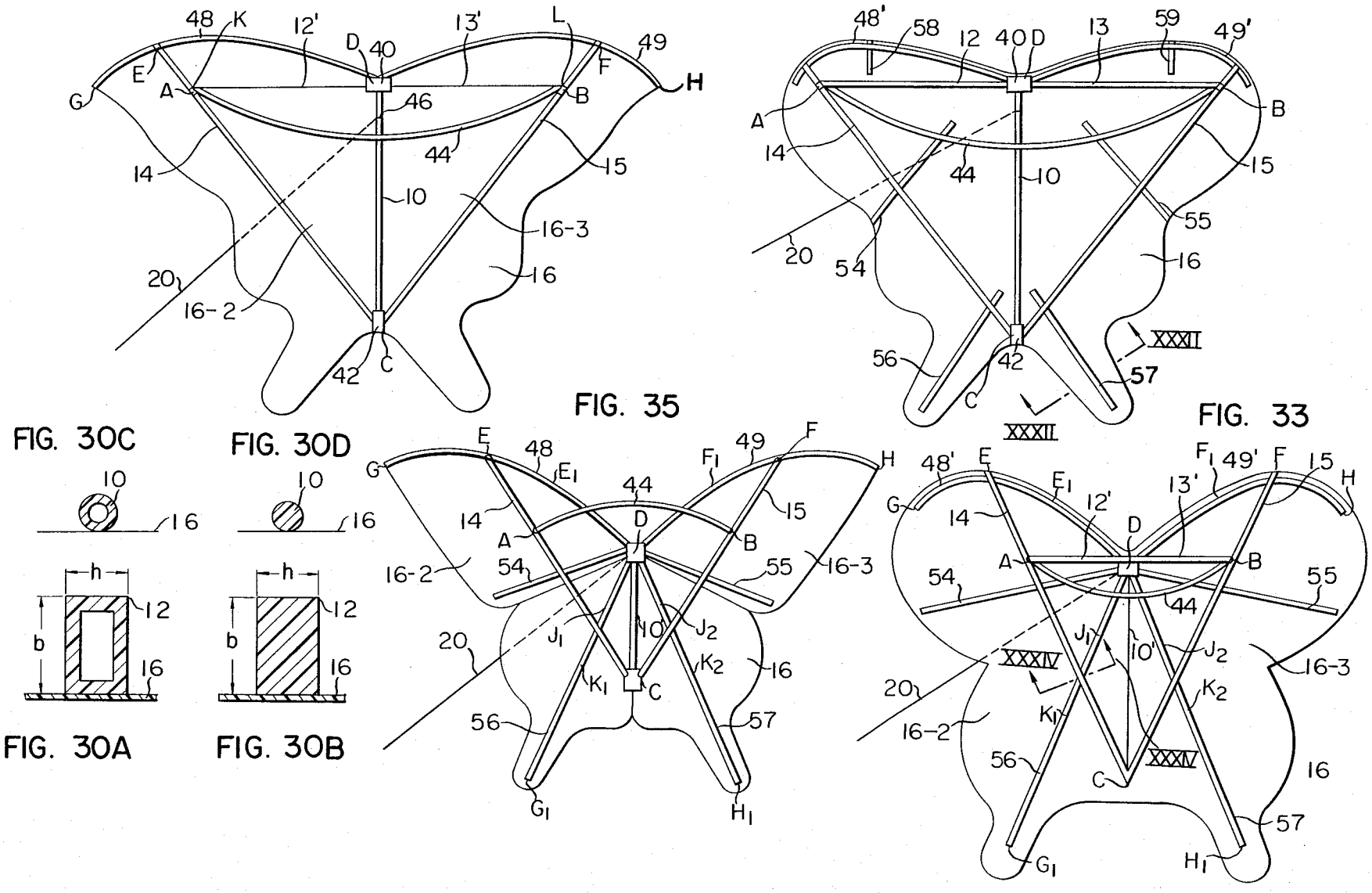
FIG. 28 is a replica of FIG. 4A useful in explaining the determination of positions where the frame members intersect one another.
FIGS. 30A, 30B, 30C and 30D are cross sectional views of various frame members used with the present invention.
FIG. 31 is a plan view of another modification of the present invention.
FIG. 33 is a plan view of a modification of the arrangement shown in FIG. 31.
FIG. 35 is a plan view of a modification of the arrangement shown in FIG. 33.

In the arrangement shown in FIG. 28 that is a replica of FIG. 4B, the arcuated rib members 48 and 49 forming the leading edge of the kite are fixedly connected at points E and F to the stay members 14 and 15 respectively. As in the arrangement shown in FIG. 27, the points E and F are positioned on the arcuated rib members 48 and 49 having free ends G and H so as to cause ratios DF/DH and DE/DG to range from 0.5 to 0.8. This is because the arcuated rib members 48 and 49 can be expected to be deflected in the similar manner as shown in FIG. 24.

The arrangement of FIG. 28 exhibits the same effects as that shown in FIG. 27.

Figure 29:
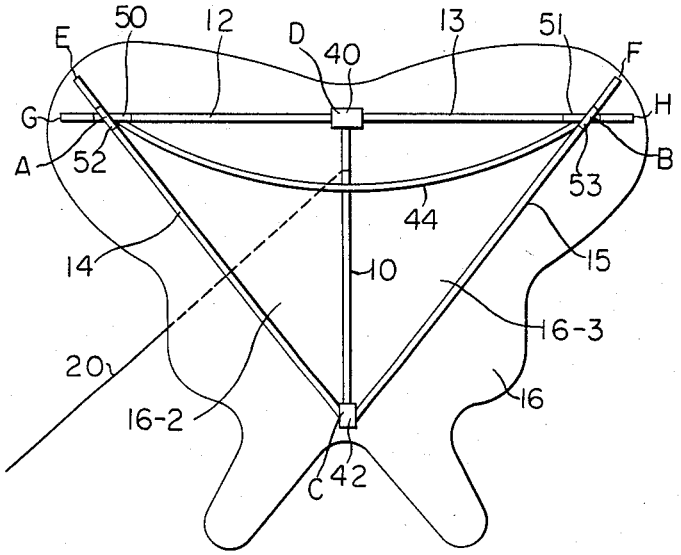
FIG. 29 is a plan view of another modification of the arrangement shown in FIG. 27.

FIG. 29 shows another modification of the arrangement of FIG. 27 wherein the rib and stay members are reinforced at their intersection. As shown, the rib member 12 has a reinforcement such as a metallic tube 50 snugly fitted onto that portion thereof located at and near the junction. A and the stay member 14 has a metallic tube 52 snugly fitted onto that portion thereof located at and near the junction A then those tubes 50 and 52 are connected to the arcuated frame member. Similar metallic tubes 51 and 53 are snugly fitted onto the rib and stay member 13 and 14 respectively in the same manner as the tubes 50 and 52.

It is to be understood that the reinforcement is not restricted to the metallic tube, and that it may comprise a splint. Alternatively, the material of that portion of each frame member located at and near the associated junction may be mechanically strengthened.

From FIG. 25 it can be seen that the intersection A or B of the rib and stay members 12 and 14 or 15 and 15 respectively is subjected to a bending maximum stress in response to a distributed load applied to the kite due to a wind pressure. As a result, if those portions of the frame members located at and near the intersection are weak this leads to a fear that they will be broken. The reinforcements 50, 51, 52 and 53 are effective for avoiding this fear.

In the arrangement of FIG. 29 it can be seen that the use of the reinforcement causes a great increase in strength of the frame member to eliminate any irregular deformation of the kite due to a wind pressure. As a result, the arrangement provides a flying object flying in the air in extremely stable manner.

Where a wind pressure applied to a surface of a kite is born on frame members attached to the surface, a distributed load is applied to the frame members caused from that wind pressure. Under these circumstances, the frame members may be reasonably formed of a material having a high bending rigidity in a direction normal to the surface of the kite. On the other hand, it is desirable to use light members in view of the flight performance of kites. Therefore the frame members can not be excessively thickened in order to increase the bending rigidity thereof.

In order to avoid this objection, the frame members can have any one of cross sectional profiles as shown in FIGS. 30A through 30D. In FIG. 30A, a frame member represented by the member 12 is shown as having a cross sectional profile in the form of a hollow rectangle. The rectangle includes longer sides b and shorter sides h with one of the shorter sides attached to surface 16 of the kite.

The frame member as shown in FIG. 30A is large in geometrical moment of inertia but very light in weight. Further as the shorter side of the rectangle is attached to the surface of the kite, the frame member has a greatly increased bending rigidity in a direction normal to the surface of the kite. As a result, the kite as a whole reduces in weight while the surface of the kite decreases in twist. This results in the advantage that the kite is flying in the air in extremely stable manner though the particular wind would be light or strong.

FIG. 30B shows a cross section in the form of a solid rectangle. A frame members having a cross section as shown in FIG. 30*b* is relatively light in weight and still high in bending rigidity.

In the rectangular cross section, though it is either hollow or solid, the frame member has its bending rigidity directly proportional to its width h and proportional to the third power of its thickness b. Therefore the frame member is preferably attached to the surface 16 of the kite so as to cause the dimension thereof in a direction normal to the kite's surface to be larger than the dimension thereof parallel to the kite's surface as shown in FIGS. 30A and 30B.

A hollow circular cross section as shown for the spinal member 10 in FIG. 30C has the same effects as the hollow rectangular cross section illustrated in FIG. 30A.

FIG. 30D shows the spinal member 10 having a solid circular cross section. This cross section gives the similar results as above described in conjunction with FIG. 30B.

Thus it will be appreciated that the cross sections as shown in FIGS. 30A through 30D provide frame members high in rigidity and light in weight with the result that kites including those frame members can fly in the air in extremely stable manner and under any wind conditions.

It is recalled that the circular cross section is advantageous over the rectangular cross section in that the former is less in weight than the latter with the geometrical moment of inertia remaining unchanged.

Conventional kites have been generally formed of the set of frame members bearing the wind pressure and also serving to hold the shape thereof. Such kites have been disadvantageous in that to lay stress on the shape thereof increases the number of the frame members leading to the necessity of sacrificing the strength of the frame members. On the contrary, laying stress on the strength of the frame members has placed the shape of kites under restriction. Thus the kites have reduced in versatility of the shape.

The present invention can eliminate these disadvantages of the prior art practice by the provision of a flying object or kite comprising a surface member such as a piece of polyvinyl chloride sheet, a plurality of primary high-strength frame members bearing a wind pressure, and a plurality of secondary frame members serving to hold a shape thereof and fixedly secured to the surface member to be integral therewith. One form of this kite is illustrated in FIG. 31. The arrangement illustrated is similar to that shown in FIG. 4B except for the provision of secondary frame members.

More specifically, a pair of secondary arcuated frame members 48' and 49' are articuated at one end to the junction 40 and on the other end portions to the free ends of the stay members 14 and 15 respectively. Another pair of secondary frame members 54 and 55 cross the stay members 14 and 15 approximately on the middle portions, and a further pair of secondary frame members 56 and 57 cross the stay members 14 and 15 on the lower portions. Further a pair of secondary frame members 58 and 59 are connected at one end to the arcuated member 48' and 49' and terminate short of the rib members 12 and 13. The secondary frame members 48' 54, 56 and 58 are symmetric with respect to the secondary frame members 49', 55, 57 and 59 about the axis of the spinal member 10 or the central axis of the kite while the secondary frame members 54, 55, 56 and 57 pass between the surface member and the associated stay member 14 or 15 to generally point toward the junction 40. The secondary frame members may be of the same material as the primary frame member.

Figure 32:
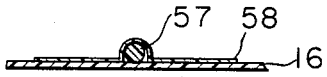
FIG. 32 is a fragmental cross sectional view taken along the line XXXII—XXXII of FIG. 31.

All the secondary frame members are fixedly secured to the surface member 16 by any suitable means such as an adhesive tape or a bonding agent 58 for the member 57 shown in FIG. 32. Thus the secondary frame members 48', 49' 54, 55, 56 and 57 are integral with the surface member 16 to hold the shape of the kite.

Each of the spinal member 10, the rib members 12 and 14 and the stay members 14 and 15 called the primary frame members are only fixed on the selected portions to the surface member 16 by any suitable bonding agent so that each member as a whole is released from the surface member 16.

In other respects the arrangement is similar to that shown in FIG. 4B.

In the arrangement of FIG. 31, the application of a wind pressure to the surface member 16 pushes the secondary frame members against the primary frame members to permit the wind pressure exerting on the surface member 16 to be transmitted to the primary frame members. Thus the wind pressure is borne on the primary frame members.

The primary and secondary frame members are arranged to be maintained separated apart from each other in the absence of a wind pressure and to be contacted by each other in the presence of the wind pressure. If desired, the secondary frame members may be initially connected to the associated ones of the primary frame members.

Thus it is seen that by preparing the secondary frame holding the shape of the kite separately from the primary frame members bearing a wind pressure, any shape can be formed at will without any decrease in strength of a framework involved.

FIG. 33 shows a modification of the arrangement shown in FIG. 31. In the arrangement illustrated, the spinal member 10 is formed, for example, of a cord-like member 10' and the rib members 12 and 13 are replaced by tensioning members 12' and 13' finer than the stay members 14 and 15 for maintaining a constant distance between the junction D and each of the junctions A or B. The stay member 14 and 15 serve as primary frame members bearing a wind pressure applied to the surface member 16 or the wind bearing surfaces 16-2 and 16-3.

Figure 34:
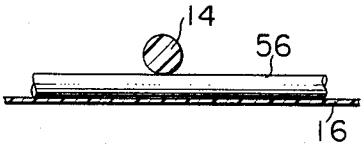
FIG. 34 is a fragmental cross sectional view taken along the line XXXIV—XXXIV of FIG. 33.

A plurality, in this case, two pairs of secondary frame members such as shown in FIG. 31 are articulated together to the junction D to which a piece of string 20 is tied. The secondary frame members are suitably fixed to the surface member 16 and overlain by the primary frame member 14 or 15 as shown for secondary member 56 in FIG. 34.

In other respects, the arrangement is similar to that shown in FIG. 31 except for the omission of the secondary frame members 58 and 59.

Upon a wind pressure exerting on the surface or the bilateral symmetric wind-bearing surfaces 16-2 16-3 of the kite, both surfaces tend to be rotated about the axis of the central member 10' or the central axis of the kite along with the secondary frame members 48', 49' and 54 through 57 attached to the surface member 16. Because all the secondary frame members are attached to the surface member 16 to cross the primary frame members 14 and 15, the wind pressure applied to the wind bearing surfaces 16-2 and 16-3 is to be fully transmitted to the primary framing members 14 and 15 through the secondary frame members.

It is noted that the primary frame members 14 and 15 are dimensioned and shaped so that the deformation and strength due to the wind pressure do not exceed respective permissible values thereof.

During the application of a wind pressure to the kite, the arcuated resilient member 44 exerts a reaction force on the principal frame members 14 and 15 thereby to cause a bending deformation and/or twist of the latter. In order to prevent the primary frame members from being deformed and/or twisted due to their bending, the primary members have been mounted at the point D so as to be freely rotatably about the axis of the central member 10' while the tensioning members 12' and 13' have been spanned between the points A and B respectively on the primary frame members 14 and 15 with both members inter-articulated at the point D on the central axis. It is to be noted that the tensioning members 12' and 13' are scarcely expected to bear a wind pressure applied to wind bearing surfaces.

The primary frame members 14 and 15 preferably have the cross section of hollow or solid circular shape because not only the bending rigidity but also the twisting rigidity is required to be increased and the weight is restricted.

If desired, that portion of the surface member 16 extending along the central axis may form the central member 10'. Also the tensioning members 12' and 13' may be formed of cord-like members. In addition, the secondary frame members 54 through 57 may be so dimensioned that their inner ends or those ends thereof remote from the edge of the surface member 16 do not reach the point D.

The arrangement of FIG. 33 is advantageous in that the kite is largely decreased in weight and improved in flight performance while a deformation required for the kite to stably fly in the air does not exceed a permissible value thereof and a variety of the kite's shape to be selected becomes plenty.

In attempts to fly conventional kites such as rectangular kites and kites in the shape of a Japanese footman of olden times, they could frequently fall to the ground owing to the wind conditions and particularly when the kite string was short in the beginning of the flying process. This fall has resulted in a crash against the surface of the earth or the like until the frame and surface members would have been broken.

In the arrangement of FIG. 33 such a crash has very frequently led to a fear that those portions of the secondary frame members remote away from the axis of the central member 10' such as designated by GE, HF, $G_1K_1$ and $H_1K_2$ will undergo impact forces upon their crash against the surface of the earth until they will be broken.

Also in the structure of kites including, in addition to primary and secondary frame members and a resilient member as in the arrangement of FIG. 31, another pair of secondary frame members forming leading edge to a wind such as shown in FIG. 4B or 28 could be broken upon the occurrence of high bending stresses therein due to the crash as above described.

In order to avoid a fear that the secondary frame members shown in FIG. 33 will be broken upon the occurrence of a crash against the surface of the earth or the like, those portions of the secondary frame members 48', 49' 56 and 57 disposed on that side of the primary members 14 and 15 remote from the central member 10' and designated by GF, HF, $G_1K_2$ and $H_1K_2$ are formed of any suitable shock-resisting material selected from the group consisting of bamboo, glass fibers, epoxy resins, fine metallic wire, somewhat soft plastics etc. Of course, those frame members in their entirety may be formed of such a shock-resisting material. If desired, the secondary frame members 54 and 55 may be partly or entirely formed of a shock-resisting material as above described.

When having falled to the ground or when having struck against an obstacle, the secondary frame members thus modified have the outwardly projecting portions thereof prevented from damaging, resulting in the provision of a flying object well withstanding any crash due to the fall.

FIG. 35 shows a modification of the arrangement as shown in FIG. 33. The arrangement illustrated is different from that shown in FIG. 33 only in that in FIG. 35 the secondary frame members 48', 49', 56 and 57 have outer portions formed of a shock-resisting material in the same manner as above described in conjunction with FIG. 33 and the tensioning members 12' and 13' are omitted. The arcuated frame members 48 and 49 are shown in FIG. 35 as forming leading edges to a wind. Therefore the description need not be further made.

Figure 36:
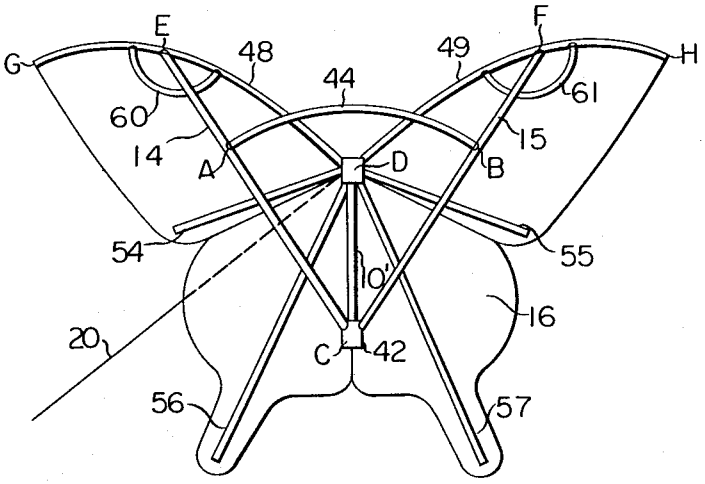
FIG. 36 is a view similar to FIG. 35 but illustrating a modification of the arrangement shown in FIG. 35.

FIG. 36 shows a reinforcement for preventing a secondary arcuated frame member forming a leading edge to a wind from damaging upon the occurrence of a crash against the ground or the like due to the fall of an associate kite. In FIG. 36, a circular segment 60 or 61 is disposed about the junction E or F of the secondary arcuated frame member 48 or 49 and the free end of the primary frame member 14 or 15 on the surface member 16 by having both ends thereof connected to the mating arcuated frame member. The segment 60 or 61 traverses the primary frame member 14 or 15 to extend between the surface member 16 and the latter and serves to reinforce the portion of the frame member 48 or 49 located around the junction E or F for the purpose of preventing the frame member 48 or 49 from causing a fault such as a break.

The circular segments 60 and 61 form reinforcements and may be of piano wire, bamboo or plastic. If desired, the reinforcements 60 and 61 may be rectilinear. Alternatively each of the reinforcements may comprise a piece of slightly thicker paper, plastic sheet, wooden sheet or the like sticked to those portions of the frame and surface member 48 or 49 and 16 respectively located at least in the vicinity of the junction E or F.

In other respects the arrangement is similar to that shown in FIG. 35.

The arrangement of FIG. 36 is advantageous in that, even though the secondary arcuated frame members forming the leading edges are applied with impact forces resulting from its fall, the secondary frame members are effectively prevented from being broken.

Figure 37:
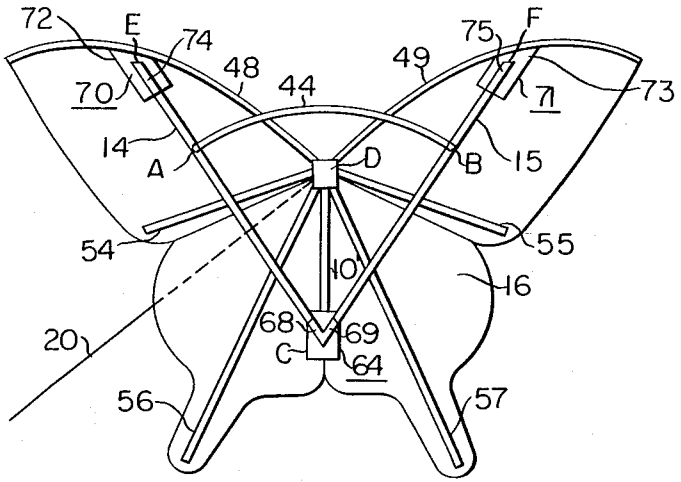
FIG. 37 is a view similar to FIG. 36 but illustrating still another modification of the present invention.
Figure 38:
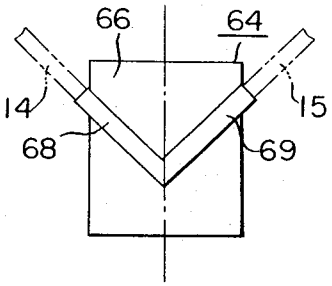
FIG. 38 is an enlarged plan view of the joint shown in FIG. 37.

In order to facilitate the housing and transporting of the present kite, the primary frame members are detachably connected to each other and to the secondary frame members forming leading edges to a wind as shown in FIG. 37. More specifically, the primary frame members 14 and 15 are detachably connected on one end to each other by a joint generally designated by the reference numeral 64. As best shown in FIG. 38, the joint 64 includes a rectangular holding piece 66 of any suitable sheet material freely bendable about the longitudinal axis thereof and a pair of short sleeves 68 and 69 interconnected into a V-shape and fixedly secured to the holding piece 66 with the longitudinal axis of the piece 66 bisecting a predetermined angle at the vertex of the "V". Then the rectangular piece 66 is attached to the surface member 16 as by any suitable bonding agent so that the longitudinal axis of the holding piece 66 coincides with the axis of the central member 10' with the vertex of the V lying at the point C. The sleeves 68 and 69 are so dimensioned that the primary frame members 14 and 15 are snugly and detachably fitted thereinto respectively.

The primary frame members 14 and 15 are also detachably fixed on the other end portions to those portions of the surface member 16 adjacent to the points E and F, by joints generally designated by reference numerals 70 and 71 respectively. Both joints 70 and 71 are of the same construction and one of them, for example, the joint 70 will be described in conjunction with FIG. 39. The joint 70 includes a holding piece 72 that may be of the same material as the holding piece 64 and a sleeve 74 fixed to the piece 72 along the longitudinal axis thereof. Then the joint 70 is attached to that portion of the surface member 16 adjacent to the point E on the secondary arcuated frame member 48, with the oblique side intimately contacted by the mating portion of the arcuated frame member 48.

The joint 71 includes the components 73 and 75 corresponding to the components 72 and 74 of the joint 70 respectively.

The other end portions of the primary frame members 14 and 15 are adapted to be snugly and detachably fitted into the sleeves 74 and 75 respectively until the other ends thereof reach the bottoms of the respective sleeves slightly spaced apart from the adjacent portions of the secondary frame members 48, and 49 as shown in FIG. 37.

If desired, the holding piece 66 and the sleeves 68 and 69 may be of any suitable plastic moulded into a unitary structure. This is true in the case of the holding piece and sleeve 72 and 74 or 73 and 75.

Each of the primary frame members 14 or 15 can readily be inserted into the joints 64 and 70 or 71 through the utilization of the flexibility or extensible and contractile property thereof for flying purposes.

In order to house or transport the arrangement of FIG. 37, the primary frame members 14 and 15 are first removed from the associated joints through the utilization of their flexiblity or the like. Then the surface member 16 with the secondary frame members 48, 49 and 54 through 57 can be folded about the point D and in a manner resembling the folding of an umbrella.

Figure 39:
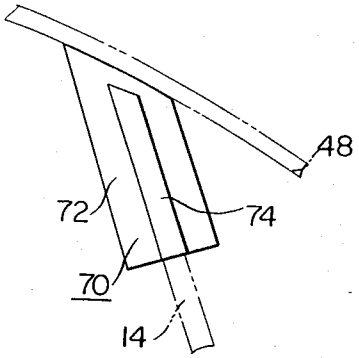
FIG. 39 is a view similar to FIG. 38 but illustrating another joint shown in FIG. 37.

The arrangement shown in FIGS. 37, 38 and 39 is also advantageous in that any broken primary member is readily replaced by a fresh one for repair purposes.

The shape of flying objects such as kites can be generally varied in numerous manners and may be of three-dimensional curvature. It is very difficult to attach the surface member to frameworks of complicated configuration without wrinkles and/or slacks usually caused on the surface member.

Such wrinkles and/or slacks developed on the surface member cause the bilateral surface portions thereof to be put in imbalance resulting in one of the factors of greatly decreasing the stability of flying objects being flying in the air.

The present invention also prevents the formation of wrinkles and/or slacks on the surface member by utilizing the elastic force of at least some of frame members forming a hull thereby to impart a tension to the surface member to firmly fix it to the frame members so as to form no wrinkle nor slack on the surface member.

Figure 40:
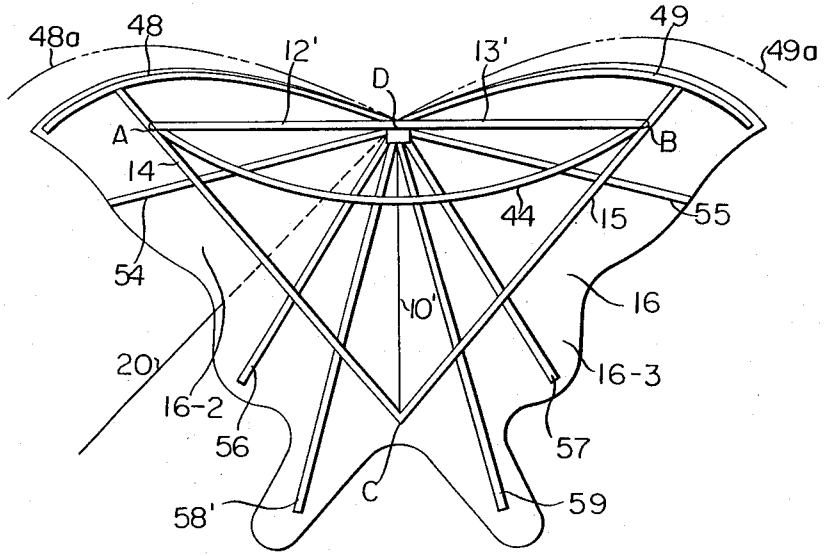
FIG. 40 is a plan view of a further modification of the present invention.

One form of the present invention just described is shown in FIG. 40. The arrangement illustrated is substantially similar to that shown in FIG. 33 excepting that in FIG. 40 the secondary arcuated frame members forming the leading edges are resilient and a pair of secondary frame members are additionally disposed on the surface member and symmetric with respect to the central axis thereof to be articulated to the point D.

More specifically, the secondary arcuated frame members 48 and 49 are of any suitable material high in resilience and less in creep strain such as fine piano wire, bamboo etc.

Each of the articulated frame members 48 or 49 has been preliminarily formed into a shape approximating the final predetermined shape thereof unless it is constrained by the surface member 16. Each of the arcuated members 48 and 49 has had the initial shape shown at dotted line **48*a* and 49*a* in FIG. 40**.

In order to assemble the arrangement of FIG. 40, the primary frame members 14 and 15, the secondary frame members 54 through 59', the tensioning members 12' and 13' and the resilient member 44 are first disposed as in the manner as shown in FIG. 40 to form a hull or a framework. Then the surface member 16 is attached to the framework thus formed. To this end, the surface member 16 is provisionally fixed at that point on the framework preferably located apart from those frame members for imparting a tension to the surface member 16, that is to say, the secondary frame members 48 and 49 forming the leading edges, in this case, in the vicinity of the point C.

Then the secondary arcuated frame members 48 and 49 in the initial shape as above described is fixedly secured at one end to the surface member 16 about a point adjacent to the point D on the central axis of the surface member 16. Then by applying an external force to the other end portion of each arcuated member 48 or 49, the latter is deformed within its elastic deformation to follow the edge of the resulting kite. At that time, the secondary arcuated frame members 48, and 49 are fixedly secured to the surface member 16 by any suitable means after which the external force can be removed from each arcuated member. This removal of the forces from the secondary frame members 48 and 49 causes the tendency for those member to be returned back to their original shapes by the action of their own resilience. However the frame members 48 and 49 are not permitted to be returned back to their original shapes because of their fixation on the surface member 16 and instead, they impart a tension to the surface member 16 while maintaining the remaining frame members fixed to the surface member 16.

It is to be understood that any one pair or more of the bilateral frame members other than a pair of arcuated frame members 48 and 49 or even all the frame members may be utilized to impart a tension to the surface member.

Thus the arrangement of FIG. 40 is advantageous in that the surface member is effectively prevented from wrinkling and/or slacking resulting in elimination of the phenomenon that the kite is flying in its unstable state due to large deformations occurring on the surface member.

Figure 41:
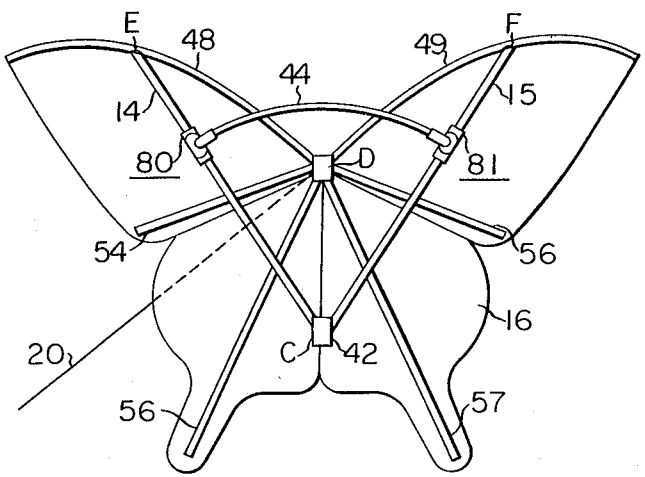
FIG. 41 is a view similar to FIG. 40 but illustrating another modification of the present invention.

FIG. 41 shows a further modification of the present invention wherein the resilient members are pivotally connected at both ends to the primary frame members. The arrangement illustrated is different from that shown in FIG. 36 without the reinforcements 60 and 61 only in that in FIG. 41 both ends of the resilient member 44 are pivotally connected to the primary frame members 14 and 15 through individual couplings generally designated by the reference numerals 80 and 81 respectively.

The couplings 80 and 81 are of the same construction and one of the couplings, for example, the coupling 80 will now be described in conjunction with FIGS. 42, 43 and 44. The coupling 80 includes a first tubular element 82 provided on the outer periphery with a flat recess 84, and a second tubular element 86 having one end portion 88 pressed into the flat. The second tubular element 86 is connected to the first tubular element 82 by having the flat end portion 88 rotatably connected to the flat recess 84 on the first tubular element 82 through a rivet or pin 90 (see FIG. 44) threaded through a hole 92 formed on the flat end portion 88 for relative rotation about the axis of the rivet or pin 90.

The coupling 81 includes the components 83, 85, 87, 89 and 91 corresponding to the components 82, 84, 86, 88 and 90 of the coupling 80 respectively.

Figure 42:
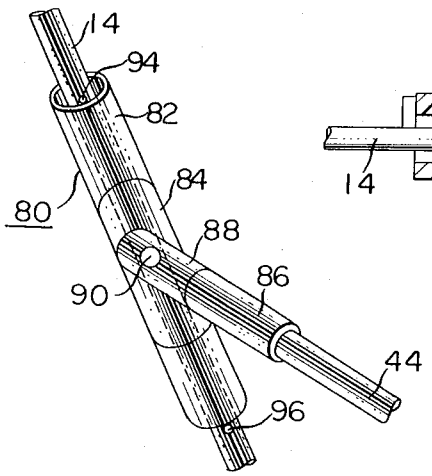
FIG. 42 is a perspective view of the coupling shown in FIG. 41.

After the primary frame member 14 or 15 has been loosely threaded into the associated coupling 80 or 81, the latter is positioned around the frame member on a predetermined portion by a pair of positioning pins 94 and 96 as shown in FIG. 42. The resilient member 44 has each end portion snugly fitted into the second tubular elements 86 or 87 (see FIG. 45). Thus the resilient member 44 is connected to the primary frame member 82 or 83 to be rotatable about the axis of both rivets or pins.

Where the kites as shown in FIG. 41 is flying in the air by receiving a wind pressure, the arcuated resilient member 44 is responsive to the wind pressure to change in curvature so as to decrease its radius of curvature. This prevents a twisting force from being applied to each of the primary frame members 14 or 15 while the resilient member 44 is permitted to be smoothly rotated with respect to the primary frame members 14 and 15.

Therefore the arrangement of FIG. 41 eliminates the disadvantages resulting from the resilient member fixedly connected to both primary frame members. With the resilient member 44 fixedly connected to the primary frame members 14 and 15, a change in radius of curvature of the resilient member 44 due to a wind pressure applied to the kite causes a twisting force to be applied to each of primary frame member 14 or 15. This brings about a deformation of the kite objectionable to its flying, such as the deformation of the secondary frame members 48, 49 and 54 through 57.

The coupling 80 or 81 also serves as a reinforcement for the primary frame member 14 or 15.

Figure 45:
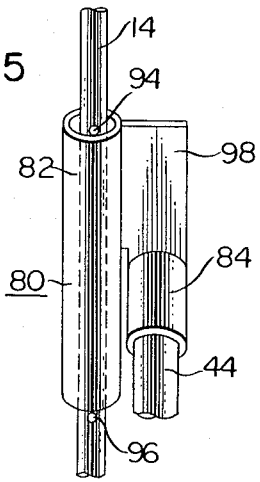
FIG. 45 is a view similar to FIG. 42 but illustrating a modification of the coupling shown in FIG. 41.
Figure 44:
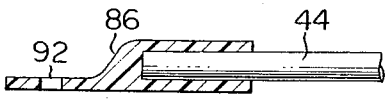
Figure 43:
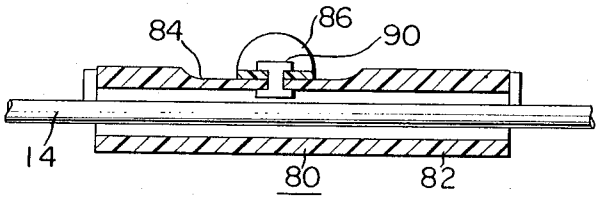
FIG. 43 is a longitudinal sectional view of the first tubular element shown in FIG. 42.

In FIG. 45 wherein like reference numerals designate the components identical or similar to those shown in FIGS. 42, 43 and 44, there is illustrated a modification of the couplings 80 as above described. The arrangement illustrated includes a first tubular element 82 and a second tubular element 84 closed at one end by having the one end portion pressed into a flat sheet 98 of substantially rectangular shape. The flat sheet serves as a connector 98 for interconnecting both tubular elements 82 and 84. That is, that side of the connector 98 parallel to the longitudinal axis of the second tubular element 84 is longitudinally connected to the outer periphery of the first tubular element to provide a flexible connection between both elements.

In other respects the arrangement is similar to that shown in FIGS. 42, 43 and 44.

The tubular elements 82 and 84 and the connector 98 may be formed into a unitary structure according to molding technique using any suitable plastic such as polyethylene, polypropyrene or polyvinyl chloride. Alternatively they may be separately molded and then united to one another.

The various embodiments of the present invention as above described have the light weight and the high strength framework sufficient to minimize the deformation thereof while stably flying within a wind range of from a breeze to a gale. Therefore the resilient member 44 is required to control the interfacial angle formed between a pair of plain surfaces 16-2 and 16-3 to a certain value or less so as to provide a buoyancy for the kite sufficient to fly it even with a gale. If it is attempted to improve the characteristics of the kite during gales then the resilient member 44 should have a very large spring constant attended with an increase in weight of the same including primary frame members. This adversely affects the characteristics of the kite during breezes.

Figure 46:
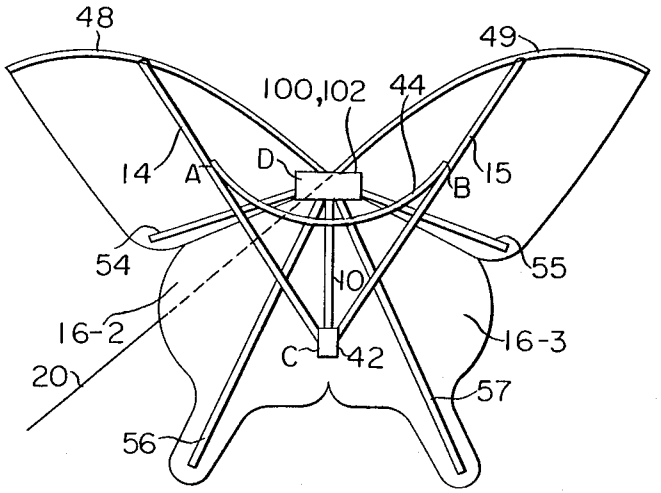
FIG. 46 is a plan view of a different modification of the present invention.

This disadvantage can be eliminated by the provision of a different modification of the present invention as shown in FIG. 46 including composite spring means. The arrangement illustrated is substantially similar to that shown in FIG. 41 excepting that in FIG. 46 the resilient member 44 acting as the main spring is rigidly secured to the primary frame members 14 and 15 and the spinal member 10 is fixedly secured to the surface member 16 through a leaf spring and a hinge.

Figure 47:
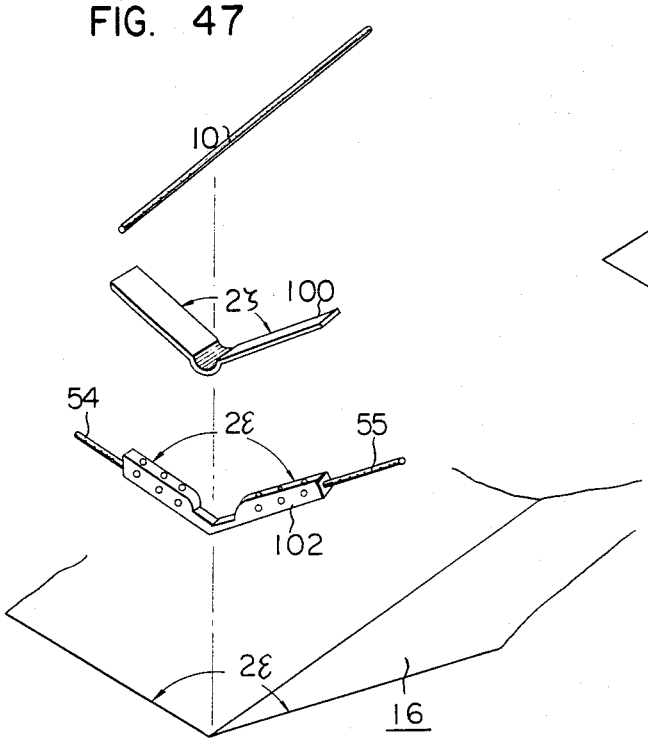
FIG. 47 is an exploded perspective view of the essential portion of the arrangement shown in FIG. 46.

The spinal member 10 shown in FIG. 47 as being of a circular cross section is provided on one end portion, in this case, the upper end portion as viewed in FIG. 46 with an angled leaf spring 100 composed of any suitable spring material such as phospher bronze and serving as an auxiliary spring. As best shown in FIG. 47, the leaf spring 100 has one half bent at an angle $2\tau$ to the other half so as to form therebetween a semicircular valley complementary in shape to the spinal member 10. The angle $2\tau$ is smaller than the initial angle $2\epsilon$ formed between the wind bearing surfaces 16-2 and 16-3 of the surface member 16.

The angled leaf spring 100 with the spinal member 10 fixed to the semicircular valley thereof is disposed on a hinge 102 having the secondary frame members 48', 54 and 56 or the secondary frame members 49', 55 and 57 attached to each side thereof as shown by the secondary frame member 54 or 55. Then the hinge 102 is fixedly disposed on the surface number 16 at its position where the spinal member 10 is located along the central axis of the surface member 16 with the end thereof positioned directly above the edge of the surface member 16. Thus the hinge 102 maintains tthe initial angle $2\epsilon$ between the plain or wind bearing surfaces 16-2 and 16-3.

Figure 48:
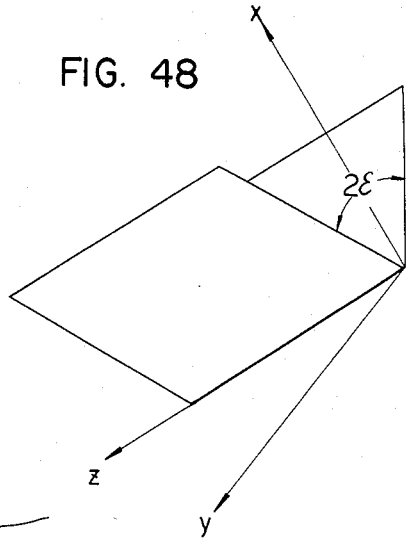
FIG. 48 is a schematic diagram illustrating a three-dimensional orthogonal coordinate system useful in explaining the operation of the arrangements shown in FIGS. 46 and 47.
Figure 49:
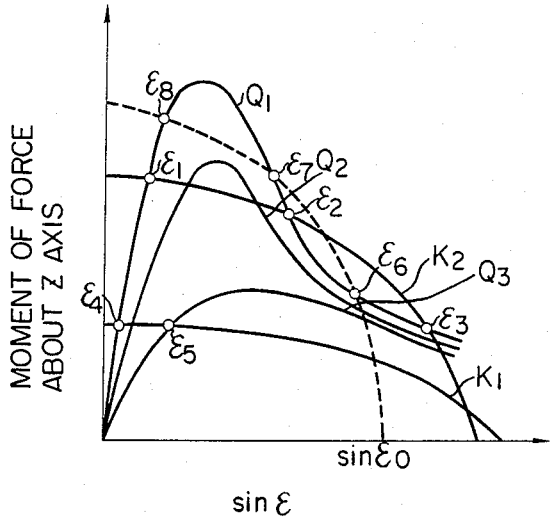
FIG. 49 is a graph similar to FIG. 13 but illustrating the characteristics of the arrangement shown in FIGS. 46 and 47.

The operation of the arrangements shown in FIGS. 46 and 47 will now be described with reference to a three-dimensional orthogonal coordinate system as shown in FIG. 48. As shown, the coordinate system has the origin at the point D as shown in FIG. 46 an z axis extending along a fold on the central axis of the surface member 16 and an x axis bisecting the interfacial angle $2\epsilon$ between the plain surfaces 16-2 and 16-3. Referring to the coordinate system as shown in FIG. 48, a moment of wind force about the z axis is such as shown in FIG. 49. A graph as shown in FIG. 49 is substantially identical to that illustrated in FIG. 13 and like reference characters have the same meaning as those denoted in FIG. 13.

From FIG. 49 it is seen that for a high wind velocity, the curve $Q_1$ for the moment of wind force about the z axis intersects at three points $\epsilon_1$, $\epsilon_2$ and $\epsilon_3$ the curve $K_2$ for the moment of elastic force about the same axis with the resilient member 44 having a proper spring constant. Points $\epsilon_1$ and $\epsilon_3$ are stable points but point $\epsilon_2$ is an unstable point. On the contrary, where the spring constant of the resilient member 44 is too small to apply a sufficient reaction force to each primary frame member 14 or 15 from the resilient member 44, the moment of elastic force about the z axis is equal to that of wind force about the same axis at point $\epsilon_4$ for a high wind velocity and at point $\epsilon_5$ for a low wind velocity. Either of points $\epsilon_4$ and $\epsilon_5$ lies within a range of fairly small values of the interfacial angle formed between the plain surfaces 16-2 and 16-3 of the surface member 16. This results in no buoyance required for the kite to float in the air. Thus the kite may fall to the ground.

In order to avoid this fall of the kite, the spring constant of the resilient member 44 is required to be fairly large attended with an increase in diameter of the resilient member 44 and hence a corresponding increase in diameter of each primary frame member 14 or 15. This causes an increase in weight of the kite and therefore a decrease in flight performance of the kite during breezes.

On the other hand, the auxiliary spring or leaf spring 100 is initiated to apply a reaction force to each of the secondary frame members in response to the rotation of each of the wind bearing surfaces 16-2 and 16-3 through a certain angle about the central axis of the surface member 16 due to a wind pressure exerting on the wind bearing surfaces. More specifically, when the two wind bearing surfaces 16-2 and 16-3 have been rotated about the central axis of the surface member 16 to form an angle $2\epsilon_o$ therebetween, the auxiliary leaf spring 100 is immediately initiated to apply a reaction force to each of the frame members maintaining the shape of the kite as shown at dotted line in FIG. 49 describing a moment of force about the z axis exerted by the leaf spring 100. Therefore the elastic force applied to the frame members abruptly changes at the central angle $2\epsilon_o$ after which the moment of reaction force about the z axis provided by the leaf spring 100 can be equal to the moment of wind force about the same axis at stable points $\epsilon_6$ and $\epsilon_7$ for a high wind velocity.

Thus the arrangement as shown in FIGS. 46 and 47 improves the flight characteristics of the kite during gales without deteriorating those during breezes.

Figure 50:
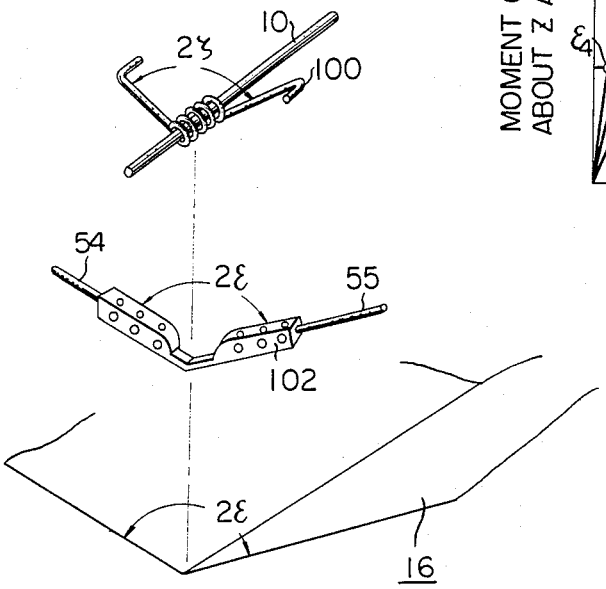
FIG. 50 is a view similar to FIG. 47 but illustrating a modification of the arrangement shown in FIG. 47.

The arrangement shown in FIG. 50 is different from that illustrated in FIG. 47 only in that in FIG. 50 a helical spring member as an auxiliary spring is disposed around one end portion of the spinal member 10 and has both end portions radially extended to form therebetween the angle 2 as above described. In FIG. 50 like reference numerals designate the components identical or corresponding to those shown in FIG. 47.

FIG. 51 shows still another modification of the present invention including an auxiliary wing. The arrangement illustrated is different from that shown in FIG. 4A only in that in FIG. 51 an auxiliary wing is fixedly secured to the point C. As shown in FIG. 51, a pair of relatively short frame members 104 and 105 fixedly connected at one end to the junction C are aligned with the stay members 15 and 14 respectively and have free end portions interconnected through a frame member 106 to form a framework in the form of an isosceles triangle disposed symmetrically with respect to the central axis of the arrangement. A surface member 108 in the form of a generally isosceles triangle is fixedly secured to the framework 104-105-106 to form an auxiliary wing AW. The surface member 16 and the associated frame members form the main wing MW.

As previously described, the main wing MW has a pair of plain surfaces 16-2 and 16-3 rotatable away from and toward each other about the longitudinal axis of the spinal member 10 or the central axis. However the auxiliarly wing AW has the junction of the frame members 104 and 105 connected to the hinge 42 on the main wing MW against movement and can be scarcely deformed.

The arrangement illustrated in FIG. 52 is different from that shown in FIG. 51 only in that the auxiliary wing is connected to the hinge 40 connecting the rib members 12 and 13. As shown in FIG. 52, a pair of frame members 108 and 109 are connected at one end to the hinge 40 with the spinal member 10 to extend at equal angles to the longitudinal axis of the spinal frame member 10 on both sides. The spinal member 10 has the lower end as viewed in FIG. 52 fixed perpendicularly to a frame member 106 at the center. A pair of hinges 42 and 43 disposed at both ends of the frame member 106 serve to articulate the stay frame members 14 and 15 to the frame members 108 and 109 respectively with the frame members 108 and 109 fixed on the intermediate portions to the hinges 42 and 43 respectively.

The frame members 12, 14 and 108 form one of frameworks for the main wing rotatable about the longitudinal axis of the frame member 108 while the frame members 13, 15 and 109 form the other framework for the main wing rotatable about the longitudinal axis of the frame member 109. Further the frame members 10, 106, 108 and 109 form a framework for the auxiliary wing arranged not to be deformed.

The operation of the arrangement as shown in FIG. 51 will now be described in conjunction with FIGS. 53A and 53B wherein a model made for the arrangement as shown in FIG. 51 is illustrated and like reference characters and numerals designate the components identical to those shown in FIG. 51. Referring to a three-dimensional orthogonal coordinate system including the origin lying at the supporting point 46 having a kite string 20 tied thereto, an x axis bisecting the interfacial angle $2\epsilon$ between the plain surfaces 16-2 and 16-3 of the main wing MW and a z axis disposed along the central axis of the main wing MW to be directed toward the auxiliary wing AW as shown in FIG. 52A. A wind pressure and a left applied to and an attack angle of a flying object such as the kite shown in FIG. 51 will now be discussed. by using the symbols as previously defined.

As previously described, each plain surface of the main wing has perpendicularly applied thereto a wind pressure D approximately expressed by $$D=(C_D/2)\int U^2{}_\infty S\cos\theta\sin\epsilon$$

where $\theta$ designates an attack angle as shown in FIG. 53A. The resultant of those wind pressures is applied to the main wing and effective for flying the main wing up in the air.

Assuming that this resultant is designates by $F_D$, $$F_D=\Sigma D\sin\epsilon$$

is obtained as will readily be seen in FIG. 53B. Therefore one obtains $$F_D=2(C_D/2)\int U^2{}_\infty S\cos\theta\sin^2\epsilon$$

which is, in turn, reduced to $$F_D=Do\cos\theta\sin^2\theta \tag{43}$$

by putting $Do=2(C_D/2)\int U^2{}_\infty S$. Therefore the force $F_D$ has its torque $T_D$ about the origin or supporting point 46 expressed by $$T_D=A_z^{(1)}Do\cos\theta\sin^2\epsilon$$

This will be seen from the illustration of FIG. 53A.

It is assumed that the wind velocity $U_\infty$ is parallel to the surface of the earth as shown at the arrow in FIG. 53A and that Ds designates a skin friction drag caused from the wind velocity along each plain surface of the main wing MW as shown in FIGS. 53A and 53B. Then Ds is expressed by $$Ds=(C_D'/2)\int U^2{}_\infty S\cos\epsilon$$

where $C_D'$ designates a skin friction drag coefficient. Since skin friction drags applied to the two plain surfaces of the main wing are equal to each other the resultant Fs of these forces applied to the main wing is expressed by $$Fs=\Sigma Ds\cos\epsilon$$

$$=2\frac{C_D'}{2}\delta U^2{}_\infty S\cos^2\epsilon$$

which is reduced to $$Fs=Do'\cos^2\epsilon \tag{44}$$

by putting $Do'=2(C_D'/2)\int U_\infty{}^2 S$ as in the equation (43). As seen in FIG. 53A, the resultant Fs has its torque Ts about the supporting point 46 expressed by $$Ts=A_z^{(2)}Do'\cos^2\epsilon\cos\theta-A_z^{(2)}Do'\cos^2\epsilon\sin\theta\cos\epsilon$$

It is assumed that a torque about the supporting point directed in the clockwise direction is positive.

Also assuming that the auxiliary wing AW has an area S', a wind pressure or a pressure drag Dp perpendicularly applied to the auxiliary wing is approximately expressed by $$Dp=(C_D/2)\int U_\infty{}^2 S'\cos\theta$$

which is reduced to $$Dp=Do\eta\cos\theta$$

where $\eta=S'/2S$. Therefore this Dp has a torque about the supporting point expressed by $$Tp=A_z^{(3)}Do\cos\theta$$

where $A^{(3)}$ is a vector connecting the origin to the center of wind on the auxiliary wing.

Further, the weight of the flying object per se causes a gravity torque about the supporting point. As seen in FIG. 54A, the weight expressed by Mg causes a torque $T_M$ about the supporting point 46 expressed by $$T_M=BzMg\sin\theta+BxMg\cos\theta\cos\epsilon$$

From the foregoing it will readily be understood that, in order to maintain the kite stationary in the air, that the algebraic sum of the torques of wind pressure should be equal to the gravity torque about the supporting point. That is, one obtains.

$$Az^{(1)}Do\cos\theta\sin^2\epsilon+Az^{(2)}Do'\cos^2\epsilon\cos\theta$$
$$-Ax^{(2)}Do'\cos^2\epsilon\sin\theta\cos\epsilon+Az^{(3)}Do'\eta\cos\theta$$
$$BzMg\sin\theta-BxMg\cos\theta\cos\epsilon=0$$

This equation can be rearranged to $$\tan\theta=(Az^{(1)}Do\sin^2\epsilon+Az^{(2)}do'\cos^2\epsilon+Az^{(3)}Do\eta-BxMg\cos\epsilon)/(BzMg+Ax^{(2)}Do'\cos^3\epsilon) \tag{45}$$

This equation depicts the relationship between the wind velocity $U_\infty$ and the attack angle $\theta$.

Then a lift for the kite of FIG. 53A will now be described. From FIG. 53A it can be seen that the pressure drags applied to the main and auxiliary wings and the weight of the kite per se are pertinent to the lift thereof.

The pressure drag $F_D$ applied to the main wing has its component $F_D \sin\theta$ contributing to the lift as seen in FIG. 53A. This lift designated by $F_{uD}$ is expressed by $$F_{uD} = F_D \sin\theta = Do \cos\theta \sin^2\epsilon \sin\theta \quad (46)$$

$$= Do \sin^2 \frac{\sin 2\theta}{s}$$

Similarly the pressure drag Dp applied to the auxiliary wing has its component Dp $\sin\theta$ contributing to the lift. This lift designated by Fup is expressed $$Fup = D_p \sin\theta = \eta\, Do \cos\theta \sin\theta \quad (47)$$

$$= \eta\, Do \frac{\sin^2\theta}{2}$$

The condition for flying the kite in the air fulfill the relationship $R_{uD}+F_{up}>Mg$. In other words, the following relationship must be held:

$$Do \frac{\sin 2\theta}{2} (\sin^2\epsilon + \eta) > Mg$$

Assuming that $\eta$ satisfies $\eta=A_z^{(1)}Do/BzMg$, the above relationship is rearranged to $$\frac{\sin 2\theta}{2} (\sin^2\epsilon + \eta) > \frac{A_z^{(1)}}{Bz} \quad (47)$$

Since is a factor concerning the weight of the kite, the area of the main wing and wind velocity, the above equation describes the relationship between a wind velocity and a lift for a given flying object or a given kite.

Figure 54B:
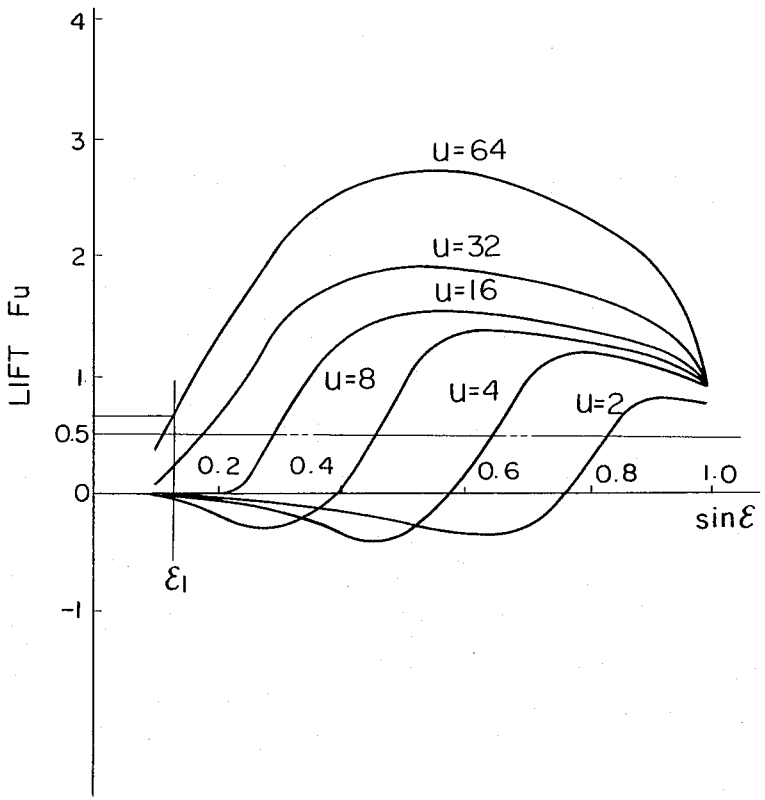
FIGS. 54A and 54B are graphs illustrating the characteristics of the arrangement shown in FIG. 51.
Figure 54A:
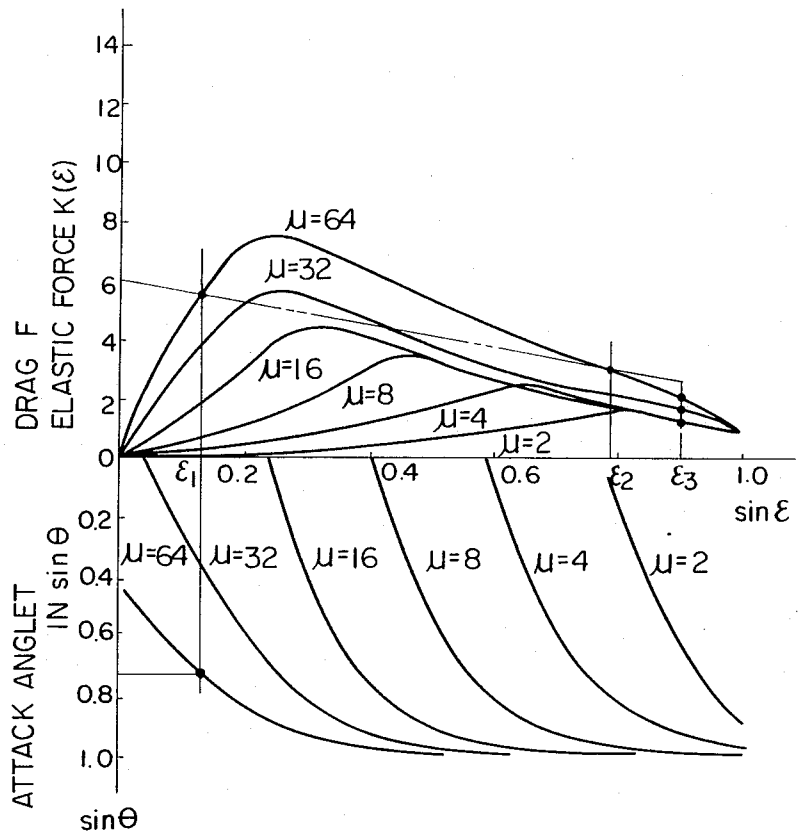

The results of the discussion as above described are shown in FIGS. 54A and 54B. In both Figures it is assumed that $S'/S=0.05$, $Do'/Do=0.02$, $Bx/Bz=2$, $A_z^{(2)}/A_x^{(1)}=1$ and the wind velocity is used as the parameter that is, $\eta=A_z^{(1)}Do/BzMg$ has values differently given. In FIG. 53A the force due to the wind pressure is plotted in ordinate as a function of sin $\epsilon$ in abscissa on the upper portion and the attack angle represented by sin $\theta$ is plotted in ordinate as a function of sin $\epsilon$ in abscissa on the lower portion. In FIG. 54B, the lift is similarly plotted as a function of sin $\epsilon$ with a required minimum lift designated at horizontal broken line. In FIG. 54A the force F due to the pressure drag is equal to the sum of the $F_D$ and $F_S$ expressed by the equations (43) and (44), and the lift $F_u$ is equal to the sum of the $F_{uD}$ and $F_{up}$ expressed by the equations (46) and (47). FIG. 54A also shows an elastic force $M(\epsilon)$ exerted by the resilient member 44 (see FIGS. 53A and 53B) as a function of sin $\epsilon$ at broken line and on the assumption that the elastic force $K(\epsilon)$ is expressed by $K(\epsilon)=\alpha b(1-$ sin) as previously described.

In order to demonstrate the effect of the auxiliary wing, the force $F_D$, the attack angle $\theta$ and the lift $F_u$ have similarly calculated with the arrangement as shown in FIGS. 53A and 53B including no auxiliary wing although such an arrangement has been previously described in detail. Those calculations can be easily conducted by excepting the terms concerning the auxiliary wing from discussion as above described.

This is a force $F_D+F_s$ due to the total wind pressure F applied to the kite is expressed by $$F=F_D+F_s=Do \cos\theta \sin^2\epsilon + D'o \cos^2\epsilon \quad (43')$$

Also the kite has an attack angle $\theta$ expressed by $$\tan\theta = (A_z^{(1)}Do \sin^2\epsilon + A_z^{(2)}Do' \cos^2\epsilon - BxMg \cos\epsilon)/(BzMg + A_x^{(2)}Do' \cos^2\epsilon) \quad (45')$$

Further the lift $F_u$ is expressed by $$F_u = Do \frac{\sin 2\theta}{2} \sin^2\epsilon \quad (44')$$

that should be greater than the weight Mg of the kite.

Figure 55B:
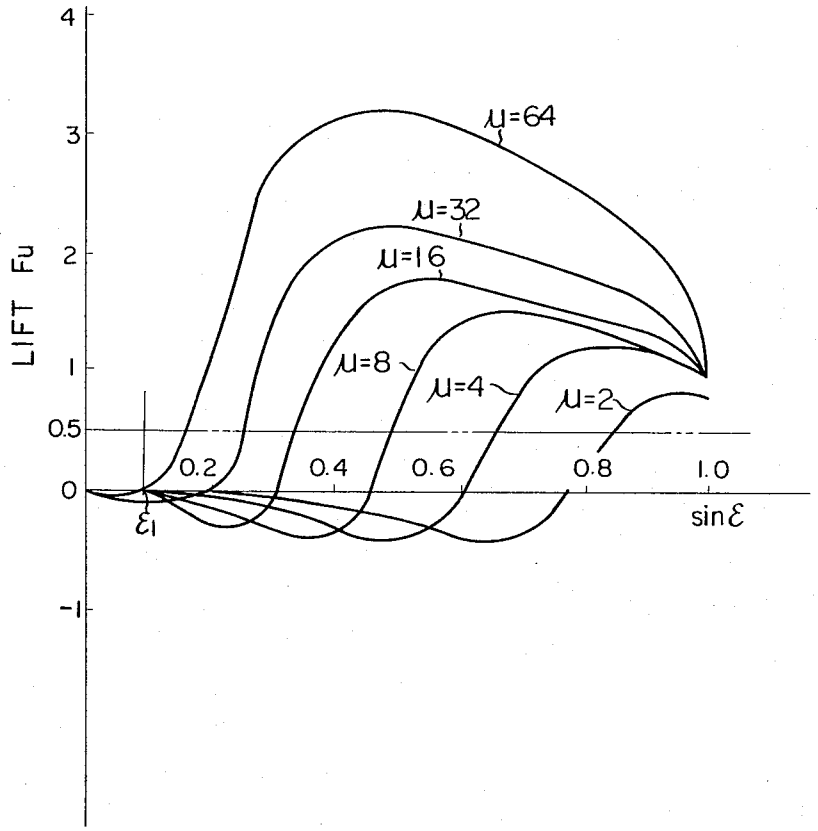
FIGS. 55A and 55B are graphs similar to FIGS. 54A and 54B respectively but illustrating the arrangement of FIG. 51 without the auxiliary wing.
Figure 55A:
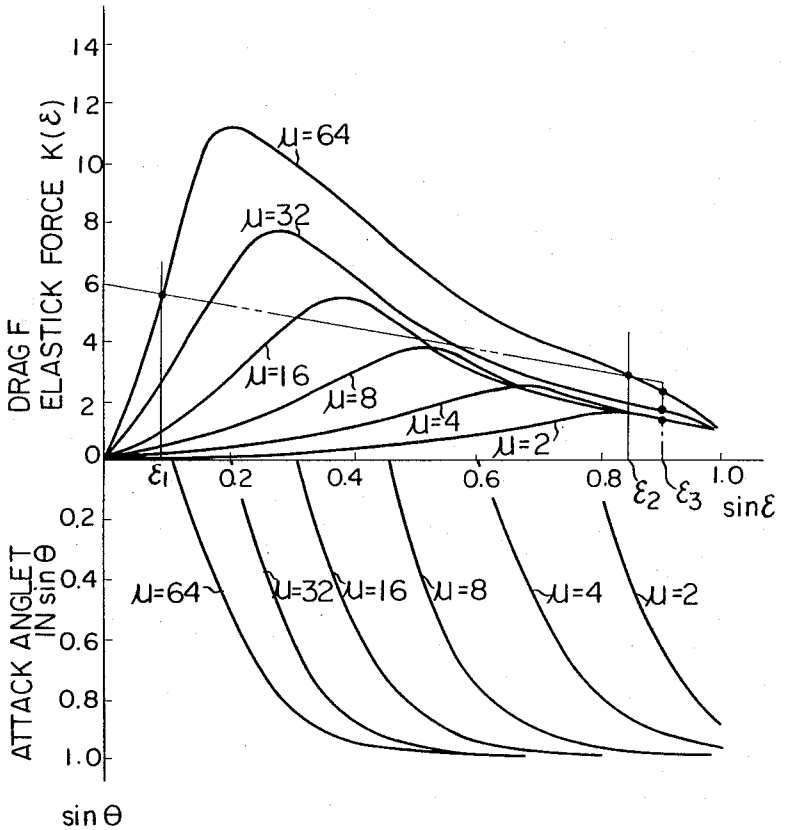

Assuming that $Do'/Do=0.02$, $Bx/Bz=2$ and $A_z^{(2)}/A_z^{(1)}=1$, the force F and the attack angle $\theta$ are plotted as functions of sin in FIG. 55A and the lift $F_u$ is plotted as a function of sin in FIG. 55B as in FIGS. 54A and 54B. In FIG. 55A the elastic force $K(\epsilon)$ is also shown as in FIG. 54A.

In the present invention the interfacial angle $2\epsilon$ formed between both plain surfaces 16-2 and 16-3 of the surface member 16 is changed so as to balance a wind pressure applied to the kite due to the particular wind velocity $U_\infty$ with an elastic force $K(\epsilon)$ provided by the resilient member 44. In other words, a force resulting from the wind pressure can not be higher than the elastic force applied to the kite by the resilient member as previously described. Where the wind pressure and elastic force have been of proper values, the lift $F_u$ due to the wind pressure becomes equal to the elastic force $K(\epsilon)$ at three points as shown at three intersections $\epsilon_1$, $\epsilon_2$ and $\epsilon_3$ of the force curve labelled $\eta=64$ and the elastic force curve shown at dotted line in FIG. 54A or 55A. In this case, the intersections $\epsilon_1$ and $\epsilon_3$ are stable points and the intersection $\epsilon_2$ is an unstable point as previously described in conjunction with FIGS. 9 and 13.

It is assumed that the kite being stably flying in the air with its stable point $\epsilon_3$ is changed to its stable point $\epsilon_1$, in response to a variation in wind velocity and/or a change in wind direction. Also assuming that $\mu$ (which is a function of the wind velocity) is equal to 64, the $\epsilon_1$ is of five (5) degrees and a corresponding attack angle $\theta$ is less than a null degree, that is, it is negative as shown in FIG. 55A that is, in the abscence of the auxiliary wing. Also, as shown in FIG. 55B, a corresponding lift $F_u$ is of a negative value. Under these circumstance, the kite is deprived of the lift resulting in its necessarily falling to the ground.

In the presence of the auxiliary wing, the $\epsilon_1$ has a value of about seven (7) degrees and a corresponding attack angle $\theta$ is of about 46 degrees as seen in FIG. 54A with the conditions remaining unchanged. In addition, the $\epsilon_1$ of about 7 degrees gives a lift of about 0.65. Assuming that the righthand side $A_x^{(1)}/Bz$ of the inequality (47) for lift has a value on the order of 0.5, or that a minimum necessary lift is on the order of 0.5, the kite in the flying state just described has a sufficient lift imparted thereto by the particular wind without any loss in attack angle. Thus the kite continues to be stably flying in the air.

While the kite without the auxiliary wing has been described to fall to the ground at the angle $\epsilon_1$ in conjunction with FIGS. 55A and 55B, it is to be understood that such a kite can effectively fly at the $\epsilon_1$ in the air with the resilient member having an elastic force more or less higher than that illustrated in FIG. 55A.

While the arrangement of FIG. 51 has been described in terms of $\mu=64$, it can been seen from FIGS. 54A and 54B that the same can stably flying in the air at every wind velocity in the air without falling to the ground as far as the auxiliary wing has an area on the order of $S'/2S/2S=0.01$. That is, the data shown in FIGS. 54A and 54B have been obtained with the auxiliary wing having an area equal to one fiftieth of that of the main wing as above described. Assuming that the kite has its own weight of 50 grams $\mu=32$ corresponds to a wind velocity of about 4.2 meters per second and $\mu=64$ corresponds to a wind velocity of about 6 meters per second.

It will readily be understood that the arrangement of FIG. 52 behaves in the similar manner as above described.

While the present invention has been illustrated and described in conjunction with various preferred embodiments thereof it is to be understood that numerous changes and modifications may be resorted to without departing from the spirit and scope of the present invention. For example, the structure of each embodiment is applicable to any of other embodiments.

What we claim is:

1. A kite having a leading edge portion and a trailing edge portion, comprising:

a V-shaped main frame including a pair of stiff elongated ribs relatively positioned symmetrically relative to a central axis of symmetry of the Vee to define a Vee with an apex toward the trailing edge portion of the kite and opening toward the leading edge portion of the kite;

a flexible sheet-like member covering said V-shaped main frame and extending beyond said main frame having a periphery independent of said main frame including a peripheral edge portion at least partially opposite the opening of the V-shaped main frame and defining the leading edge portion of the kite, said flexible sheet-like member being folded along the central axis of symmetry of said V-shaped main frame to define the central axis of symmetry of the kite and two symmetrical halves of the kite, said sheet-like member having a symmetrical leading edge portion and approximately symmetrical lateral and trailing edge portions;

means for fastening said sheet-like member to said main frame;

a first pair of elongated auxiliary frame members disposed symmetrically about the central axis of symmetry of the kite extending along a central longitudinal portion thereof from within said main frame and beyond said main frame back toward the trailing edge portion of the kite, and between said main frame and the sheet-like member, said first pair of elongated auxiliary frame members being resilient and flexible but sufficiently stiff to impart stiffness to said sheet-like member at portions thereof outside of said main frame and to help distribute tension within said sheet-like member;

means for fastening said first pair of auxiliary frame members to said sheet-like member;

a second pair of auxiliary frame members disposed symmetrically about the central axis of symmetry of the kite and along the leading edge portion of the kite, said second pair of auxiliary frame members extending from within said main frame beyond said main frame and between said main frame and said sheet-like member, said second pair of auxiliary frame members being flexible and resilient but sufficiently stiff to impart stiffness to the leading edge portion of the kite and to help distribute tension within said sheet-like member;

means for fastening said second auxiliary frame members to said sheet-like member;

an elastic spacer connected to the respective elongated ribs closer to the open end of said Vee than to the apex of said V-shaped main frame and spanning therebetween to set in cross section of the kite an initial angular separation between the two halves of the kite, said spacer flexing under increases in wind pressure applied to said two halves of the kite to permit the angular spacing between said two kite halves to decrease in response to the wind pressure increase and to maintain the two kite halves angularly spaced, and for restoring the two kite halves to the initial angular spacing when the wind pressure acting on the two kite halves decreases; and means for fixing said elastic spacer to said two elongated ribs.

2. A kite having a leading edge portion and a trailing edge portion, comprising:

a V-shaped main frame including a pair of stiff elongated ribs relatively positioned symmetrically relative to a central axis of the Vee to define a Vee with an apex toward the trailing edge portion of the kite and opening toward the leading edge portion of the kite;

a kite cover covering said V-shaped main frame and having a peripery independent of said main frame including a peripheral edge portion at least partially opposite the opening of the V-shaped main frame and defining the leading edge portion of the kite, said kite cover extending parallel to the central axis of symmetry of said V-shaped main frame to define the longitudinal central axis of symmetry of the kite and two symmetrical halves of the kite defining wind-bearing surfaces, said kite cover having a symmetrical leading edge portion and approximately symmetrical lateral and trailing edge portions;

means for fastening said kite cover to said main frame;

an elastic spacer coupled to the respective elongated ribs on a side opposite to said wind-bearing surfaces and constituting the upper side of said kite and disposed closer to the open end of said Vee than to the apex of said V-shaped main frame and spanning therebetween to set continuously in cross section of the kite an initial angular separation between the two halves of the kite, said spacer deforming under increases in wind pressure applied to said two halves of the kite to permit the angular spacing in cross section between said two kite halves to decrease in response to the wind pressure increase and to maintain the two kite halves angularly spaced, and for restoring the two kite halves to the initial angular spacing when the wind pressure acting on the two halves decreases; and means for coupling said elastic spacer to said two elongated ribs effectively to eliminate torsion and rotation about said longitudinal, central axis of symmetry of said kite.

3. A kite having a leading edge portion and a trailing edge portion according to claim 2, in which a spinal member is disposed extending along said axis symmetry.

4. A kite having a leading edge portion and a trailing edge portion according to claim 3, in which said elongated ribs are connected to said spinal member at said apex.

5. A kite having a leading edge portion and a trailing edge portion according to claim 4, including means for pivotally connecting said elongated ribs to said spinal member.

6. A kite having a leading edge portion and a trailing edge portion according to claim 4, in which said elongated ribs and said spinal member are straight in an unloaded condition and have some stiffness.

7. A kite having a leading edge portion and a trailing edge portion according to claim 2, in which the symmetrical halves of the kite have the configuration of wings of an object defined by the kite cover.

8. A kite having a leading edge portion and a trailing edge portion according to claim 2, in which said kite cover is made of a flexible material, and including a pair of elongated auxiliary frame members disposed joined symmetrically extending transversely between the elongated ribs and joined respectively thereto, said pair of auxiliary frame members being disposed more remote from the apex of said Vee than from said open end of the Vee.

9. A kite having a leading edge portion and a trailing edge portion according to claim 2, in which said kite cover has the configuration of a living object.

10. A kite having a leading edge portion and a trailing edge portion according to claim 2, in which said elastic spacer comprises a spring constant.

11. A kite having a leading edge portion and a trailing edge portion according to claim 2, in which said elastic spacer is connected to said elongated ribs at respective points thereon effective for maintaining said angular spacing of said kite halves in varying wind pressure conditions.

12. A kite having a leading edge portion and a trailing edge portion according to claim 2, in which said means for connecting said elastic spacer to said elongated ribs comprises means movable axially on the ribs in response to wind pressures on the kite to maintain said angular spacing.

13. A kite having a leading edge portion and a trailing edge portion, comprising: a V-shaped main frame including a stiff spinal member disposed defining a longitudinal symmetry of the Vee of the V-shaped frame and of the central axis of the kite, a pair of stiff elongated ribs coupled to said spinal member relatively positioned symmetrically relative to the central axis of the Vee converging to define a Vee with an apex at the spinal member toward the trailing edge portion of the kite and opening toward the leading edge portion of the kite, the main frame having a pair of stiff, elongated auxiliary frame members disposed symmetrically about the spinal member coupled thereto and coupled to respective elongated ribs closer to the open end of said Vee than to the apex of said Vee defining therewith and with said spinal member two right triangles of equal triangular areas disposed symmetrically relative to the axis of symmetry of the main frame and of the kite;

a kite cover covering the V-shaped main frame defining wind-bearing surfaces over said triangular areas to define two symmetrical halves of the kite, the kite cover defining a symmetrical leading portion and approximately symmetrical lateral and trailing edge portions;

means for fastening said kite cover to said main frame;

an elastic spacer coupled to the respective elongated ribs at junctures at which the auxiliary frame members are coupled to the elongated ribs spanning therebetween to set in cross section of the kite an initial positive diehedral angle between the two halves of the kite disposed opposed to each other in a V-shaped configuration in cross section of the kite, the elastic spacer having elasticity to deform to permit the diehedral angle to vary and thereby angular spacing between said two kite halves to decrease in response to a wind pressure increase on said wind-bearing surfaces and to maintain the two kite halves spaced, and for restoring the two kite halves to the initial spacing when the wind pressure acting on the two kite halves decreases; and means for coupling said elastic spacer to said two elongated ribs.

14. A kite having a leading edge portion and a trailing edge portion, according to claim 13, in which said kite cover comprises a flexible sheet-like material.

15. A kite having a leading edge portion and a trailing edge portion according to claim 13, in which said elastic member is of a springy material.

16. A kite having a leading edge portion and a trailing edge portion, according to claim 13, including coupling means for coupling the two elongated ribs to said spinal members to allow the elongated ribs to pivot relative to the spinal member.

17. A kite having a leading edge portion and trailing edge portion, according to claim 13, including coupling means for coupling the elastic member to the elongated ribs on an upper side of the kite constituting a side opposite to the wind-bearing surfaces of the kite cover.

18. A kite having a leading edge portion and a trailing edge portion, according to claim 13, in which said kite has in the vicinity of said spinal member an area defining a point of equilibrium remote from said apex of the Vee located relative to the wind-bearing surfaces on a plane bisecting the initial positive diehedral angle effective upon attachment of the kite to a string generally at said point to cause said kite to develop in flight about said point, self-excited pitching oscillations continuously in steady state conditions of the wind velocity thereby varying the angle of attack of the kite in said steady state wind velocity conditions for effectively varying the position of the wind-bearing surfaces relative to the relative wind and thereby varying the pressure applied by said wind to said wind-bearing surfaces during constant wind velocity conditions, and said elastic member having elasticity for responding to the varying pressure of the wind on the wind-bearing surfaces in response to the pressure variations continuously varying the diehedral angle synchronously with the varying angle of attack and wind pressure thereby to effect fluttering of said two halves during said conditions of constant velocity of the wind itself.

19. A kite having a leading edge portion and a trailing edge portion, according to claim 18, in which a kite string for flying said kite is attached to said kite having at least a projection thereof passing through said point of equilibrium.

* * * * *